US008132419B2

(12) United States Patent
Yonemori et al.

(10) Patent No.: US 8,132,419 B2
(45) Date of Patent: Mar. 13, 2012

(54) REFRIGERATION SYSTEM AND REFRIGERATION SYSTEM ANALYZER

(75) Inventors: Tsuyoshi Yonemori, Osaka (JP); Yoshinari Sasaki, Osaka (JP); Takahiro Yamaguchi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 611 days.

(21) Appl. No.: 12/225,485

(22) PCT Filed: Mar. 23, 2007

(86) PCT No.: PCT/JP2007/056032

§ 371 (c)(1),
(2), (4) Date: Sep. 23, 2008

(87) PCT Pub. No.: WO2007/108537

PCT Pub. Date: Sep. 27, 2007

(65) Prior Publication Data

US 2009/0151377 A1 Jun. 18, 2009

(30) Foreign Application Priority Data

Mar. 23, 2006 (JP) ..... 2006-080687
Feb. 21, 2007 (JP) ..... 2007-040803

(51) Int. Cl.
*F25B 49/02* (2006.01)

(52) U.S. Cl. ..... 62/125; 62/127; 62/203; 62/204; 62/208

(58) Field of Classification Search ..... 62/125, 62/127, 203, 204, 208
See application file for complete search history.

(56) References Cited

U.S. PATENT DOCUMENTS 4,510,576 A * 4/1985 MacArthur et al. ..... 702/182
5,073,862 A * 12/1991 Carlson ..... 702/185
5,559,691 A 9/1996 Monta et al.
5,758,506 A * 6/1998 Hancock et al. ..... 62/77
2005/0262856 A1* 12/2005 Street et al. ..... 62/129
2005/0268625 A1* 12/2005 Sienel et al. ..... 62/129
2006/0042276 A1* 3/2006 Doll et al. ..... 62/129
2006/0053811 A1* 3/2006 Lifson et al. ..... 62/196.3

FOREIGN PATENT DOCUMENTS

JP 58-062403 A 4/1983
JP 6-331781 A 12/1994
JP 7-071803 A 3/1995
JP 9-152237 A 6/1997
JP 2001-021192 A 1/2001
JP 2001-041615 A 2/2001
JP 2001-133011 A 5/2001
JP 2001-263756 A 9/2001
JP 2005-121248 A 5/2005

* cited by examiner

*Primary Examiner* — Cheryl J Tyler
*Assistant Examiner* — Jonathan Bradford
(74) *Attorney, Agent, or Firm* — Birch, Stewart, Kolasch & Birch, LLP

(57) ABSTRACT

In a refrigeration system (10) that includes a refrigerant circuit (20) configured by connecting a plurality of circuit component parts including a compressor (30), a pressure reduction device (36, 39) and a plurality of heat exchangers (34, 37) and operates in a refrigeration cycle by circulating refrigerant through the refrigerant circuit (20), a refrigerant state detection section (51) is provided for detecting the refrigerant temperatures and entropies at the entrance and exit of each of the compressor (30), the pressure reduction device (36, 39) and the heat exchangers (34, 37), and a variation calculation section (52) is provided that uses the refrigerant temperatures and entropies detected by the refrigerant state detection section (51) to separately calculate the magnitude of energy variation of refrigerant produced in each of the circuit component parts.

17 Claims, 25 Drawing Sheets

FIG. 2

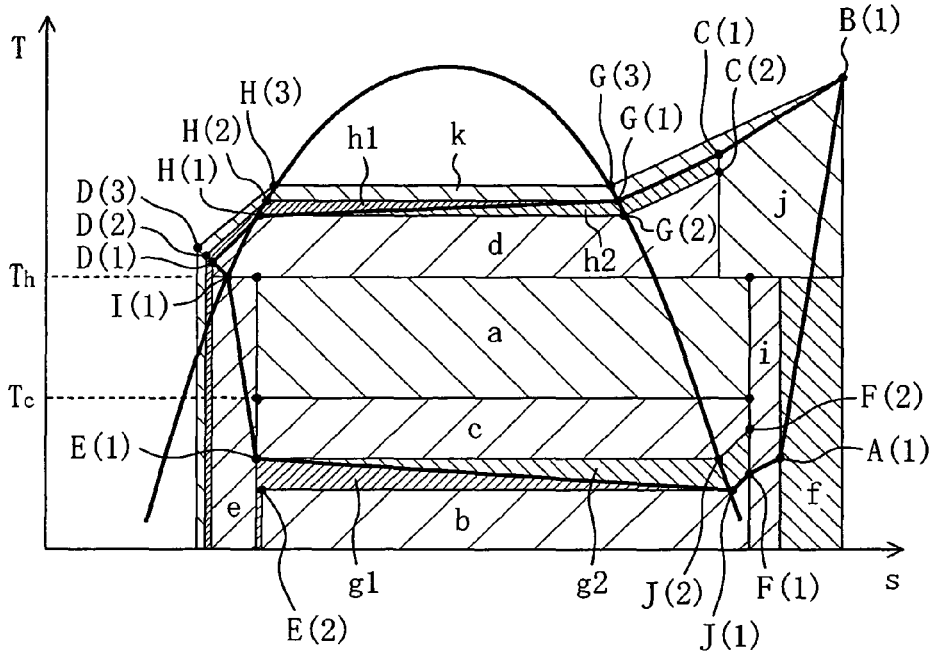

a:WORKLOAD OF REVERSE CARNOT CYCLE
b:QUANTITY OF HEAT TAKEN IN INDOOR HEAT EXCHANGER
c:LOSS INVOLVED IN HEAT EXCHANGE OF INDOOR HEAT EXCHANGER
d:LOSS INVOLVED IN HEAT EXCHANGE OF OUTDOOR HEAT EXCHANGER
e:FRICTION LOSS IN EXPANSION VALVE
f:LOSS DUE TO MECHANICAL FRICTION IN COMPRESSOR
g1:PRODUCTION OF FRICTIONAL HEAT IN INDOOR HEAT EXCHANGER
g2:PRESSURE LOSS IN INDOOR HEAT EXCHANGER
h1:PRODUCTION OF FRICTIONAL HEAT IN OUTDOOR HEAT EXCHANGER
h2:PRESSURE LOSS IN OUTDOOR HEAT EXCHANGER
i:LOSS DUE TO HEAT PENETRATION OR PRESSURE LOSS BETWEEN INDOOR HEAT EXCHANGER AND COMPRESSOR
j:LOSS DUE TO HEAT RELEASE BETWEEN COMPRESSOR AND OUTDOOR HEAT EXCHANGER
k:PRESSURE LOSS BETWEEN COMPRESSOR AND OUTDOOR HEAT EXCHANGER

FIG. 4A NORMAL OPERATING CONDITION
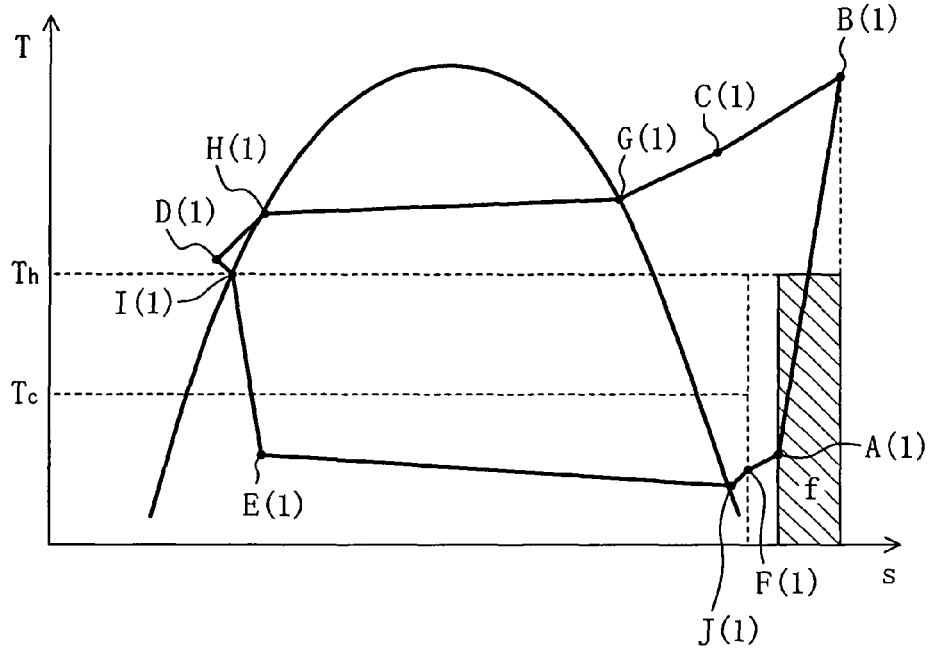
FIG. 4B AT DIAGNOSIS
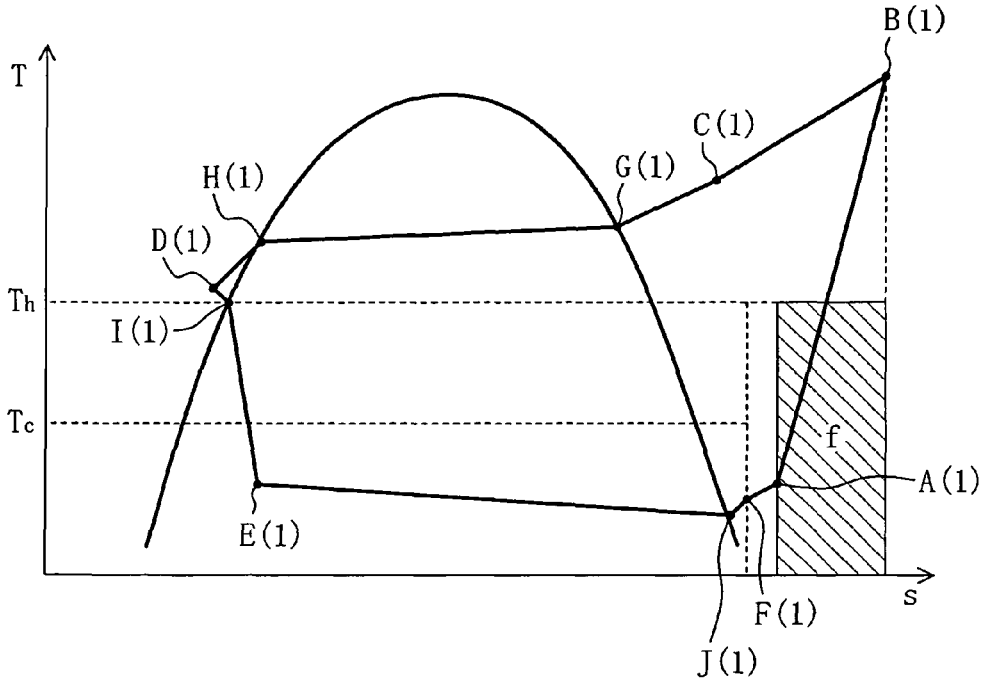

FIG. 6A NORMAL OPERATING CONDITION
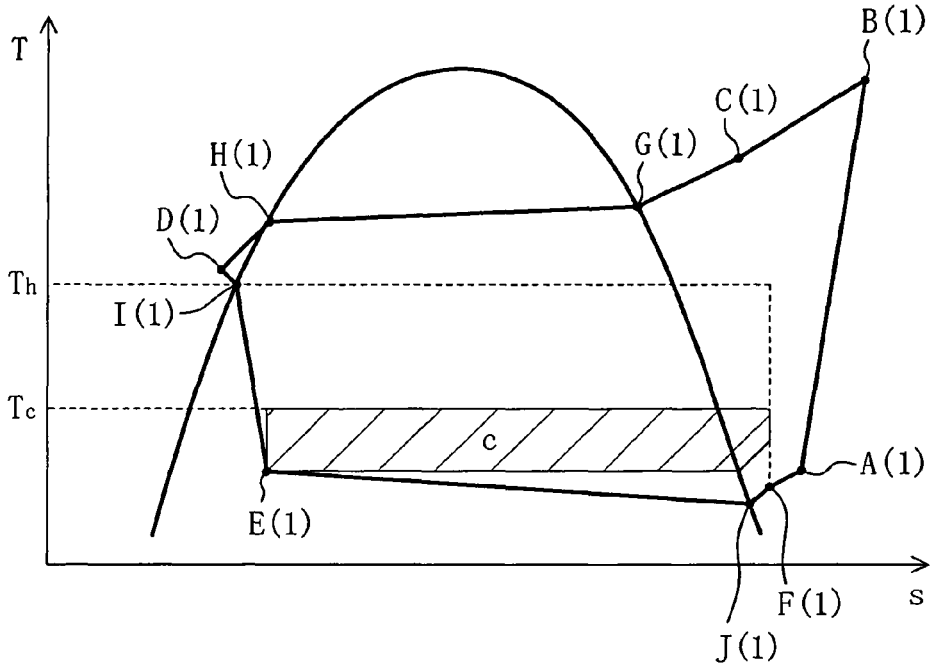
FIG. 6B AT DIAGNOSIS
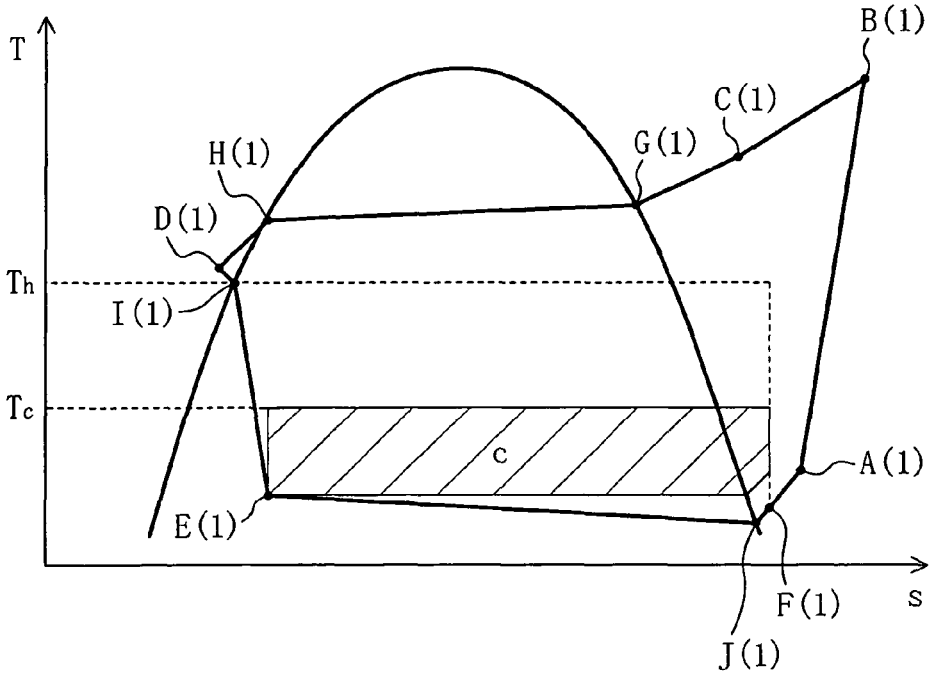

FIG. 8A NORMAL OPERATING CONDITION
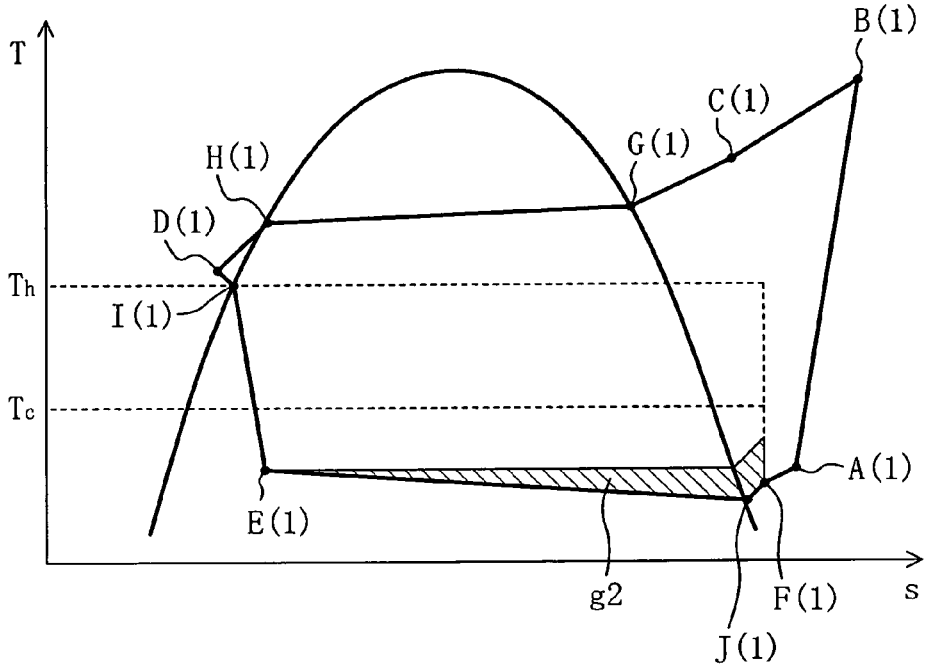
FIG. 8B AT DIAGNOSIS
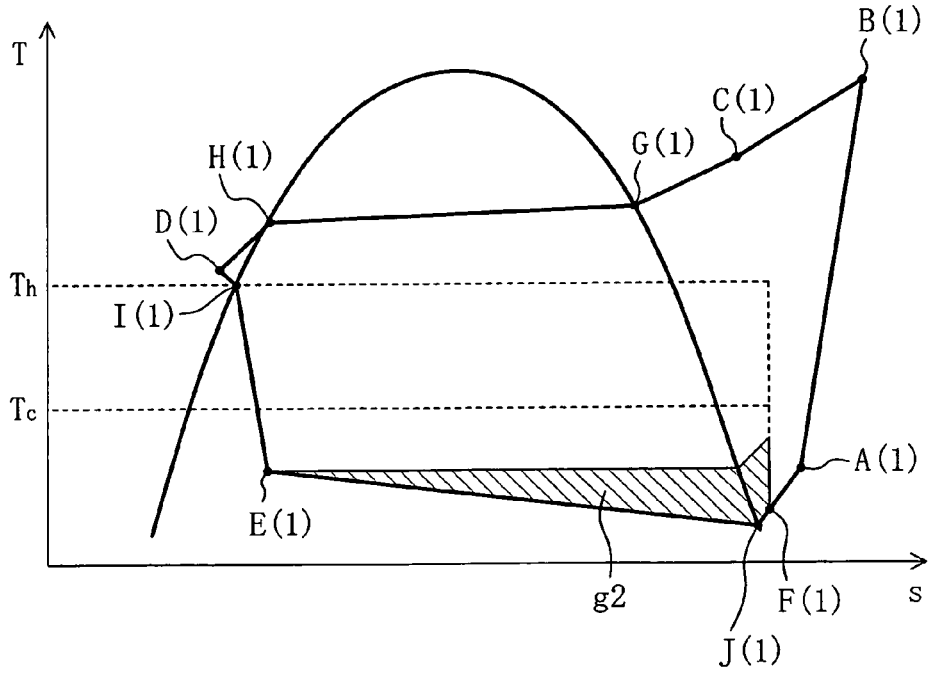

a:WORKLOAD OF REVERSE CARNOT CYCLE
c:LOSS INVOLVED IN HEAT EXCHANGE OF INDOOR HEAT EXCHANGER
d:LOSS INVOLVED IN HEAT EXCHANGE OF OUTDOOR HEAT EXCHANGER
e:FRICTION LOSS IN EXPANSION VALVE
f:LOSS DUE TO MECHANICAL FRICTION IN COMPRESSOR

FIG. 27
| | |
|---|---|
| COMPRESSOR LOSS | ○ |
| EVAPORATOR LOSS | ☆ |
| EXPANSION VALVE LOSS | ○ |
| CONDENSER LOSS | ○ |
| THEORETICAL POWER | ○ |
FIG. 28
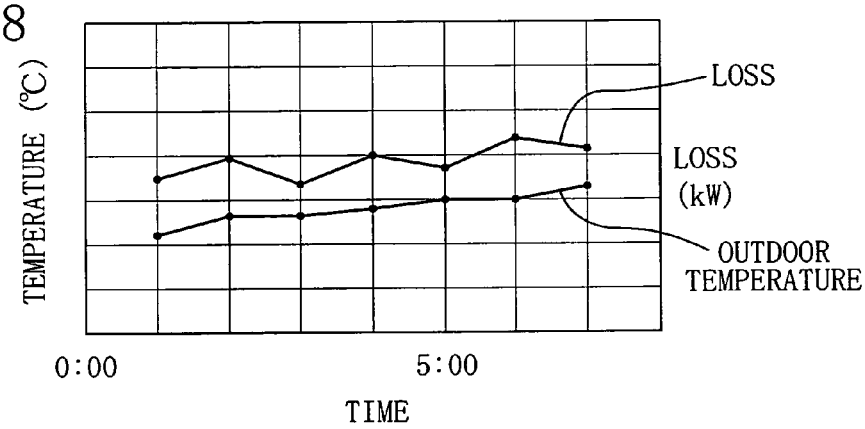
FIG. 29
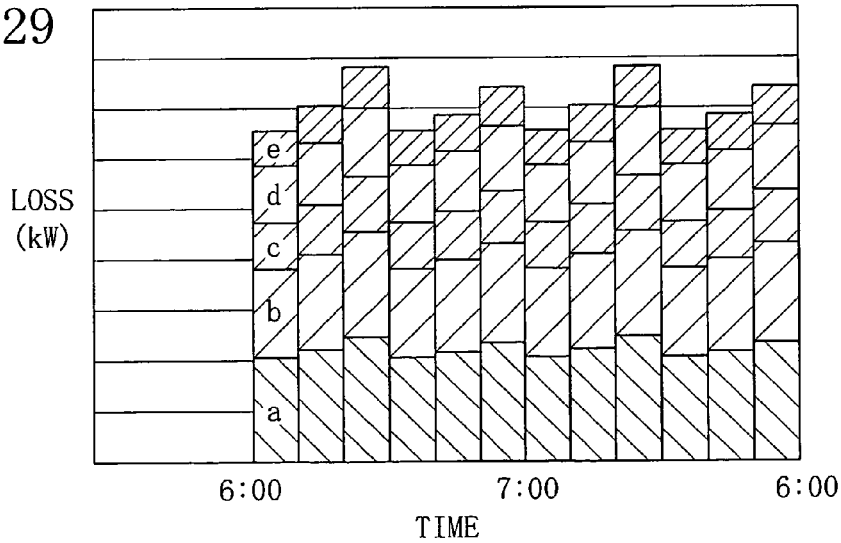
a:WORKLOAD OF REVERSE CARNOT CYCLE
b:QUANTITY OF HEAT TAKEN IN INDOOR HEAT EXCHANGER
c:LOSS INVOLVED IN HEAT EXCHANGE OF INDOOR HEAT EXCHANGER
d:LOSS INVOLVED IN HEAT EXCHANGE OF OUTDOOR HEAT EXCHANGER
e:FRICTION LOSS IN EXPANSION VALVE

REFRIGERATION SYSTEM AND REFRIGERATION SYSTEM ANALYZER

TECHNICAL FIELD

This invention relates to refrigeration systems having the function of analyzing their own condition and analyzers for refrigeration systems.

BACKGROUND ART

Among various conventional refrigeration systems including a refrigerant circuit operable in a vapor compression refrigeration cycle, there are known refrigeration systems having the function of analyzing their own condition. Refrigeration systems of such kind are configured to analyze their own condition by comparing an operating condition determined from detected values such as of temperature sensors and pressure sensors with a normal operating condition.

Specifically, Patent Document 1 discloses an air conditioner using Mollier diagrams showing the relation between pressure and enthalpy to analyze the condition of the refrigeration system and thereby diagnose whether its component devices are normal or defective. The air conditioner includes as component devices of its outdoor unit a compressor, a four-way selector valve and an outdoor heat exchanger and includes as a component device of its indoor unit an indoor heat exchanger. Furthermore, a diagnoser (controller) for the air conditioner includes a numerical value conversion means, a first input means, a first characteristic calculation means, a second characteristic calculation means, a characteristic diagnosis means and a result display means.

When in the above air conditioner the diagnoser outputs a diagnosis start instruction, the numerical value conversion means first converts the voltage values of temperatures and pressures detected by temperature sensors and pressure sensors to numerical values. Furthermore, by means of the first input means, the respective amounts of refrigerant in the outdoor and indoor units, the length of the connecting pipe and other data are input. Next, the first characteristic calculation means makes a Mollier diagram of the air conditioner in a normal condition based on data obtained from the first input means and the numerical value conversion means. Next, the second characteristic calculation means makes a Mollier diagram of the air conditioner in operation. Then, the characteristic diagnosis means compares the Mollier diagram in the normal condition from the first characteristic calculation means with the Mollier diagram in operation from the second characteristic calculation means to identify a place of failure or a reason for failure. Then, the result display means displays details of the diagnosis of the characteristic diagnosis means.

Patent Document 1: Published Japanese Patent Application No. 2001-133011

DISCLOSURE OF THE INVENTION

Problems to be Solved by the Invention

The known refrigeration systems can analyze the general condition of the refrigeration cycle by comparison of the Mollier diagram in the normal operating condition with the Mollier diagram at diagnosis. However, it is difficult for the known refrigeration systems to analyze the conditions of their individual component devices in detail.

Specifically, what is detected by comparison of the Mollier diagram in the normal operating condition with the Mollier diagram at diagnosis are, for example, the difference between air conditioning performance in the normal operating condition and that at analysis, the pressure difference between discharged refrigerant or sucked refrigerant in the normal operating condition and that at analysis, and the temperature difference between discharged refrigerant or sucked refrigerant in the normal operating condition and that at analysis. The numerical values indicating these differences between the characteristics in the normal operating condition and those at analysis do not depend only on the conditions of the individual component devices. In addition, the numerical values often have different units, which makes it difficult to correlate them with each other. Therefore, it is difficult to analyze the conditions of the individual component devices separately.

Furthermore, the known refrigeration systems cannot analyze the conditions of their component parts (for example, refrigerant pipes connecting between their component devices) other than their component devices.

The present invention has been made in view of the foregoing points and, therefore, an object thereof is to provide a refrigeration system having the function of separately analyzing the conditions of circuit component parts connected in a refrigerant circuit and constituting the refrigerant circuit.

Means to Solve the Problems

A first aspect of the invention is directed to a refrigeration system that includes a refrigerant circuit (20) configured by connecting a plurality of circuit component parts including a compressor (30), a pressure reduction device (36, 39) and a plurality of heat exchangers (34, 37) and operates in a refrigeration cycle by circulating refrigerant through the refrigerant circuit (20). Furthermore, the refrigeration system (10) further includes: refrigerant state detection means (51) for detecting the refrigerant temperatures and entropies at the entrance and exit of each of the compressor (30), the pressure reduction device (36, 39) and the heat exchangers (34, 37); and variation calculation means (52) that uses the refrigerant temperatures and entropies detected by the refrigerant state detection means (51) to separately calculate the magnitude of energy variation of refrigerant produced in each of the circuit component parts.

A second aspect of the invention is the refrigeration system according to the first aspect of the invention and further including: fluid-handling parts (12, 14, 28, 75, 76*b*) through each of which fluid exchanging heat with the refrigerant in the associated heat exchanger (34, 37) flows; and diagnosing means (54) for treating at least one of the circuit component parts and the fluid-handling parts (12, 14, 28, 75, 76*b*) as a part to be diagnosed and diagnosing the condition of the part to be diagnosed based on the value calculated by the variation calculation means (52).

A third aspect of the invention is the refrigeration system according to the second aspect of the invention and further including fans (12, 14) for sending air to the respective heat exchangers (34, 37), the fans (12, 14) constituting the individual fluid-handling parts (12, 14, 28, 75, 76*b*), the diagnosing means (54) being configured to treat each of the fans (12, 14) as the part to be diagnosed and diagnose the condition of each of the fans (12, 14) based on the value calculated by the variation calculation means (52).

A fourth aspect of the invention is the refrigeration system according to the second or third aspect of the invention, wherein the variation calculation means (52) calculates the magnitude of energy variation of refrigerant produced in each of the circuit component parts as a value of loss produced in the circuit component part, and the diagnosing means (54)

diagnoses the condition of the part to be diagnosed based on the value calculated as the value of loss by the variation calculation means (52).

A fifth aspect of the invention is the refrigeration system according to the fourth aspect of the invention, wherein the variation calculation means (52) separately calculates the value of each of plural types of losses produced in each of the heat exchangers (34, 37), and the diagnosing means (54) diagnoses, for the losses produced in each of the heat exchangers (34, 37), the condition of the part to be diagnosed based on the value calculated for each of the plural types of losses by the variation calculation means (52).

A sixth aspect of the invention is the refrigeration system according to the fourth or fifth aspect of the invention, wherein the refrigerant circuit (20) includes a main circuit (66) including the compressor (30) for compressing the refrigerant to a high-side pressure in the refrigeration cycle and a plurality of branch circuits (67) connected in parallel with each other to the main circuit (66), the refrigeration system further includes flow volume calculation means (56) for calculating the refrigerant flow volume in each of the branch circuits (67), and the variation calculation means (52) calculates the value of loss produced in each of the circuit component parts using the refrigerant flow volume in each of the branch circuits (67) calculated by the flow volume calculation means (56).

A seventh aspect of the invention is the refrigeration system according to the sixth aspect of the invention, wherein the refrigerant circuit (20) includes the plurality of branch circuits (67) provided with their respective heat exchangers (34, 37), and the variation calculation means (52) calculates the value of loss produced in the heat exchanger (34, 37) in each of the branch circuits (67) using the refrigerant flow volume in the branch circuit (67) calculated by the flow volume calculation means (56).

An eighth aspect of the invention is the refrigeration system according to any one of the fourth to seventh aspects of the invention and further including loss storage means (53) for storing the magnitude of loss produced in each of the circuit component parts in a normal operating condition as a reference value of loss, the diagnosing means (54) being configured to diagnose the condition of the part to be diagnosed based on the value calculated by the variation calculation means (52) and the reference value of loss stored in the loss storage means (53).

A ninth aspect of the invention is the refrigeration system according to the eighth aspect of the invention, wherein the diagnosing means (54) diagnoses the condition of the part to be diagnosed by comparing, for the loss produced in each of the circuit component parts, the value of loss calculated by the variation calculation means (52) with the reference value of loss stored in the loss storage means (53).

A tenth aspect of the invention is the refrigeration system according to the eighth or ninth aspect of the invention, wherein the loss storage means (53) stores the reference values of losses in normal operating conditions under a plurality of operating situations, and the diagnosing means (54) uses, out of the reference values of losses stored in the loss storage means (53), the reference value of loss under the operating situation corresponding to the operating situation at diagnosis to diagnose the condition of the part to be diagnosed.

An eleventh aspect of the invention is the refrigeration system according to any one of the second to seventh aspects of the invention, wherein the diagnosing means (54) diagnoses the condition of the part to be diagnosed based on a variation with time of the value calculated by the variation calculation means (52).

A twelfth aspect of the invention is the refrigeration system according to any one of the second to eleventh aspects of the invention and further including a display (55) for displaying a diagnosis result of the diagnosing means (54) on the condition of the part to be diagnosed.

A thirteenth aspect of the invention is the refrigeration system according to any one of the first to twelfth aspects of the invention, wherein the refrigerant circuit (20) is provided with pairs of one temperature sensor (45) and one pressure sensor (46), one pair at each of one end and the other end of each of the compressor (30) and the heat exchangers (34, 37), to measure the refrigerant temperatures and pressures at the entrances and exits of the compressor (30) and the heat exchangers (34, 37), and the refrigerant state detection means (51) is configured to consider the refrigerant temperature and entropy at the entrance of the pressure reduction device (36, 39) as the same values as those at the exit of the heat exchanger (34, 37) serving as a gas cooler and consider the refrigerant temperature and entropy at the exit of the pressure reduction device (36, 39) as the same values as those at the entrance of the heat exchanger (34, 37) serving as an evaporator.

A fourteenth aspect of the invention is the refrigeration system according to the first aspect of the invention and further including a display (55) for displaying, based on the value calculated by the variation calculation means (52), the state of energy variation of refrigerant produced in each of the circuit component parts as data for diagnosing the refrigeration system (10).

A fifteenth aspect of the invention is directed to a refrigeration system analyzer (60) for analyzing the condition of a refrigeration system (10) that includes a refrigerant circuit (20) configured by connecting a plurality of circuit component parts including a compressor (30), a pressure reduction device (36, 39) and a plurality of heat exchangers (34, 37) and operates in a refrigeration cycle by circulating refrigerant through the refrigerant circuit (20), the refrigeration system analyzer (60) being connected to the refrigeration system (10). Furthermore, the refrigeration system analyzer (60) includes: refrigerant state detection means (51) for detecting the refrigerant temperatures and entropies at the entrance and exit of each of the compressor (30), the pressure reduction device (36, 39) and the heat exchangers (34, 37); variation calculation means (52) that uses the refrigerant temperatures and entropies detected by the refrigerant state detection means (51) to separately calculate the magnitude of energy variation of refrigerant produced in each of the circuit component parts; and a display (55) for displaying an analysis result on the condition of the refrigeration system (10) based on the value calculated by the variation calculation means (52).

A sixteenth aspect of the invention is the refrigeration system analyzer according to the fifteenth aspect of the invention, wherein the refrigeration system (10) further includes fluid-handling parts (12, 14, 28, 75, 76*b*) through each of which fluid exchanging heat with the refrigerant in the associated heat exchanger (34, 37) flows, the refrigeration system analyzer further includes diagnosing means (54) for treating at least one of the circuit component parts and the fluid-handling parts (12, 14, 28, 75, 76*b*) as a part to be diagnosed and diagnosing the condition of the part to be diagnosed based on the value calculated by the variation calculation means (52), and the display (55) displays, as the analysis result on the condition of the refrigeration system (10), a diagnosis result of the diagnosing means (54) on the condition of the part to be diagnosed.

A seventeenth aspect of the invention is the refrigeration system analyzer according to the fifteenth or sixteenth aspect of the invention, wherein the display (55) displays, based on the value calculated by the variation calculation means (52), the state of energy variation of refrigerant produced in each of the circuit component parts as the analysis result on the condition of the refrigeration system (10).

An eighteenth aspect of the invention is the refrigeration system analyzer according to any one of the fifteenth to seventeenth aspects of the invention, wherein the refrigeration system analyzer is composed of: a first component unit (47) that includes at least a refrigerant state detection sensor (65) for detecting states of refrigerant in the refrigerant circuit (20) necessary to detect the refrigerant temperatures and entropies at the entrance and exit of each of the compressor (30), the pressure reduction device (36, 39) and the heat exchangers (34, 37) and is disposed in the refrigeration system (10); and a second component unit (48) including at least a display (55) and disposed away from the refrigeration system (10), and the first component unit (47) and the second component unit (48) are connected to each other via communication lines (63).

A nineteenth aspect of the invention is the refrigeration system analyzer according to any one of the fifteenth to seventeenth aspects of the invention and further including a refrigerant state detection sensor (65) for detecting states of refrigerant in the refrigerant circuit (20) necessary to detect the refrigerant temperatures and entropies at the entrance and exit of each of the compressor (30), the pressure reduction device (36, 39) and the heat exchangers (34, 37), the refrigerant state detection sensor (65) being mountable to the refrigerant circuit (20), the refrigerant state detection means (51) using measured values of the refrigerant state detection sensor (65) to calculate the refrigerant temperatures and entropies at the entrance and exit of each of the compressor (30), the pressure reduction device (36, 39) and the heat exchangers (34, 37).

A twentieth aspect of the invention is the refrigeration system analyzer according to the nineteenth aspect of the invention, wherein the refrigerant state detection sensor (65) comprises a plurality of temperature sensors (65), one mounted to the heat exchanger (34, 37) serving as a gas cooler and another mounted to the heat exchanger (34, 37) serving as an evaporator, and the refrigerant state detection means (51) calculates the refrigerant temperatures and entropies at the entrance and exit of each of the compressor (30), the pressure reduction device (36, 39) and the heat exchangers (34, 37) by calculating the high-side refrigerant pressure in the refrigeration cycle based on the measured value of the temperature sensor (65) mounted to the heat exchanger (34, 37) serving as a gas cooler and calculating the low-side refrigerant pressure in the refrigeration cycle based on the measured value of the temperature sensor (65) mounted to the heat exchanger (34, 37) serving as an evaporator.

-Operations-

In the first aspect of the invention, the variation calculation means (52) uses the refrigerant temperatures and entropies detected by the refrigerant state detection means (51) to separately calculate the magnitude of energy variation of refrigerant produced in each of the circuit component parts including the compressor (30), the pressure reduction device (36, 39) and the heat exchangers (34, 37) (hereinafter, referred to these component devices as main component devices). With the use of the refrigerant temperatures and entropies at the exits and entrances of the main component devices, the magnitude of energy variation of refrigerant produced in each circuit component part can be separately calculated. Specifically, in a T-s diagram plotted using the refrigerant temperatures and entropies at the exits and entrances of the main component devices, the respective magnitudes of variations in refrigerant energy produced in the circuit component parts are expressed as the respective areas of associated regions shown in FIG. 2. Therefore, the magnitude of energy variation of refrigerant produced in each circuit component part can be calculated from the area of the associated region. In the first aspect of the invention, the magnitude of energy variation of refrigerant produced in each circuit component part is separately calculated using the fact that the respective magnitudes of variations in refrigerant energy produced in the circuit component parts are shown in the T-s diagram.

In the second aspect of the invention, the diagnosing means (54) treats at least one of the circuit component parts and the fluid-handling parts (12, 14, 28, 75, 76*b*) as a part to be diagnosed and diagnoses the condition of the part to be diagnosed based on the magnitude of energy variation of refrigerant produced in the associated circuit component part.

The magnitude of energy variation of refrigerant produced in each circuit component part represents, for example, the magnitude of loss produced in the circuit component part and depends on the condition of the circuit component part. For example, since the magnitude of energy variation of refrigerant produced in the compressor (30) serving as a circuit component part represents the magnitude of loss produced in the compressor (30), it mainly represents the magnitude of mechanical friction in the compressor (30) and depends on the state of deterioration of a sliding member of the compressor (30), such as a bearing, or the state of deterioration of refrigerating machine oil.

Furthermore, the magnitude of energy variation of refrigerant produced in some of the circuit component parts depends not only on the condition of that circuit component part but also on the condition of the fluid-handling part (12, 14, 28, 75, 76*b*) through which fluid for exchanging heat with refrigerant flowing through the heat exchanger (34, 37) flows. For example, since the magnitude of energy variation of refrigerant produced in each heat exchanger (34, 37) serving as a circuit component part represents the magnitude of loss mainly involved in heat exchange and the flow of refrigerant, it depends not only on the condition of the pipe for the heat exchanger (34, 37) itself but also on the operating condition of a fan serving as a fluid-handling part (12, 14, 28, 75, 76*b*) associated with the heat exchanger (34, 37) or the condition of a filter serving as another fluid-handling part (12, 14, 28, 75, 76*b*) associated with the heat exchanger (34, 37).

As described above, the magnitude of energy variation of refrigerant produced in each circuit component part depends on the condition of the circuit component part and the condition of the associated fluid-handling part (12, 14, 28, 75, 76*b*). Therefore, in the second aspect of the invention, the condition of each circuit component part or the condition of the associated fluid-handling part (12, 14, 28, 75, 76*b*) is separately diagnosed based on the magnitude of energy variation of refrigerant produced in the circuit component part.

In the third aspect of the invention, the diagnosing means (54) treats each of the fans (12, 14) for sending air to the associated heat exchanger (34, 37) as the part to be diagnosed. The condition of each fan (12, 14) is diagnosed based on the magnitude of energy variation of refrigerant produced in the associated circuit component part.

In the fourth aspect of the invention, the variation calculation means (52) calculates the magnitude of energy variation of refrigerant produced in each circuit component part as a value of loss produced in the circuit component part. The diagnosing means (54) diagnoses the condition of the part to be diagnosed based on the value of loss produced in the associated circuit component part.

In the fifth aspect of the invention, for the losses produced in each of the heat exchangers (34, 37) constituting part of the circuit component parts, the values of plural types of losses produced therein are calculated. Then, the value of loss for each of plural types of losses is used to diagnose the condition of the part to be diagnosed. Specifically, with the use of the refrigerant temperatures and entropies at the exits and entrances of the main component devices, the values of losses for plural types of losses in each heat exchanger (34, 37) can be calculated. For example, in the above-stated T-s diagram (see FIG. 2), the loss in the evaporator or the gas cooler is subdivided into the loss involved in heat exchange, the loss involved in production of frictional heat and the pressure loss due to channel resistance. Therefore, in the fifth aspect of the invention, the loss in each heat exchanger (34, 37) is subdivided into plural types of losses and the value of each subdivided loss is used for diagnosis of the condition of the associated part to be diagnosed.

In the sixth aspect of the invention, the refrigerant circuit (20) includes a main circuit (66) and a plurality of branch circuits (67). For the refrigerant circuit (20) in which refrigerant in the main circuit (66) is distributed to the plurality of branch circuits (67), its refrigeration cycle can be expressed by T-s diagrams, one for each branch circuit (67). In the T-s diagram for each branch circuit (67), the area of the region for each circuit component part provided in the branch circuit (67) represents the magnitude of loss produced in the circuit component part in the branch circuit (67) as a value per unit refrigerant flow volume. Furthermore, in the above T-s diagram, the area of the region for each circuit component part provided in the main circuit (66) represents, out of the magnitude of total loss produced in the circuit component part in the main circuit (66), the magnitude of loss corresponding to the ratio of the refrigerant flow volume flowing into the branch circuit (67) to the refrigerant flow volume in the main circuit (66) as a value per unit refrigerant flow volume.

Furthermore, in the sixth aspect of the invention, the value of loss produced in each circuit component part in the main circuit (66) and the branch circuits (67) is calculated using the refrigerant flow volume or volumes in the associated branch circuit or circuits (67) calculated by the flow volume calculation means (56). For example, the value of loss produced in each circuit component part of each branch circuit (67) is calculated by multiplying the area of the region of the T-s diagram for the branch circuit (67) associated with the loss by the refrigerant flow volume in the branch circuit (67) calculated by the flow volume calculation means (56). On the other hand, the value of loss produced in each circuit component part of the main circuit (66) is calculated by multiplying the respective areas of the regions of the T-s diagrams for the branch circuits (67) associated with the loss by the respective refrigerant flow volumes of the branch circuits (67) and summing the obtained values.

In the seventh aspect of the invention, refrigerant flows distributed from the main circuit (66) run through the respective heat exchangers (34, 37) in the branch circuits (67). The refrigerant flows having run through the respective heat exchangers (34, 37) in the branch circuits (67) meet and then return to the main circuit (66). The value of loss in the heat exchanger (34, 37) in each branch circuit (67) is calculated using the refrigerant flow volume in the branch circuit (67) calculated by the flow volume calculation means (56).

In the eighth aspect of the invention, the diagnosing means (54) diagnoses the condition of the part to be diagnosed based on the value of loss in the associated circuit component part in a normal operating condition and the value of loss in the circuit component part at diagnosis. In other words, the condition of the part to be diagnosed is diagnosed with reference to the value of loss in a normal operating condition.

In the ninth aspect of the invention, the diagnosis of the condition of the part to be diagnosed is made by comparing, for the loss produced in each of the circuit component parts, the value of loss calculated by the variation calculation means (52) with the reference value of loss stored in the loss storage means (53). Therefore, the difference between the condition of the part to be diagnosed in the normal operating condition and that at diagnosis is clearly comprehended for the loss produced in each of the circuit component parts.

In the tenth aspect of the invention, out of the reference values of losses stored in the loss storage means (53), the reference value of loss under the operating situation corresponding to the operating situation at diagnosis is used to diagnose the condition of the part to be diagnosed. In other words, the reference value of loss under the same operating situation as the operating condition at diagnosis or, if not the same operating situation, the reference value of loss under the nearest operating situation to the operating condition at the diagnosis is selected from among the plurality of reference values of losses under the plurality of operating situations and used as the reference value of loss in the normal operating condition to diagnose the condition of the part to be diagnosed.

In the eleventh aspect of the invention, a variation with time of the value calculated by the variation calculation means (52) is used for diagnosis of the condition of the part to be diagnosed. In the refrigeration system (10) that compares the stored value of loss in the normal operating condition with the value of loss at diagnosis, the environment of installation of the refrigeration system (10) expected upon calculation of the value of loss in the normal operating condition (for example, the volume of the space to be conditioned in temperature) may be different from the actual environment of installation of the refrigeration system (10). If the expected environment of installation is different from the actual environment of installation, the difference value between the value of loss in the normal operating condition and the value of loss at diagnosis will by affected by such a difference in environment of installation. To cope with this, since in the eleventh aspect of the invention a variation with time of the value calculated by the variation calculation means (52) is used for diagnosis of the condition of the part to be diagnosed, only the value of loss in the same environment of installation is used for the diagnosis of the condition of the part to be diagnosed.

In the twelfth aspect of the invention, the refrigeration system (10) includes a display (55). Displayed on the display (55) is a diagnosis result of the diagnosing means (54) on the condition of the part to be diagnosed. Thus, the user of the refrigeration system (10) can know the condition of the part to be diagnosed by checking the indication on the display (55).

In the thirteenth aspect of the invention, the refrigerant temperature and entropy at the entrance of the pressure reduction device (36, 39) is detected as the same values as those at the exit of the heat exchanger (34, 37) serving as a gas cooler. Furthermore, the refrigerant temperature and entropy at the exit of the pressure reduction device (36, 39) is detected as the same values as those at the entrance of the heat exchanger (34, 37) serving as an evaporator. In other words, even if the pressure reduction device (36, 39) is not provided with two pairs of one temperature sensor and one pressure sensor, one pair at one end thereof and the other pair at the other end, the refrigerant temperatures and entropies at the exit and entrance of the pressure reduction device (36, 39) are detected.

In the fourteenth aspect of the invention, a display (55) displays the state of energy variation of refrigerant produced in each of the circuit component parts based on the calculated value. The state of energy variation of refrigerant produced in each of the circuit component parts is displayed as data for diagnosing the refrigeration system (10). As described previously, the state of energy variation of refrigerant produced in each circuit component part depends on the conditions of the circuit component part and other associated parts. Therefore, when, for example, a person having specialized knowledge about the refrigeration system (10) sees the state of energy variation of refrigerant in each circuit component part displayed on the display (55), he or she can diagnose the conditions of the circuit component part and other associated parts.

In the fifteenth aspect of the invention, the refrigeration system analyzer (60) includes a refrigerant state detection means (51) and a variation calculation means (52), which are the same as those in the first aspect of the invention. The variation calculation means (52) uses the refrigerant temperatures and entropies detected by the refrigerant state detection means (51) to separately calculate the magnitude of energy variation of refrigerant produced in each of the circuit component parts including the above-stated main component devices. Furthermore, the display (55) displays an analysis result on the condition of the refrigeration system (10) based on the value calculated by the variation calculation means (52). In the fifteenth aspect of the invention, like the first aspect of the invention, the magnitude of energy variation of refrigerant produced in each circuit component part is separately calculated using the fact that the respective magnitudes of variations in refrigerant energy produced in the circuit component parts are shown in a T-s diagram.

In the sixteenth aspect of the invention, the diagnosing means (54) treats at least one of the circuit component parts and the fluid-handling parts (12, 14, 28, 75, 76*b*) as a part to be diagnosed and diagnoses the condition of the part to be diagnosed based on the magnitude of energy variation of refrigerant produced in the associated circuit component part. The display (55) displays, as the analysis result on the condition of the refrigeration system (10), a diagnosis result of the diagnosing means (54) on the condition of the part to be diagnosed. As described previously, the magnitude of energy variation of refrigerant produced in each circuit component part depends on the condition of the circuit component part and the condition of the associated fluid-handling part (12, 14, 28, 75, 76*b*). Therefore, the condition of each circuit component part or the condition of the associated fluid-handling part (12, 14, 28, 75, 76*b*) is separately diagnosed based on the magnitude of energy variation of refrigerant produced in the circuit component part.

In the seventeenth aspect of the invention, the display (55) displays, based on the value calculated by the variation calculation means (52), the state of energy variation of refrigerant produced in each of the circuit component parts as the analysis result on the condition of the refrigeration system (10). Therefore, like the fourteenth aspect of the invention, when, for example, a person having specialized knowledge about the refrigeration system (10) sees the state of energy variation of refrigerant in each circuit component part displayed on the display (55), he or she can diagnose the conditions of the circuit component part and other associated parts.

In the eighteenth aspect of the invention, the refrigeration system analyzer (60) is composed of a first component unit (47) and a second component unit (48) which are connected via communication lines (63) to each other. The second component unit (48) includes a display (55) for displaying an analysis result on the condition of the refrigeration system (10) based on the value calculated by the variation calculation means (52). Therefore, the conditions of the circuit component parts can be checked away from the refrigeration system (10).

In the nineteenth aspect of the invention, the refrigerant state detection sensor (65) is mounted to the refrigerant circuit (20) in analyzing the conditions of the circuit component parts. Then, with the use of measured values of the refrigerant state detection sensor (65), the refrigerant state detection means (51) detects the refrigerant temperatures and entropies at the entrance and exit of each main component device and the variation calculation means (52) calculates the value of loss produced in each of the circuit component parts separately. In the nineteenth aspect of the invention, a person having specialized knowledge about the refrigeration system (10) can carry the analyzer for the refrigeration system (10) and analyze, at a site where the refrigeration system (10) is installed, the conditions of the circuit component parts.

In the twentieth aspect of the invention, the refrigerant state detection sensor (65) comprises a plurality of temperature sensors (65). Furthermore, the high-side refrigerant pressure in the refrigeration cycle is calculated based on the measured value of the temperature sensor (65) mounted to the heat exchanger (34, 37) serving as a gas cooler and the low-side refrigerant pressure in the refrigeration cycle is calculated based on the measured value of the temperature sensor (65) mounted to the heat exchanger (34, 37) serving as an evaporator. In order to calculate the refrigerant temperatures and entropies at the exit and entrance of each main component device, at least the high-side refrigerant pressure and the low-side refrigerant pressure in the refrigeration cycle are necessary. In the twentieth aspect of the invention, even if the refrigerant state detection sensor (65) includes no pressure sensor, the refrigerant temperatures and entropies at the exit and entrance of each main component device are calculated.

Effects of the Invention

In the present invention, the magnitude of energy variation of refrigerant produced in each circuit component part is separately calculated using the fact that the respective magnitudes of variations in refrigerant energy produced in the circuit component parts are shown in a T-s diagram plotted using the refrigerant temperatures and entropies at the exits and entrances of the main component devices. The magnitude of energy variation of refrigerant produced in each circuit component part represents, for example, the magnitude of loss produced in the circuit component part and depends on the condition of the circuit component part. Therefore, according to the present invention, the conditions of the circuit component parts can be separately analyzed.

In the second and sixteenth aspects of the invention, the condition of each circuit component part or the condition of the associated fluid-handling part (12, 14, 28, 75, 76*b*) is separately diagnosed using the magnitude of energy variation of refrigerant produced in the circuit component part and depending on the condition of the circuit component part or the associated fluid-handling part (12, 14, 28, 75, 76*b*). In addition, since the diagnosis is made not using physical values of different units but using those of the same unit, each of the conditions of the circuit component parts and the fluid-handling parts (12, 14, 28, 75, 76*b*) can be quantitatively comprehended. Therefore, the conditions of the circuit component parts and the fluid-handling parts (12, 14, 28, 75, 76*b*) can be diagnosed with precision.

In the fifth aspect of the invention, for the losses produced in each of the heat exchangers (34, 37), the diagnosing means (54) uses the value of each of plural types of subdivided losses to diagnose the condition of the part to be diagnosed. Therefore, the condition of the part to be diagnosed can be comprehended in further detail, which provides more precise diagnosis of the condition of the part to be diagnosed.

In the eighth aspect of the invention, the condition of the part to be diagnosed is diagnosed with reference to the value of loss in the normal operating condition. Therefore, the condition of the part to be diagnosed at diagnosis can be understood as a difference from that in the normal operating condition, which provides precise diagnosis of the condition of the part to be diagnosed.

In the ninth aspect of the invention, by comparing, for the loss produced in each of the circuit component parts, the value of loss calculated by the variation calculation means (52) with the reference value of loss stored in the loss storage means (53), the difference between the conditions of the part to be diagnosed in the normal operating condition and at diagnosis is clearly comprehended for the loss produced in each of the circuit component parts. In addition, since the comparison is made for the loss produced in each of the circuit component parts, this gives a clear comprehension of the difference between the conditions of the part to be diagnosed in the normal operating condition and at diagnosis even if the produced loss is small as the whole of the refrigeration system (10). Therefore, the condition of the part to be diagnosed can be diagnosed with higher precision.

In the tenth aspect of the invention, the diagnosis of the condition of the part to be diagnosed is made with the use of the reference value of loss under the same operating situation as the operating condition at diagnosis or, if not the same operating situation, the reference value of loss under the nearest operating situation to the operating condition at the diagnosis. Therefore, out of the difference value between the value of loss in the normal operating condition and the value of loss at diagnosis, a partial difference value derived from the difference between the operating situation for the reference value of loss and the operating situation at the diagnosis is reduced. In addition, the difference value between the values of losses in the normal operating condition and at diagnosis can express the difference between the conditions of the part to be diagnosed in the normal operating condition and at the diagnosis with higher precision, which provides more precise diagnosis of the condition of the part to be diagnosed.

Since in the eleventh aspect of the invention a variation with time of the value calculated by the variation calculation means (52) is used for diagnosis of the condition of the part to be diagnosed, only the value of loss in the same environment of installation is used for the diagnosis of the condition of the part to be diagnosed. Therefore, the value of loss used for diagnosis of the condition of the part to be diagnosed is not affected by the difference in environment of installation. This provides precise diagnosis of the condition of the part to be diagnosed.

Furthermore, even if the value of loss in the normal operating condition is not previously stored in the refrigeration system (10), the condition of the part to be diagnosed can be diagnosed. This saves the labor of storing the value of loss in the normal operating condition into the refrigeration system (10). Therefore, the production of the refrigeration system (10) can be facilitated.

In the eighteenth aspect of the invention, the refrigeration system analyzer includes the second component unit (48) including the display (55) and connected via communication lines (63) to the first component unit (47) located close to the refrigeration system (10). Therefore, the conditions of the circuit component parts can be checked away from the refrigeration system (10). Thus, a person having specialized knowledge about the refrigeration system (10) can monitor, instead of the user of the refrigeration system (10), the conditions of the circuit component parts. Therefore, the conditions of the circuit component parts and other associated parts can be diagnosed with higher precision.

According to the nineteenth aspect of the invention, a person having specialized knowledge about the refrigeration system (10) can carry the analyzer (60) for the refrigeration system (10) and analyze, on a site where the refrigeration system (10) is installed, the conditions of the circuit component parts. Therefore, the person having specialized knowledge about the refrigeration system (10), instead of the user of the refrigeration system (10), can check the conditions of the circuit component parts on site. Furthermore, since the analyzer (60) for the refrigeration system (10) includes the refrigerant state detection sensor (65), it can analyze, even for refrigeration systems (10) having no sensors for detecting the refrigerant temperatures and entropies at the exits and entrances of the main component devices, the conditions of their circuit component parts.

In the twentieth aspect of the invention, even if the refrigerant state detection sensor (65) includes no pressure sensor, the refrigerant temperatures and entropies at the exit and entrance of each main component device are calculated. Therefore, the conditions of the circuit component parts can be easily analyzed using the easily mountable temperature sensors (65).

BRIEF DESCRIPTION OF DRAWINGS

FIG. 2 is a T-s diagram segmentized into respective regions associated with circuit component parts whose values of losses are to be calculated in Embodiment 1 of the present invention.

FIG. 4A is a T-s diagram of the refrigeration system in a normal operating condition and FIG. 4B is an example of a T-s diagram of the refrigeration system at diagnosis.

FIG. 6A is a T-s diagram of the refrigeration system in a normal operating condition and FIG. 6B is an example of a T-s diagram of the refrigeration system at diagnosis.

FIG. 8A is a T-s diagram of the refrigeration system in a normal operating condition and FIG. 8B is an example of a T-s diagram of the refrigeration system at diagnosis.

FIG. 16 is T-s diagrams segmentized into respective regions associated with circuit component parts whose values of losses are to be calculated in Embodiment 2 of the present invention, wherein

FIG. 27 is a diagram showing still another way to display the losses of the circuit component parts on the display section in the sixth modification in "Other Embodiments".

FIG. 28 is a diagram showing a way to display the loss of each circuit component part on the display section in the sixth modification in "Other Embodiments".

FIG. 29 is a diagram showing still another way to display the losses of the circuit component parts on the display section in the sixth modification in "Other Embodiments".

LIST OF REFERENCE NUMERALS

Figure 1:
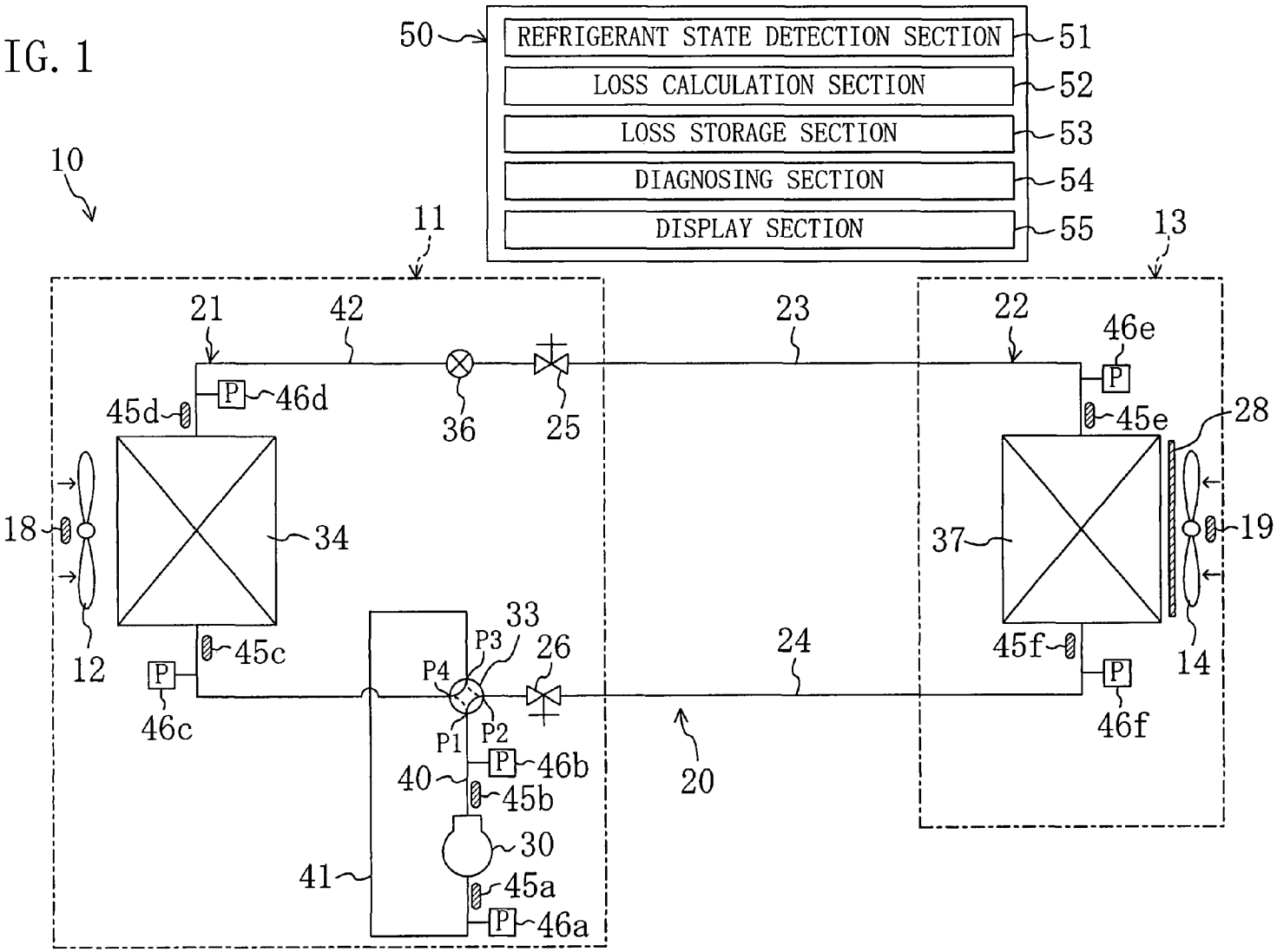
FIG. 1 is a schematic diagram of a refrigeration system according to Embodiment 1 of the present invention.

10 air conditioning system (refrigeration system)
20 refrigerant circuit
30 compressor (circuit component part)
34 outdoor heat exchanger (heat exchanger, circuit component part)
36 expansion valve, outdoor expansion valve (pressure reduction device, circuit component part)
37 indoor heat exchanger (heat exchanger, circuit component part)
39 indoor expansion valve (pressure reduction device, circuit component part)
45 temperature sensor
46 pressure sensor
51 refrigerant state detection section (refrigerant state detection means)
52 loss calculation section (variation calculation means)
53 loss storage section (loss storage means)
54 diagnosing section (diagnosing means)
55 display section (display)
56 flow volume calculation section (flow volume calculation means)
60 analyzer
65 refrigerant state detection sensor
66 main circuit
67 branch circuit

BEST MODE FOR CARRYING OUT THE INVENTION

Embodiments of the present invention will be described below in detail with reference to the drawings.

Embodiment 1 of the Invention

A description is given of Embodiment 1 of the present invention. Embodiment 1 is a refrigeration system (10) according to the present invention. As shown in FIG. 1, the refrigeration system (10) is an air conditioning system including an outdoor unit (11) and an indoor unit (13) and is configured to selectively perform a space-cooling operation (cooling operation) and a space-heating operation (heating operation).

The present invention is applicable to refrigeration systems (10) including a refrigerant circuit (20) operable in a refrigeration cycle. For example, the present invention is also applicable to refrigeration systems other than the air conditioning system according to Embodiment 1, including refrigeration systems for cooling foods (cold storages and freezers), refrigeration systems made up of a combination of an air conditioner, a cold storage and a freezer, refrigeration systems having the function of conditioning the humidity using heat of refrigerant flowing through a heat exchanger to heat or cool an adsorbent, and refrigeration systems having a hot-water supply function, such as a so-called "Eco-kyuto" (registered trademark).

-Configuration of Refrigeration System-

The outdoor unit (11) includes an outdoor circuit (21). The indoor unit (13) includes an indoor circuit (22). In the refrigeration system (10), a refrigerant circuit (20) operable in a vapor compression refrigeration cycle is formed by connecting the outdoor circuit (21) and the indoor circuit (22) to each other through a liquid side connection pipe (23) and a gas side connection pipe (24). The refrigerant circuit (20) is filled with, for example, chlorofluorocarbon-based refrigerant as refrigerant.

<<Outdoor Unit>>

The outdoor circuit (21) of the outdoor unit (11) includes as main component devices a compressor (30), an outdoor heat exchanger (34) serving as a heat-source side heat exchanger, and an expansion valve (36) serving as a pressure reduction device and further includes a four-way selector valve (33). These main component devices and the four-way selector valve (33) constitute individual circuit component parts and are connected to each other through refrigerant pipes also constituting individual circuit component parts. The circuit component parts are parts that constitute the refrigerant circuit (20) and through which refrigerant flows. One end of the outdoor circuit (21) is provided with a liquid side shut-off valve (25) connected to the liquid side connection pipe (23).

The other end of the outdoor circuit (21) is provided with a gas side shut-off valve (26) connected to the gas side connection pipe (24).

The compressor (30) is configured as a fully-enclosed, high-pressure domed compressor. The discharge side of the compressor (30) is connected through a discharge pipe (40) to the first port (P1) of the four-way selector valve (33). The suction side of the compressor (30) is connected through a suction pipe (41) to the third port (P3) of the four-way selector valve (33).

The outdoor heat exchanger (34) is configured as a cross-fin-and-tube heat exchanger. Disposed near the outdoor heat exchanger (34) is an outdoor fan (12) for sending outdoor air flowing therethrough to the outdoor heat exchanger (34). In the outdoor heat exchanger (34), heat is exchanged between outdoor air sent by the outdoor fan (12) and refrigerant flowing through the outdoor heat exchanger (34). The outdoor fan (12) constitutes a fluid-handling part through which air for exchanging heat with refrigerant in the outdoor heat exchanger (34) flows. One end of the outdoor heat exchanger (34) is connected to the fourth port (P4) of the four-way selector valve (33). The other end of the outdoor heat exchanger (34) is connected through a liquid pipe (42) to the liquid side shut-off valve (25). The liquid pipe (42) is provided with an expansion valve (36) variable in opening. Furthermore, the second port (P2) of the four-way selector valve (33) is connected to the gas side shut-off valve (26).

The four-way selector valve (33) is configured to be switchable between a first position (the position shown in the solid lines in FIG. 1) in which the first port (P1) and the second port (P2) are communicated with each other and the third port (P3) and the fourth port (P4) are communicated with each other and a second position (the position shown in the broken lines in FIG. 1) in which the first port (P1) and the fourth port (P4) are communicated with each other and the second port (P2) and the third port (P3) are communicated with each other.

The outdoor circuit (21) is provided with four pairs of one temperature sensor (45) and one pressure sensor (46), one pair at each of one end and the other end of the compressor (30) and one end and the other end of the outdoor heat exchanger (34). Specifically, the suction pipe (41) is provided with a pair of one suction temperature sensor (45*a*) and one suction pressure sensor (46*a*). The discharge pipe (40) is provided with a pair of one discharge temperature sensor (45*b*) and one discharge pressure sensor (46*b*). Provided between the outdoor heat exchanger (34) and the four-way selector valve (33) are a pair of one outdoor gas temperature sensor (45*c*) and one outdoor gas pressure sensor (46*c*). Provided between the outdoor heat exchanger (34) and the expansion valve (36) are a pair of one outdoor liquid temperature sensor (45*d*) and one outdoor liquid pressure sensor (46*d*). Provided near the outdoor fan (12) is an outdoor air temperature sensor (18).

<<Indoor Unit>>

The indoor circuit (22) of the indoor unit (13) includes as a main component device an indoor heat exchanger (37) serving as a utilization side heat exchanger. The indoor heat exchanger (37) constitutes a circuit component part and is connected to the outdoor circuit (21) through a refrigerant pipe also constituting a circuit component part.

The indoor heat exchanger (37) is configured as a cross-fin-and-tube heat exchanger. Disposed near the indoor heat exchanger (37) is an indoor fan (14) for sending room air flowing therethrough to the indoor heat exchanger (37). Furthermore, a filter (28) is provided between the indoor fan (14) and the indoor heat exchanger (37). In the indoor heat exchanger (37), heat is exchanged between room air sent by the indoor fan (14) and refrigerant flowing through the indoor heat exchanger (37). The indoor fan (14) and the filter (28) constitute individual fluid-handling parts through which air for exchanging heat with refrigerant in the indoor heat exchanger (37) flows.

The indoor circuit (22) is provided with two pairs of one temperature sensor (45) and one pressure sensor (46), one pair at each of one end and the other end of the indoor heat exchanger (37). Specifically, a pair of one indoor liquid temperature sensor (45*e*) and one indoor liquid pressure sensor (46*e*) are provided between the liquid side end of the indoor circuit (22) and the indoor heat exchanger (37). A pair of one indoor gas temperature sensor (45*f*) and one indoor liquid pressure sensor (46*f*) are provided between the indoor heat exchanger (37) and the gas side end of the indoor circuit (22). Provided near the indoor fan (14) is a room temperature sensor (19).

<<Controller>>

The refrigeration system (10) includes a controller (50) for controlling the operating capacity of the compressor (30) and the opening of the expansion valve (36) in order to control the air conditioning capacity and for diagnosing component parts of the refrigeration system (10). The parts to be diagnosed by the controller (50) are circuit component parts including main component devices and the above-stated fluid-handling parts (12, 14, 28). The controller (50) diagnoses the conditions of the parts to be diagnosed based on thermodynamic analysis (exergy analysis) for analyzing the loss produced in each circuit component part. The controller (50) includes: a refrigerant state detection section (51) serving as a refrigerant state detection means; a loss calculation section (52) serving as a variation calculation means; a loss storage section (53) serving as a loss storage means; a diagnosing section (54) serving as a diagnosing means; and a display section (55) serving as a display.

The parts that the controller (50) can diagnose using thermodynamic analysis include circuit component parts producing variations in refrigerant energy and parts having indirect effects on energy variation of refrigerant from the outside of the refrigerant circuit (20), such as fluid-handling parts (12, 14, 28). For example, the outdoor fan (12) and the indoor fan (14) produce variations in refrigerant energy by sending air to the heat exchangers (34, 37). Furthermore, when the filter (28) is clogged, it changes the flow volume of air to be sent to the heat exchanger (34, 37) and thereby has an effect on energy variation of refrigerant.

The refrigerant state detection section (51) is configured to detect, from measured values obtained by the temperature sensors (45), the refrigerant temperatures at eight points: the entrance of the compressor (30), the exit of the compressor (30), the entrance of the outdoor heat exchanger (34), the exit of the outdoor heat exchanger (34), the entrance of the expansion valve (36), the exit of the expansion valve (36), the entrance of the indoor heat exchanger (37) and the exit of the indoor heat exchanger (37). In addition, the refrigerant state detection section (51) is configured to calculate, from measured values obtained by the pairs of one temperature sensor (45) and one pressure sensor (46), the refrigerant entropies at eight points: the entrance of the compressor (30), the exit of the compressor (30), the entrance of the outdoor heat exchanger (34), the exit of the outdoor heat exchanger (34), the entrance of the expansion valve (36), the exit of the expansion valve (36), the entrance of the indoor heat exchanger (37) and the exit of the indoor heat exchanger (37).

In Embodiment 1, during cooling operation, the refrigerant temperature and entropy at the entrance of the expansion valve (36) are detected to be equal to those at the exit of the outdoor heat exchanger (34) and the refrigerant temperature and entropy at the exit of the expansion valve (36) are detected to be equal to those at the entrance of the indoor heat exchanger (37). On the other hand, during heating operation, the refrigerant temperature and entropy at the entrance of the expansion valve (36) are detected to be equal to those at the exit of the indoor heat exchanger (37) and the refrigerant temperature and entropy at the exit of the expansion valve (36) are detected to be equal to those at the entrance of the outdoor heat exchanger (34).

The loss calculation section (52) is configured to separately calculate the value of loss produced in each of the circuit component parts (i.e., the compressor (30), the expansion valve (36), the outdoor heat exchanger (34), the indoor heat exchanger (37), the pipe between the indoor heat exchanger (37) and the compressor (30) and the pipe between the outdoor heat exchanger (34) and the compressor (30)). The value of loss is calculated using the refrigerant temperatures and entropies detected by the refrigerant state detection section (51).

The loss storage section (53) stores the value of loss produced in each of the circuit component parts (parts whose losses are to be calculated) in a normal operating condition as a reference value of loss for the loss produced in each of the circuit components. Stored as the reference value of loss for the loss in each of the circuit component parts is a value calculated by simulation calculation. Furthermore, the loss storage section (53) stores the reference values of losses under a plurality of different operating situations having different combinations of room and outdoor temperatures. The volume of refrigerant circulating through the refrigerant circuit may be applied as a matter of such a combination for an operating situation.

The diagnosing section (54) treats the circuit component parts, the outdoor fan (12) and the indoor fan (14) as the parts to be diagnosed and diagnoses the conditions of these parts to be diagnosed. The diagnosis of the conditions of the parts to be diagnosed is made by comparing, for the loss produced in each of the circuit component parts, the value of loss calculated by the loss calculation section (52) with the reference value of loss stored in the loss storage section (53). The display section (55) is configured to be able to display a diagnosis result of the diagnosing section (54).

-Operational Behavior of Refrigeration System-

Next, a description is given of the operational behavior of the refrigeration system (10). The refrigeration system (10) is configured to be capable of performing a cooling operation and a heating operation. The switching between the cooling and heating operations is made by the four-way selector valve (33).

<Cooling Operation>

In the cooling operation, the four-way selector valve (33) is selected to the second position. When in this position the compressor (30) is operated, the refrigerant circuit (20) operates in a vapor compression refrigeration cycle in which the outdoor heat exchanger (34) serves as a condenser (gas cooler) and the indoor heat exchanger (37) serves as an evaporator. In the cooling operation, the opening of the expansion valve (36) is appropriately adjusted.

Specifically, the refrigerant discharged from the compressor (30) exchanges heat with outdoor air in the outdoor heat exchanger (34) to condense. The refrigerant having condensed in the outdoor heat exchanger (34) is reduced in pressure during passage through the expansion valve (36) and then exchanges heat with room air in the indoor heat exchanger (37) to evaporate. The refrigerant having evaporated in the indoor heat exchanger (37) is sucked into the compressor (30) and compressed therein.

<Heating Operation>

In the heating operation, the four-way selector valve (33) is selected to the first position. When in this position the compressor (30) is operated, the refrigerant circuit (20) operates in a vapor compression refrigeration cycle in which the outdoor heat exchanger (34) serves as an evaporator and the indoor heat exchanger (37) serves as a condenser (gas cooler). Also in the heating operation, the opening of the expansion valve (36) is appropriately adjusted.

Specifically, the refrigerant discharged from the compressor (30) exchanges heat with room air in the indoor heat exchanger (37) to condense. The refrigerant having condensed in the indoor heat exchanger (37) is reduced in pressure during passage through the expansion valve (36) and then exchanges heat with outdoor air in the outdoor heat exchanger (34) to evaporate. The refrigerant having evaporated in the outdoor heat exchanger (34) is sucked into the compressor (30) and compressed therein.

-Operation of Controller-

A description is given of the operation of the controller (50) upon diagnosis of the conditions of the parts to be diagnosed. The diagnosis of the conditions of the parts to be diagnosed is carried out during the cooling operation and heating operation. The following description is made with reference to the diagnosis during the cooling operation.

In diagnosing the conditions of the parts to be diagnosed, the refrigerant state detection section (51) first detects, from measured values obtained by the pairs of one temperature sensor (45) and one pressure sensor (46), the refrigerant temperatures and entropies at the eight points: the entrance of the compressor (30), the exit of the compressor (30), the entrance of the outdoor heat exchanger (34), the exit of the outdoor heat exchanger (34), the entrance of the expansion valve (36), the exit of the expansion valve (36), the entrance of the indoor heat exchanger (37) and the exit of the indoor heat exchanger (37).

Specifically, the refrigerant temperature and, entropy at the entrance of the compressor (30) are detected from the measured values obtained by the suction temperature sensor (45*a*) and the suction pressure sensor (46*a*). The refrigerant temperature and entropy at the exit of the compressor (30) are detected from the measured values obtained by the discharge temperature sensor (45*b*) and the discharge pressure sensor (46*b*). The refrigerant temperature and entropy at the entrance of the outdoor heat exchanger (34) are detected from the measured values obtained by the outdoor gas temperature sensor (45*c*) and the outdoor gas pressure sensor (46*c*). The refrigerant temperature and entropy at the exit of the outdoor heat exchanger (34) and the refrigerant temperature and entropy at the entrance of the expansion valve (36) are detected from the measured values obtained by the outdoor liquid temperature sensor (45*d*) and the outdoor liquid pressure sensor (46*d*). The refrigerant temperature and entropy at the exit of the indoor heat exchanger (37) are detected from the measured values obtained by the indoor gas temperature sensor (45*f*) and the indoor liquid pressure sensor (46*f*).

The refrigerant at the exit of the expansion valve (36) and at the entrance of the indoor heat exchanger (37) is in a gas-liquid two-phase state. Thus, its refrigerant temperature is detected from the measured value of the indoor liquid temperature sensor (45*e*) but its refrigerant entropy cannot be detected only from the measured values of the indoor liquid temperature sensor (45*e*) and the indoor liquid pressure sensor (46*e*). Therefore, the refrigerant entropies at the exit of the expansion valve (36) and the entrance of the indoor heat exchanger (37) are detected as the same value as that at the exit of the outdoor heat exchanger (34).

Next, the loss calculation section (52) uses the refrigerant temperatures and entropies detected by the refrigerant state detection section (51) to separately calculate the values of losses produced in the circuit component parts, such as the compressor (30), the expansion valve (36), the outdoor heat exchanger (34) and the indoor heat exchanger (37).

Now shown in FIG. 2 is a T-s diagram plotted using the refrigerant temperatures and entropies at the exits and entrances of the main component devices. These values of losses produced in the circuit component parts are known to correspond to the respective areas of regions (c, d, e, f, g1, g2, h1, h2, i, j, k) segmentized based on the T-s diagram.

Point A(1) shown in FIG. 2 is a point determined from the refrigerant temperature and entropy at the entrance of the compressor (30). Point B(1) is a point determined from the refrigerant temperature and entropy at the exit of the compressor (30). Point C(1) is a point determined from the refrigerant temperature and entropy at the entrance of the outdoor heat exchanger (34). Point D(1) is a point determined from the refrigerant temperature and entropy at the exit of the outdoor heat exchanger (34) (or the entrance of the expansion valve (36)). Point E(1) is a point determined from the refrigerant temperature and entropy at the entrance of the indoor heat exchanger (37) (or the exit of the expansion valve (36)). Point F(1) is a point determined from the refrigerant temperature and entropy at the exit of the indoor heat exchanger (37).

Point C(2) is a point that is equal in entropy to Point C(1) and located on a constant pressure line passing through Point D(1). Point D(2) is an intersecting point of an constant enthalpy line passing through Point D(1) and a constant pressure line passing through Point C(1). Point D(3) is an intersecting point of the constant enthalpy line passing through Point D(1) and a constant pressure line passing through Point B(1). Point E(2) is an intersecting point of a constant enthalpy line passing through Point E(1) and a constant pressure line passing through Point F(1). Point F(2) is a point that is equal in entropy to Point F(1) and located on a constant pressure line passing through Point E(1).

Point G(1) is an intersecting point of the constant pressure line passing through Point C(1) and a saturated vapor line. Point G(2) is an intersecting point of a constant pressure line passing through Point C(2) and the saturated vapor line. Point G(3) is an intersecting point of the constant pressure line passing through Point B(1) and the saturated vapor line. Point H(1) is an intersecting point of the constant pressure line passing through Point D(1) and a saturated liquid line. Point H(2) is an intersecting point of a constant pressure line passing through Point D(2) and the saturated liquid line. Point H(3) is an intersecting point of a constant pressure line passing through Point D(3) and the saturated liquid line. Point I(1) is an intersecting point of the constant enthalpy line passing through Point D(1) and the saturated liquid line. Point J(1) is an intersecting point of the constant pressure line passing through Point F(1) and the saturated vapor line. Point J(2) is an intersecting point of a constant pressure line passing through Point F(2) and the saturated vapor line.

Th denotes the temperature of air sent to the outdoor heat exchanger (34) (or the measured value of the outdoor air temperature sensor (18)) and Tc denotes the temperature of air sent to the indoor heat exchanger (37) (or the measured value of the room temperature sensor (19)).

Furthermore, Region (a) shown in FIG. 2 indicates the workload of the reverse Carnot cycle. Region (b) indicates the quantity of heat taken in the indoor heat exchanger (37). Region (c) indicates the loss involved in heat exchange of the indoor heat exchanger (37). Region (d) indicates the loss involved in heat exchange of the outdoor heat exchanger (34). Region (e) indicates the friction loss during passage of refrigerant through the expansion valve (36). Region (f) indicates the loss due to mechanical friction in the compressor (30). Region (g1) indicates the loss due to production of frictional heat in the indoor heat exchanger (37). Region (g2) indicates the pressure loss in the indoor heat exchanger (37). Region (h1) indicates the loss due to production of frictional heat in the outdoor heat exchanger (34). Region (h2) indicates the pressure loss in the outdoor heat exchanger (34). Region (i) indicates the loss due to heat penetration or the pressure loss between the indoor heat exchanger (37) and the compressor (30). Region (j) indicates the loss due to heat release between the compressor (30) and the outdoor heat exchanger (34). Region (k) indicates the pressure loss between the compressor (30) and the outdoor heat exchanger (34).

For the losses produced in each of the outdoor heat exchanger (34) and the indoor heat exchanger (37), the values of three types of losses: the loss involved in heat exchange, the loss due to production of frictional heat and the pressure loss, are calculated. The inventor has found that, with the use of the refrigerant temperatures and entropies at the exits and entrances of the main component devices, the values of plural types of losses in each of the heat exchanger (34, 37) serving as an evaporator and the heat exchanger (34, 37) serving as a condenser can be calculated. The details are described below. The following description is made with reference to the heat exchanger serving as an evaporator.

Figure 3:
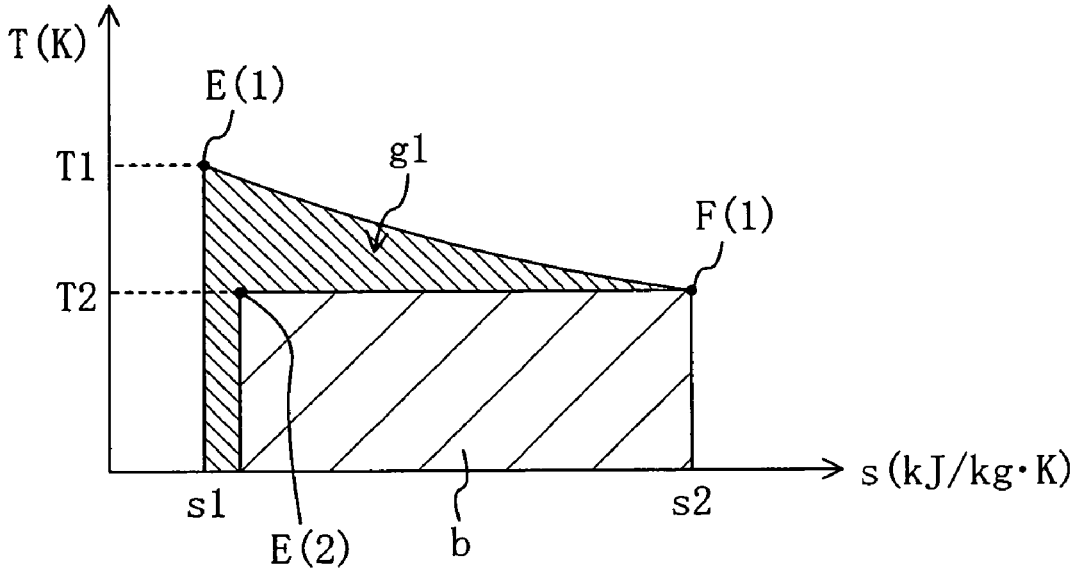
FIG. 3 is a graph showing variations in the state of refrigerant from entrance to exit of an evaporator.

The T-s diagram showing the states of refrigerant from the entrance to the exit of the evaporator is as shown in FIG. 3. In FIG. 3, Point E(1) is a point determined from the refrigerant temperature (T1) and entropy (s1) at the entrance of the evaporator, Point F(1) is a point determined from the refrigerant temperature (T2) and entropy (s2) at the exit of the evaporator and Point E(2) is an intersecting point of a constant enthalpy line passing through Point E(1) and a constant pressure line passing through Point F(1).

Under an ideal condition in which no loss occurs in a refrigeration cycle, refrigerant does not change its pressure when it takes heat from something else. Therefore, the line connecting Points E(2) and F(1) both located on a constant pressure line shows the variation in the state of refrigerant from the entrance to the exit of the evaporator under the ideal condition, i.e., the variation in the state of refrigerant only due to heat taken in the evaporator. Hence, the quantity of heat taken in the evaporator is expressed by Region (b) under the line connecting Points E(2) and F(1).

Furthermore, the mathematical expression showing the variation in the state of refrigerant from the entrance to the exit of the evaporator is as shown in the following Equation 1.

$$ds=(dq+dq(fr))/T \qquad \text{Equation 1}$$

In Equation 1, ds denotes the increasing amount of specific entropy, dq denotes the quantity of heat taken by refrigerant from something else, dq(fr) denotes the quantity of frictional heat produced owing to pressure loss and T demotes the evaporation temperature. Furthermore, the integral of Equation 1 over an interval [s1, s2] gives the following Equation 2.

$$\int Tds=\int dq+\int dq(fr)=Q+Q(fr) \qquad \text{Equation 2}$$

In Equation 2, Q denotes the quantity of heat taken by refrigerant in the evaporator and Q(fr) denotes the quantity of frictional heat produced in the evaporator owing to pressure loss.

The value ∫Tds in Equation 2 corresponds to the area of the region under the curve connecting Points E(1) and F(1) in FIG. 3. Therefore, Region (g1) obtained by subtracting from the above Region (b) corresponding to the quantity of heat Q taken by refrigerant in the evaporator is the region corresponding to the quantity of frictional heat Q(fr) produced in the evaporator. Then, the calculation of the area of Region (g1) gives the value of loss due to frictional heat produced in the evaporator as a value of one of losses in the evaporator. The quantity of frictional heat Q(fr) released from the evaporator corresponds to a decrease of quantity of heat taken in the evaporator due to production of frictional heat caused by pressure loss.

It can be derived in the same manner that Region (g2) in FIG. 2 corresponds to the pressure loss in the evaporator. Then, the calculation of the area of Region (g2) gives the value of pressure loss in the evaporator as a value of one of losses in the evaporator.

The loss calculation section (52) determines the values of losses corresponding to Regions (c) to (k) by calculating the areas of Regions (c, d, e, f, g1, g2, h1, h2, i, j, k). The values of losses may be calculated as enthalpies shown by the areas of Regions (c, d, e, f, g1, g2, h1, h2, i, j, k) or may be calculated as energies (workloads) obtained by multiplying the respective enthalpies by the circulating volume of refrigerant. Since all of the circuit component parts have the same refrigerant flow volume, the magnitudes of losses produced in the circuit component parts can be relatively expressed even if the values of losses are expressed in enthalpy.

The diagnosing section (54) selects, from among reference values of losses under a plurality of operating situations stored in the loss storage section (53), a reference value of loss under an operating situation corresponding to an operating situation at diagnosis. Selected as the corresponding operating situation is an operating situation having the same room and outdoor temperatures as those at diagnosis or, if not the same room or outdoor temperature, an operating situation having the nearest room and outdoor temperatures to those at diagnosis. Furthermore, the diagnosing section (54) diagnoses the conditions of the parts to be diagnosed by comparing, for the loss produced in each circuit component part, the value of loss calculated by the loss calculation section (52) with the reference value of loss under the selected operating situation stored in the loss storage section (53).

For example, when the value of loss due to mechanical friction in the compressor (30) at diagnosis (the value corresponding to Region (f)) is larger than that in the normal condition (i.e., when the compressor (30) is in a state as shown in FIG. 4), this means that the mechanical loss (production of frictional heat) in the compressor (30) or production of Joule heat in the motor increases. Therefore, the diagnosing section (54) diagnoses the above state as a state in which the deterioration of refrigerating machine oil in the compressor (30) or the deterioration of a sliding member, such as a bearing, in the compressor (30) progresses or as a state in which the circuit resistance of an electrical component in the compressor (30) increases. Furthermore, when the value of loss at the diagnosis is larger than that in the normal operating condition, for example, by 10% or more, the diagnosing section (54) determines that the compressor (30) is at fault.

Figure 5:
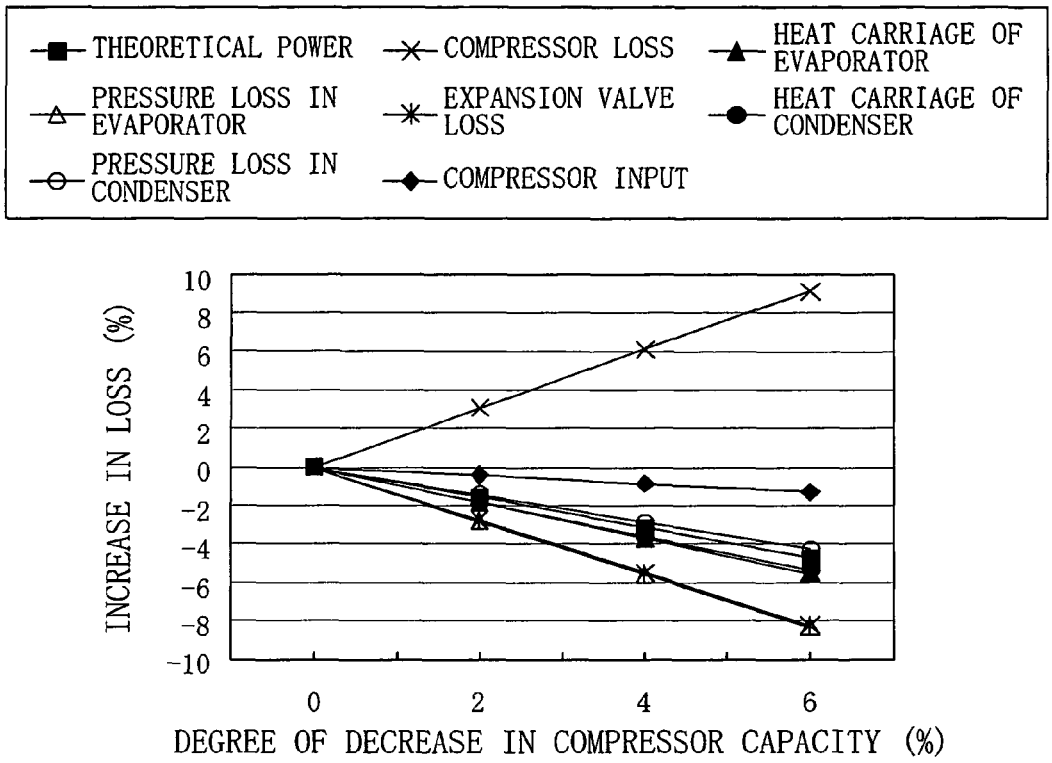
FIG. 5 is a graph showing the relation between the loss produced in a compressor and the degree of deterioration in the capacity of the compressor.

The Inventor has already made sure by simulation calculation that the magnitude of value of loss produced in the compressor (30) reflects the condition of the compressor (30). The results of the above simulation calculation are shown in FIG. 5. Specifically, FIG. 5 shows the results of simulation calculation about three cases where the degree of decrease in the capacity of the compressor (30) changes with respect to a predetermined value (i.e., the cases where the capacity of the compressor (30) decreases by 2%, 4% and 6%). Reference to FIG. 5 shows that as the degree of decrease in the capacity of the compressor (30) increases, the value of loss produced in the compressor (30) increases. Furthermore, it can be seen from FIG. 5 that since the degree of decrease in the capacity of the compressor (30) increases with progressing damage and malfunction of the compressor (30), the damage and malfunction of the compressor (30) progresses as the value of loss produced in the compressor (30) increases.

When the value of loss due to heat exchange in the indoor heat exchanger (37) at diagnosis (the value corresponding to Region (c)) is larger than that in the normal condition (i.e., when the indoor heat exchanger (37) is in a state as shown in FIG. 6), this means that the evaporation temperature of refrigerant in the indoor heat exchanger (37) decreases as compared to the normal operating condition. Therefore, the diagnosing section (54) diagnoses that the flow volume of air passing through the indoor heat exchanger (37) decreases. Furthermore, the diagnosing section (54) diagnoses that the reason for the decrease in the flow volume of air passing through the indoor heat exchanger (37) is that the indoor fan (14) is aging, the filter (28) for the indoor fan (14) is clogged, the fins of the indoor heat exchanger (37) are grimy or the fins are broken down.

Figure 7:
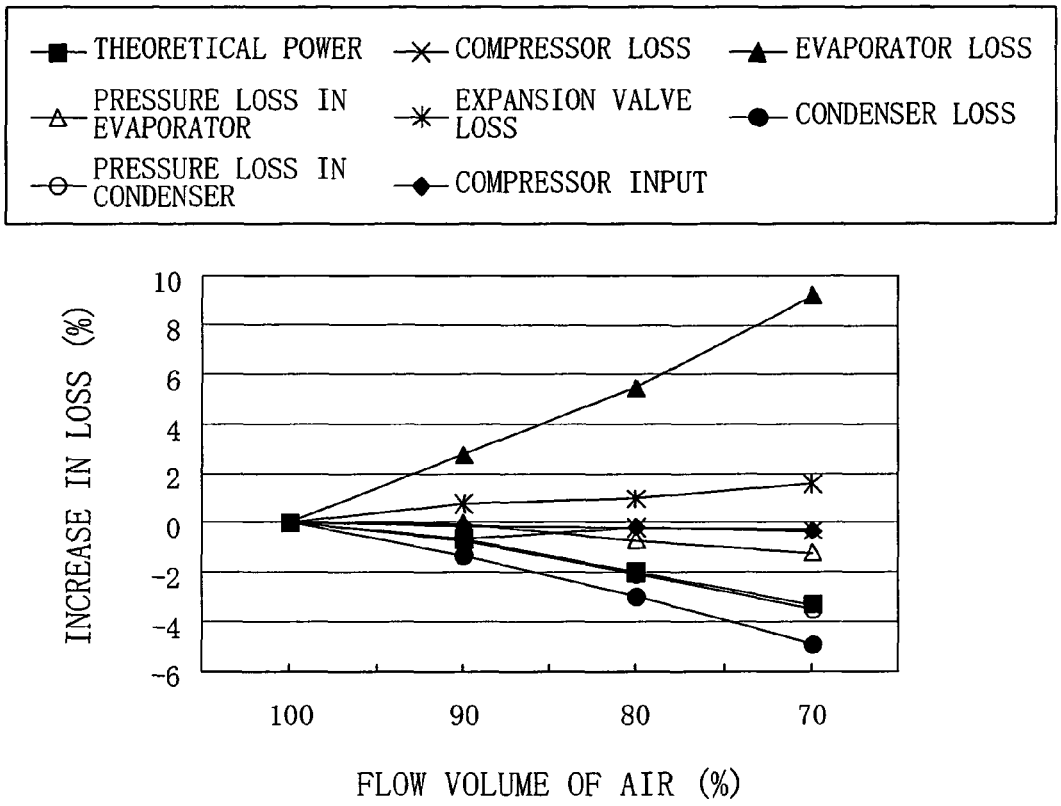
FIG. 7 is a graph showing the relation between the loss produced in an evaporator and the degree of drop in the air flow volume of a fan.

The Inventor has already made sure by simulation calculation that the magnitude of value of loss in the evaporator reflects the condition of the fan for sending air to the evaporator. The results of the above simulation calculation are shown in FIG. 7. Specifically, FIG. 7 shows the results of simulation calculation about three cases where the degree of decrease in the flow volume of air of the fan changes with respect to a predetermined value (i.e., the cases where the flow volume of air of the fan decreases by 10%, 20% and 30%). Reference to FIG. 7 shows that as the degree of decrease in the flow volume of air of the fan increases, the value of loss in the evaporator increases. Furthermore, it can be seen from FIG. 7 that since the flow volume of air of the fan decreases with progressing damage and malfunction of the fan, the damage and malfunction of the fan progresses as the value of loss produced in the evaporator increases.

When the value of pressure loss in the indoor heat exchanger (37) at diagnosis (the value corresponding to Region (g2)) is larger than that in the normal condition (i.e., when the indoor heat exchanger (37) is in a state as shown in FIG. 8), this means that the pressure drop in the indoor heat exchanger (37) increases and the loss due to production of frictional heat increases. Therefore, the diagnosing section (54) diagnoses that the inside of the indoor heat exchanger (37) is grimy, the pipe of the indoor heat exchanger (37) has a dent or much foreign substances exist inside the indoor heat exchanger (37). The diagnosing section (54) makes the same diagnosis also when the quantity of frictional heat produced in the indoor heat exchanger (37) (the value corresponding to Region (g1)) is larger than that in the normal operating condition.

Figure 9:
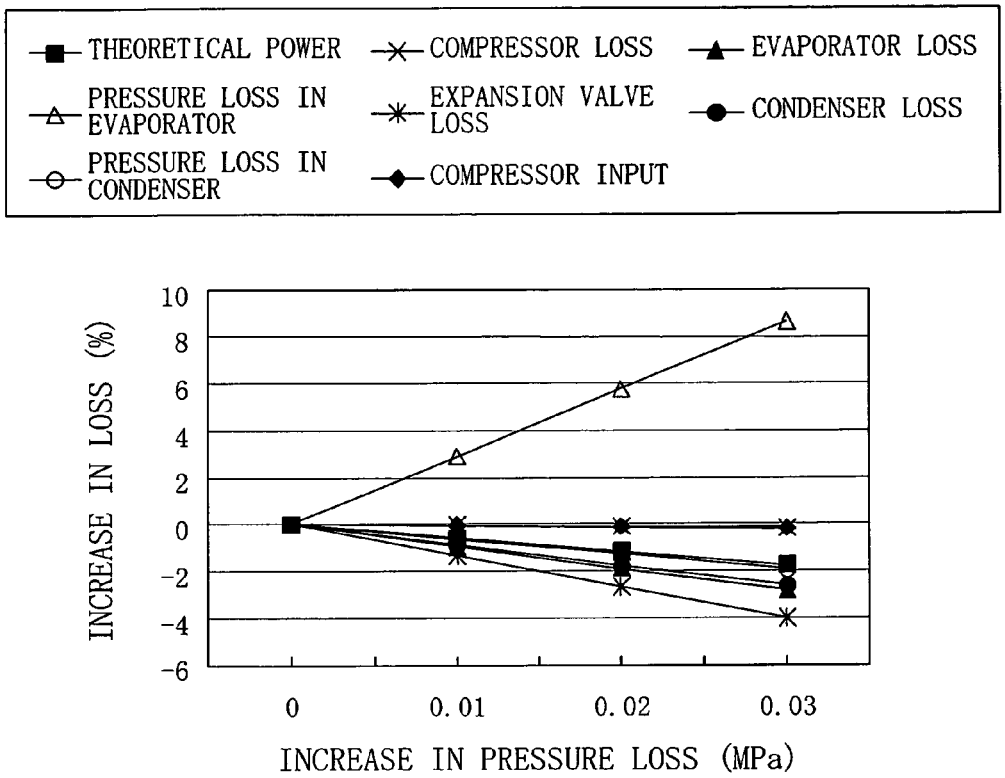
FIG. 9 is a graph showing the relation between the loss produced in the evaporator and the degree of increase in pressure loss of refrigerant in the evaporator.

The Inventor has already made sure by simulation calculation that the magnitude of loss in the evaporator reflects the degree of pressure loss of refrigerant in the evaporator. The results of the above simulation calculation are shown in FIG. 9. Specifically, FIG. 9 shows the results of simulation calculation about three cases where the degree of decrease in the refrigerant pressure in the evaporator changes with respect to a predetermined value (i.e., the cases where the refrigerant pressure in the evaporator decreases by 0.01 MPa, 0.02 MPa and 0.03 MPa). Reference to FIG. 9 shows that as the degree of decrease in the refrigerant pressure in the evaporator increases, the loss in the evaporator increases. Furthermore, it can be seen from FIG. 9 that since a decrease of refrigerant pressure in the evaporator means an increase in pressure loss of refrigerant in the evaporator, the pressure loss of refrigerant in the evaporator increases as the loss in the evaporator increases.

When the value of loss due to heat exchange in the outdoor heat exchanger (34) at diagnosis (the value corresponding to Region (d)) is larger than that in the normal condition, this means that the condensation temperature of refrigerant in the outdoor heat exchanger (34) increases as compared to the normal operating condition. Therefore, the diagnosing section (54) diagnoses that the flow volume of air passing through the outdoor heat exchanger (34) decreases. Furthermore, the diagnosing section (54) diagnoses that the reason for the decrease in the flow volume of air passing through the outdoor heat exchanger (34) is that the outdoor fan (12) is aging, the fins of the outdoor heat exchanger (34) are grimy or the fins are clogged with rusts or the like.

Figure 10:
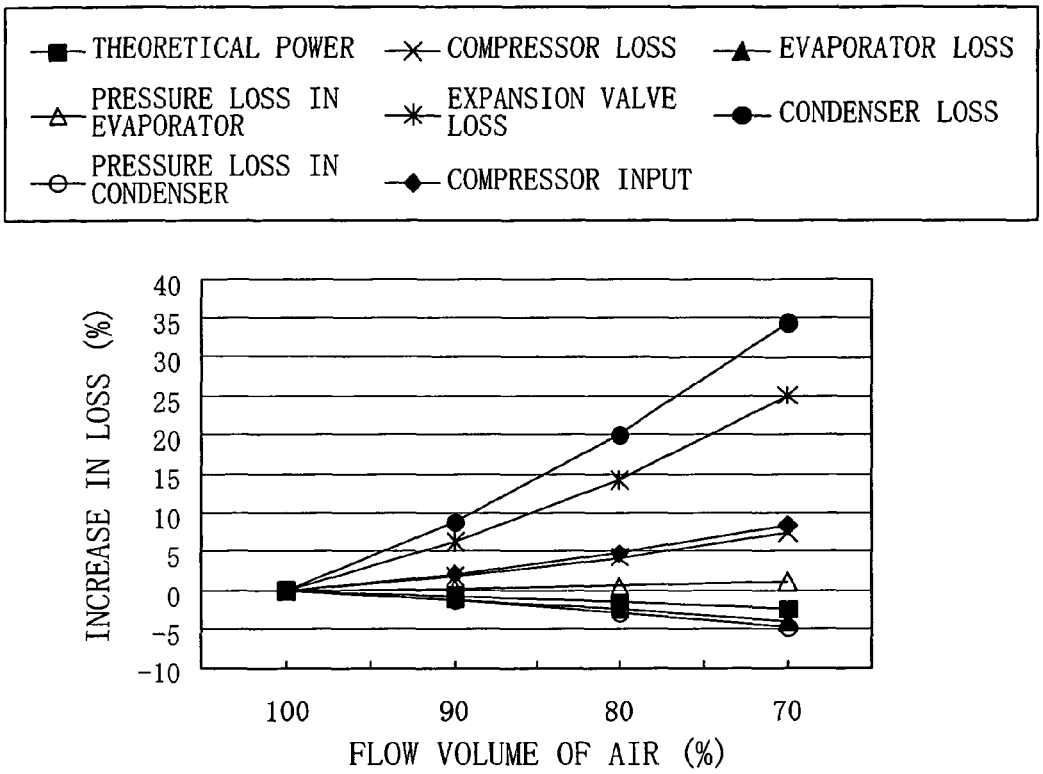
FIG. 10 is a graph showing the relation between the loss produced in a condenser and the degree of drop in the air flow volume of a fan.

The Inventor has already made sure by simulation calculation that the magnitude of value of loss in the condenser reflects the condition of the fan for sending air to the condenser. The results of the above simulation calculation are shown in FIG. 10. Specifically, FIG. 10 shows the results of simulation calculation about three cases where the degree of decrease in the flow volume of air of the fan changes with respect to a predetermined value (i.e., the cases where the flow volume of air of the fan decreases by 10%, 20% and 30%). Reference to FIG. 10 shows that as the degree of decrease in the flow volume of air of the fan increases, the value of loss in the condenser increases. Furthermore, it can be seen from FIG. 10 that since the flow volume of air of the fan decreases with progressing damage and malfunction of the fan, the damage and malfunction of the fan progresses as the value of loss produced in the condenser increases.

When the value of loss from the indoor heat exchanger (37) to the compressor (30) at diagnosis (the value corresponding to Region (i)) is larger than that in the normal condition, this means that the quantity of heat transferred to the pipe between the indoor heat exchanger (37) and the compressor (30) increases or the pressure loss of refrigerant in the pipe increases. Therefore, the diagnosing section (54) diagnoses that the heat insulating material of the pipe is deteriorated, dew condenses on the pipe, the pipe has a dent or much foreign substances stick to the inside of the pipe.

When the value of loss due to heat release from the compressor (30) to the outdoor heat exchanger (34) at diagnosis (the value corresponding to Region (j)) is larger than that in the normal condition, this means that the quantity of heat released from the pipe between the compressor (30) and the outdoor heat exchanger (34) increases. Therefore, the diagnosing section (54) diagnoses that the heat insulating material of the pipe is deteriorated.

When the value of pressure loss from the compressor (30) to the outdoor heat exchanger (34) at diagnosis (the value corresponding to Region (k)) is larger than that in the normal condition, this means that the pressure loss of refrigerant in the pipe between the compressor (30) and the outdoor heat exchanger (34) increases. Therefore, the diagnosing section (54) diagnoses that the pipe has a dent or much foreign substances stick to the inside of the pipe.

The diagnosis results stated so far are only some of results as which the diagnosing section (54) can diagnose.

Figure 11:
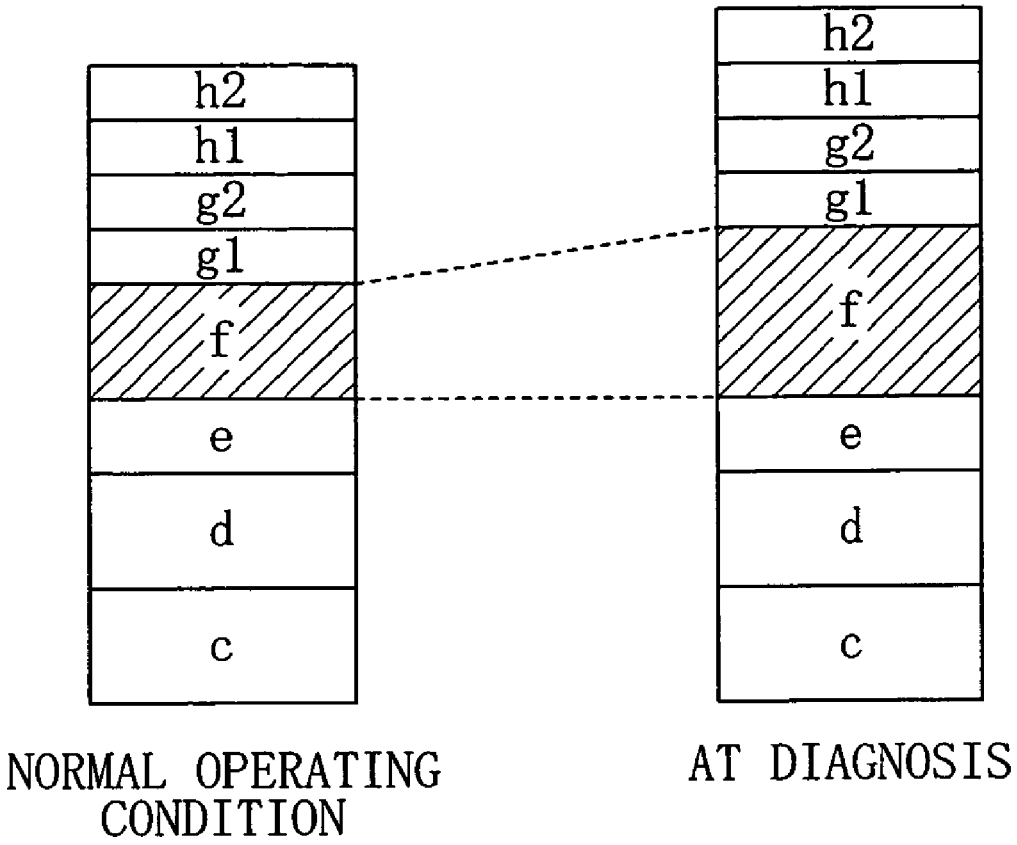
FIG. 11 is diagrams showing distributions of losses produced in the circuit component parts.

The display section (55) displays the conditions of the parts to be diagnosed by the diagnosing section (54). The display section (55) may display also the values of losses produced in the circuit component parts. For example, as shown in FIG. 11, the display section (55) can display the distributions of losses produced in the circuit component parts. Thus, the user can infer the condition of each of the circuit component parts, which enables early finding of deterioration and aged deterioration of parts.

Figure 12A:
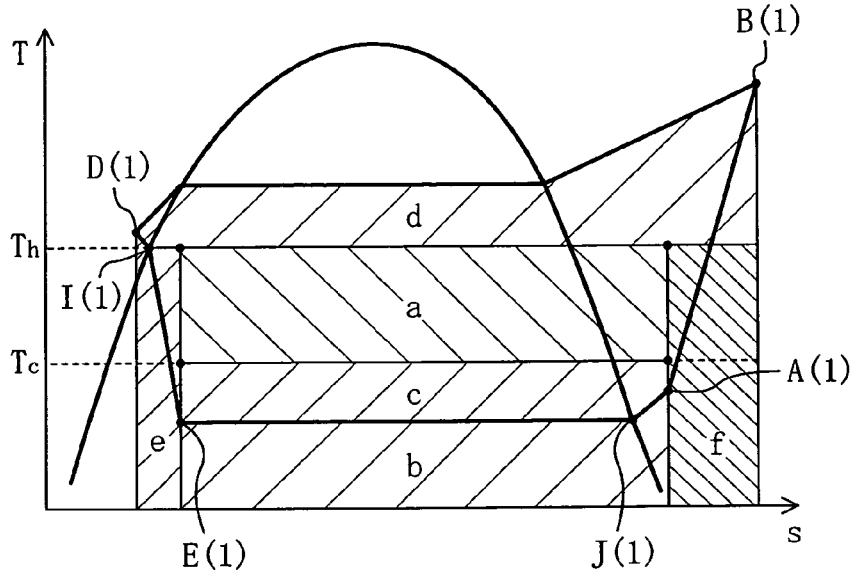
FIG. 12 is graphs showing examples of segmentized regions of a T-s diagram.

Note that the segmentized regions of the T-s diagram of FIG. 2 are illustrative only. For example, the T-s diagram may be segmentized into regions as shown in FIG. 12A. Region (a) in FIG. 12A indicates the workload of the reverse Carnot cycle. Region (b) indicates the quantity of heat taken in the indoor heat exchanger (37). Region (c) indicates the loss produced in the indoor heat exchanger (37). Region (d) indicates the loss produced in the outdoor heat exchanger (34). Region (e) indicates the friction loss during passage of refrigerant through the expansion valve (36). Region (f) indicates the loss due to mechanical friction in the compressor (30). In this case, since the T-s diagram is made from the refrigerant temperatures and entropies at four points, there is not need for the outdoor gas temperature sensor (45*c*), the outdoor gas pressure sensor (46*c*), the indoor gas temperature sensor (45*f*) and the indoor liquid pressure sensor (46*f*).

Figure 12B:
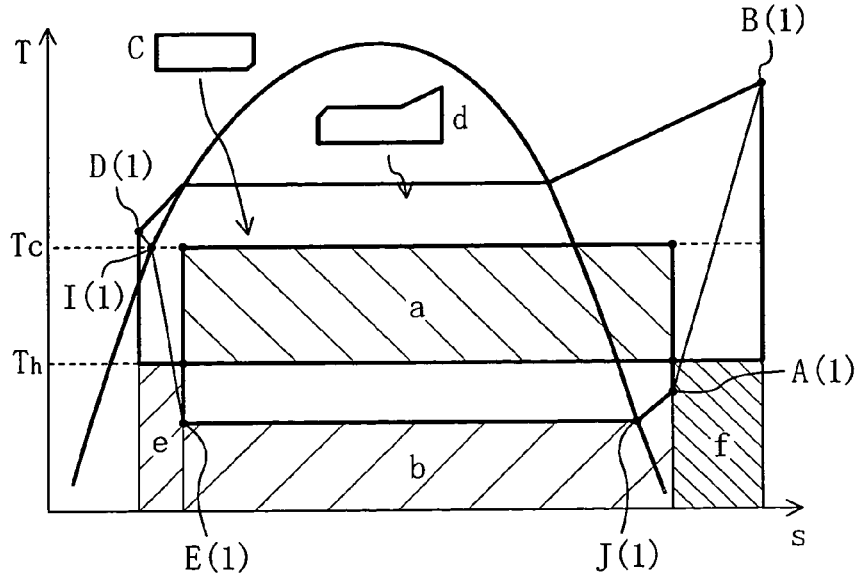

When during the cooling operation the temperature (Tc) of air sent to the indoor heat exchanger (37) is higher than the temperature (Th) of air sent to the outdoor heat exchanger (34), the T-s diagram is as shown in FIG. 12B. In this case, the workload of the reverse Carnot cycle shown by Region (a) is negative and Regions (c) and (d) are overlapped with each other. The loss calculation section (52) calculates the value of loss produced in the indoor heat exchanger (37) from the area of Region (c) and calculates the value of loss produced in the outdoor heat exchanger (34) from the area of Region (d). Also when during the heating operation the room temperature (Tc) is lower than the outdoor temperature (Th), the workload of the reverse Carnot cycle is set as a negative value and the values of losses produced in the outdoor heat exchanger (34) and the indoor heat exchanger (37) are calculated.

Effects of Embodiment 1

In Embodiment 1, the magnitude of energy variation of refrigerant produced in each circuit component part is separately calculated using that fact that the respective magnitudes of variations in refrigerant energy produced in the circuit component parts are shown in a T-s diagrams plotted using the refrigerant temperatures and entropies at the exits and entrances of the main component devices. The magnitude of energy variation of refrigerant produced in each circuit component part represents, for example, the magnitude of loss produced in the circuit component part and depends on the condition of the circuit component part. Therefore, according to Embodiment 1, the conditions of the circuit component parts can be separately analyzed.

Furthermore, in Embodiment 1, the condition of each circuit component part or the associated fluid-handling part (12, 14, 28) is separately diagnosed using the magnitude of energy variation of refrigerant produced in the circuit component part and depending on the condition of the circuit component part or the associated fluid-handling part (12, 14, 28). In addition, since the diagnosis is made not using the physical values of different units but using those of the same unit, each of the conditions of the circuit component parts and the fluid-handling parts (12, 14, 28) can be quantitatively comprehended. Therefore, the conditions of the circuit component parts and the fluid-handling parts (12, 14, 28) can be diagnosed with precision.

In Embodiment 1, when the values of losses of the circuit component parts corresponding to all of the regions shown in a T-s diagram are displayed, all of the variations of losses produced in a refrigeration cycle and classified in types can be comprehended. Therefore, a careful loss analysis can be provided. This more certainly ensures the performance of the refrigeration system (10), which is advantageous in offering the refrigeration system (10) as an energy service company (ESCO) business. Furthermore, such a careful loss analysis makes it easy to detect an abnormality in the refrigeration system (10), which improves the maintenance service of the refrigeration system (10).

Furthermore, in Embodiment 1, the condition of each part to be diagnosed is diagnosed with reference to the value of loss in the normal operating condition. Therefore, the condition of the part to be diagnosed at diagnosis can be understood as a difference from that in the normal operating condition, which provides precise diagnosis of the condition of the part to be diagnosed.

Furthermore, in Embodiment 1, by comparing, for the loss produced in each of the circuit component parts, the value of loss calculated by the loss calculation section (52) with the reference value of loss stored in the loss storage section (53), the difference between the conditions of the part to be diagnosed in the normal operating condition and at diagnosis is clearly comprehended for the loss produced in each of the circuit component parts. In addition, since the comparison is made for the loss produced in each circuit component part, this gives a clear comprehension of the difference between the conditions of the part to be diagnosed in the normal operating condition and at diagnosis even if the produced loss is small as the whole of the refrigeration system (10). Therefore, the condition of the part to be diagnosed can be diagnosed with higher precision.

In Embodiment 1, for the losses produced in each of the outdoor heat exchanger (34) and the indoor heat exchanger (37), the diagnosing means (54) uses the value of each of plural types of subdivided losses to diagnose the conditions the outdoor heat exchanger (34), the indoor heat exchanger (37), the fans (12, 14) serving as fluid-handling parts and the filter (28) serving as a fluid-handling part. Therefore, the conditions of the outdoor heat exchanger (34), the indoor heat exchanger (37), the fans (12, 14) and the filter (28) can be comprehended in further detail, which provides more precise diagnosis of the conditions of these component parts.

Furthermore, in Embodiment 1, the diagnosis of the condition of each part to be diagnosed is made with the use of the reference value of loss under the same operating situation as the operating condition at diagnosis at which the loss calculation section (52) calculates the value of loss or, if not the same operating situation, the reference value of loss under the nearest operating situation to the operating condition at the diagnosis. Therefore, out of the difference value between the value of loss in the normal operating condition and the value of loss at diagnosis, a partial difference value derived from the difference between the operating situation for the reference value of loss and the operating situation at the diagnosis is reduced. In addition, the difference value between the values of losses in the normal operating condition and at diagnosis can express the difference between the conditions of the part to be diagnosed in the normal operating condition and at the diagnosis with higher precision, which provides more precise diagnosis of the condition of the part to be diagnosed.

Modification of Embodiment 1

A description is given of a modification of Embodiment 1. In the refrigeration system (10) of this modification, the refrigerant circuit (20) operates in a so-called supercritical cycle. The supercritical cycle is a refrigeration cycle in which the high-side pressure of refrigerant is set at a higher value than the critical pressure of the refrigerant. The refrigerant circuit (20) is filled with, for example, carbon dioxide as refrigerant. In this refrigeration system (10), the compressor (30) compresses carbon dioxide to a higher pressure than its critical pressure.

Figure 13:
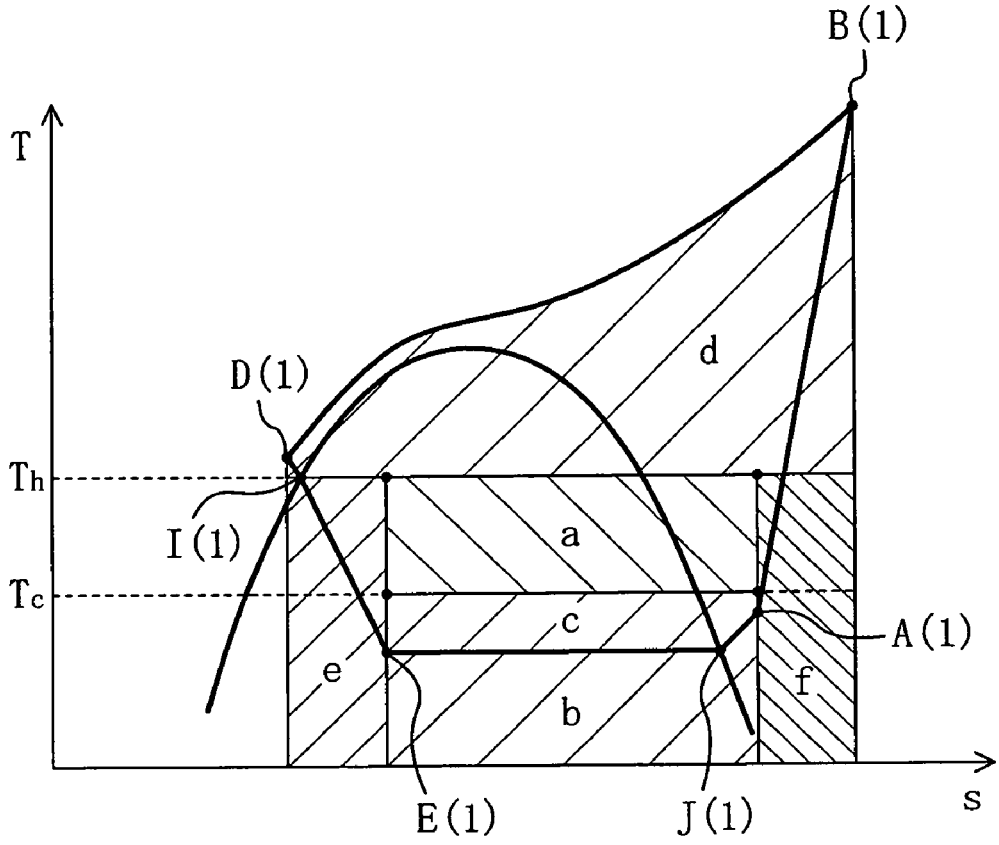
FIG. 13 is a T-s diagram segmentized into respective regions associated with circuit component parts whose values of losses are to be calculated in a modification of Embodiment 1 of the present invention.

In the T-s diagram of the refrigeration cycle in the refrigerant circuit (20) of this modification, the relation between refrigerant temperature and refrigerant entropy from the entrance to the exit of the condenser varies along a curve as shown in FIG. 13. Region (a) in FIG. 13 indicates the workload of the reverse Carnot cycle. Region (b) indicates the quantity of heat taken in the indoor heat exchanger (37). Region (c) indicates the loss produced in the indoor heat exchanger (37). Region (d) indicates the loss produced in the outdoor heat exchanger (34). Region (e) indicates the friction loss during passage of refrigerant through the expansion valve (36). Region (f) indicates the loss due to mechanical friction in the compressor (30).

The operation of the controller (50) in this modification upon diagnosis of the conditions of the parts to be diagnosed is the same as in Embodiment 1.

Embodiment 2 of the Invention

A description is given of Embodiment 2 of the present invention. Embodiment 2 is directed to a refrigeration system (10) according to the present invention.

-Configuration of Refrigeration System-

Figure 14:
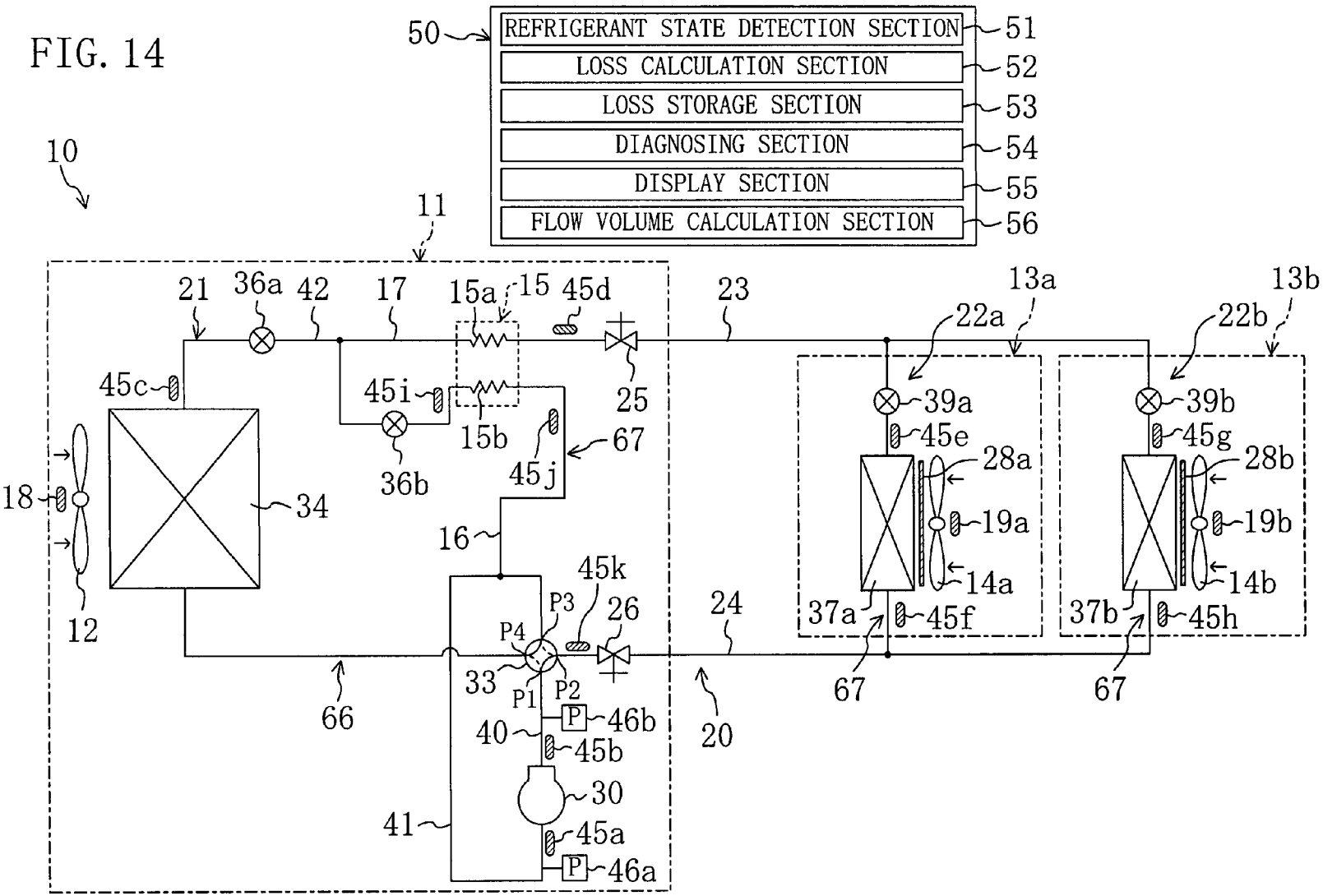
FIG. 14 is a schematic diagram of a refrigeration system according to Embodiment 2 of the present invention.

As shown in FIG. 14, the refrigeration system (10) of Embodiment 2 is an air conditioner including two indoor units: a first indoor unit (13*a*) and a second indoor unit (13*b*). The number of indoor units (13) is illustrative only. A description is given below of different points from Embodiment 1.

<<Outdoor Unit>>

The outdoor circuit (21) of the outdoor unit (11) includes as main component devices a compressor (30), an outdoor heat exchanger (34) serving as a heat-source side heat exchanger, and first and second expansion valves (36*a*, 36*b*) serving as pressure reduction devices and further includes a four-way selector valve (33) and an internal heat exchanger (15). These main component devices, the four-way selector valve (33) and the internal heat exchanger (15) constitute individual circuit component parts and are connected to each other through refrigerant pipes also constituting individual circuit component parts.

In the outdoor circuit (21), the liquid pipe (42) extending from the outdoor heat exchanger (34) branches into two pipes: an indoor connecting pipe (17) and a bypass pipe (16). The indoor connecting pipe (17) is connected to the liquid side shut-off valve (25). The bypass pipe (16) is connected to the suction pipe (41). The first outdoor expansion valve (36*a*) is installed in the liquid pipe (42) and the second outdoor expansion valve (36*b*) is installed in the bypass pipe (16).

The internal heat exchanger (15) includes a first channel (15*a*) disposed midway through the indoor connecting pipe (17) and a second channel (15*b*) disposed midway through the bypass pipe (16). The second channel (15*b*) is located closer to the suction pipe (41) than the second outdoor expansion valve (36*b*). In the internal heat exchanger (15), the first channel (15*a*) and the second channel (15*b*) are situated next to each other and configured to exchange heat between refrigerant in the first channel (15*a*) and refrigerant in the second channel (15*b*).

The outdoor circuit (21) is provided at the entrance of the compressor (30) with a temperature sensor (45*a*) and a pressure sensor (46*a*) and provided at the exit of the compressor (30) with a temperature sensor (45*b*) and a pressure sensor (46*b*). The liquid pipe (42) is provided with a first outdoor liquid temperature sensor (45*c*) and the indoor connecting pipe (17) is provided with a second outdoor liquid temperature sensor (45*d*). The bypass pipe (16) is provided with a third outdoor liquid temperature sensor (45*i*) upstream of the second channel (15*b*) and provided with a first outdoor gas temperature sensor (45*j*) downstream of the second channel (15*b*). Provided between the second port (P2) of the four-way selector valve (33) and the gas side shut-off valve (26) is a second outdoor gas temperature sensor (45*k*).

<<Indoor Unit>>

The first indoor unit (13*a*) includes a first indoor circuit (22*a*) and the second indoor unit (13*b*) includes a second indoor circuit (22*b*). The first indoor circuit (22*a*) and the second indoor circuit (22*b*) have the same configuration.

Each indoor circuit (22*a*, 22*b*) includes as main component devices an indoor expansion valve (39*a*, 39*b*) serving as a pressure reduction device and an indoor heat exchanger (37*a*, 37*b*) serving as a utilization side heat exchanger. The indoor expansion valves (39*a*, 39*b*) and the indoor heat exchangers (37*a*, 37*b*) constitute individual circuit component parts.

Disposed near each indoor heat exchanger (37*a*, 37*b*) is an indoor fan (14*a*, 14*b*). Furthermore, a filter (28) is provided between each indoor fan (14*a*, 14*b*) and the associated indoor heat exchanger (37*a*, 37*b*). The indoor fan (14) and the filter (28) constitute individual fluid-handling parts (12, 14, 28) through which air for exchanging heat with refrigerant in the indoor heat exchanger (37) flows.

In the first indoor unit (13*a*), an indoor liquid temperature sensor (45*e*) is disposed to the liquid side of the indoor heat exchanger (37*a*) and an indoor gas temperature sensor (45*f*) is disposed to the gas side of the indoor heat exchanger (37*a*). On the other hand, in the second indoor unit (13*b*), an indoor liquid temperature sensor (45*g*) is disposed to the liquid side of the indoor heat exchanger (37*b*) and an indoor gas temperature sensor (45*h*) is disposed to the gas side of the indoor heat exchanger (37*b*).

<<Controller>>

Like Embodiment 1, the controller (50) diagnoses the conditions of the component parts of the refrigeration system (10) based on thermodynamic analysis for analyzing the loss produced in each circuit component part. The parts to be diagnosed by the controller (50) are circuit component parts including main component devices and fluid-handling parts (12, 14, 28, 75, 76*b*). The controller (50) is configured to thermodynamically analyze each of the below-described branch circuits (67).

The controller (50) includes, in addition to a refrigerant state detection section (51), a loss calculation section (52), a loss storage section (53), a diagnosing section (54) and a display section (55) all of which are the same as those in Embodiment 1, a flow volume calculation section (56). The flow volume calculation section (56) constitutes a flow volume calculation means. The flow volume calculation section (56) is configured to calculate each of the refrigerant flow volume in each indoor circuit (22) and the refrigerant flow volume in the bypass pipe (16) as the refrigerant flow volume in the below-described branch circuit (67). The following description is given only of the configuration of the flow volume calculation section (56).

Specifically, the flow volume calculation section (56) calculates the ratio ($G_1/G$)) of the refrigerant flow volume $G_1$ in the first indoor circuit (22*a*) to the refrigerant circulating volume G in the refrigerant circuit (20), the ratio ($G_2/G$)) of the refrigerant flow volume $G_2$ in the second indoor circuit (22*b*) to the refrigerant circulating volume G in the refrigerant circuit (20), the ratio ($G_3/G$)) of the refrigerant flow volume $G_3$ in the bypass pipe (16) to the refrigerant circulating volume G in the refrigerant circuit (20), and the refrigerant circulating volume G in the refrigerant circuit (20) (i.e., the flow volume of refrigerant discharged by the compressor (30)). Furthermore, the flow volume calculation section (56) calculates the refrigerant flow volume $G_1$ in the first indoor circuit (22*a*), the refrigerant flow volume $G_2$ in the second indoor circuit (22*b*) and the refrigerant flow volume $G_3$ in the bypass pipe (16) by multiplying the ratio ($G_1/G$, $G_2/G$, $G_3/G$) of the refrigerant flow volume in each of the indoor circuits (22) and the bypass pipe (16) to the refrigerant circulating volume G in the refrigerant circuit (20) by the refrigerant circulating volume G in the refrigerant circuit (20).

The ratio ($G_1/G$) of the refrigerant flow volume $G_1$ in the first indoor circuit (22*a*) to the refrigerant circulating volume G in the refrigerant circuit (20) is calculated using the following Equation 3. The ratio ($G_2/G$) of the refrigerant flow volume $G_2$ in the second indoor circuit (22*b*) to the refrigerant circulating volume G in the refrigerant circuit (20) is calculated using the following Equation 4. The ratio ($G_3/G$) of the refrigerant flow volume $G_3$ in the bypass pipe (16) to the refrigerant circulating volume G in the refrigerant circuit (20) is calculated using the following Equation 5.

$$G_1/G=(h_4-h_3)\times(h_5-h_2)/(h_5-h_3)/(h_1-h_2) \quad \text{Equation 3}$$

$$G_2/G=(h_4-h_3)\times(h_5-h_1)/(h_5-h_3)/(h_2-h_1) \quad \text{Equation 4}$$

$$G_3/G=(h_4-h_5)/(h_3-h_5) \quad \text{Equation 5}$$

In the above Equations 3 to 5, $h_1$ denotes the refrigerant enthalpy downstream of the indoor heat exchanger (37*a*) in the first indoor circuit (22*a*), $h_2$ denotes the refrigerant enthalpy downstream of the indoor heat exchanger (37*b*) in the second indoor circuit (22*b*), $h_3$ denotes the refrigerant enthalpy downstream of the internal heat exchanger (15) in the bypass pipe (16), $h_4$ denotes the refrigerant enthalpy after meeting of refrigerant of the first indoor circuit (22*a*) and refrigerant of the second indoor circuit (22*b*) and before meeting of them with refrigerant of the bypass pipe (16), and $h_5$ denotes the refrigerant enthalpy after meeting of refrigerant of the first indoor circuit (22*a*) and refrigerant of the second indoor circuit (22*b*) with refrigerant of the bypass pipe (16).

Figure 15:
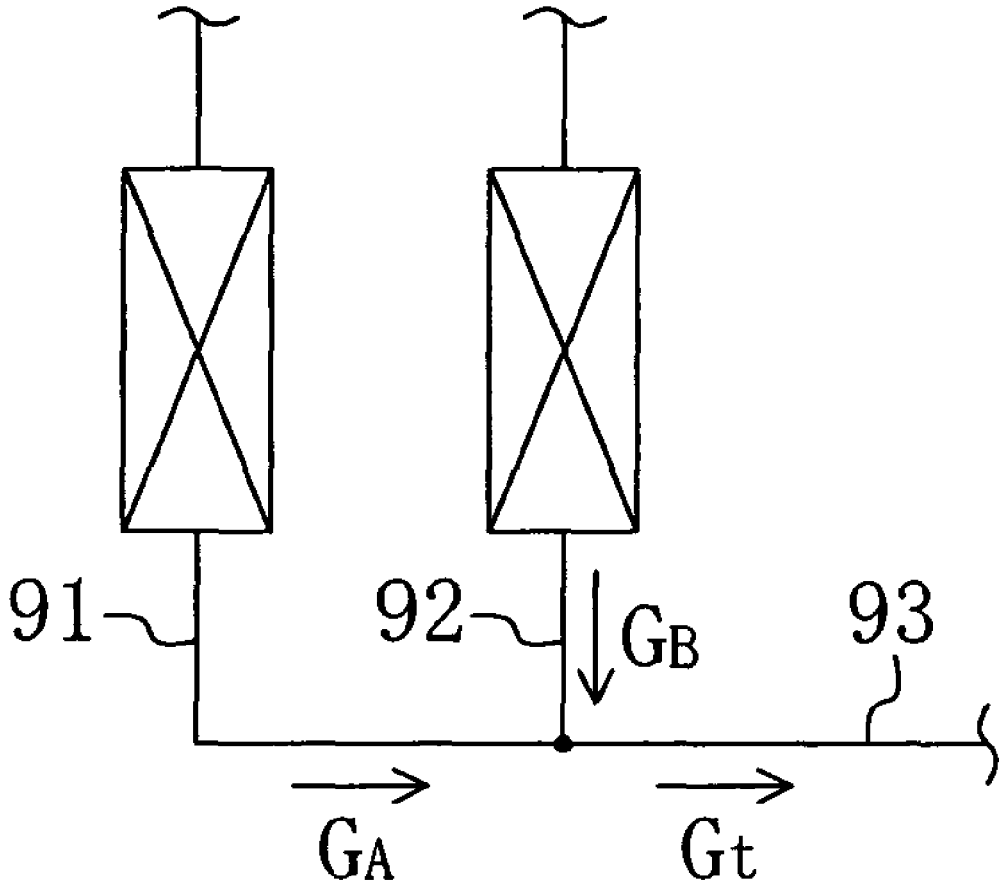
FIG. 15 is a circuit diagram for illustrating Equations 6 to 9 in Embodiment 2 of the present invention.

The above Equations 3 to 5 are made using the fact that the refrigerant flow volumes in two circuits (91, 92) joining each other into the circuit shown in FIG. 15 are expressed by Equations 8 and 9 derived from the following Equations 6 and 7.

$$G_A\times h_A+G_B\times h_B=ht\times Gt \quad \text{Equation 6}$$

$$G_A+G_B=Gt \quad \text{Equation 7}$$

$$G_A/(G_A/G_B)=(ht-h_B)/(h_A-h_B) \quad \text{Equation 8}$$

$$G_B/(G_A/G_B)=(ht-h_A)/(h_2-h_A) \quad \text{Equation 9}$$

In the above Equations 6 to 9, $G_A$ denotes the refrigerant flow volume in a first circuit (91), which is one of the two circuits (91, 92) joining each other, $G_B$ denotes the refrigerant flow volume in a second circuit (92), which is the other of the two circuits (91, 92), Gt denotes the refrigerant flow volume in a joint circuit (93) located after the joining of the first circuit (91) and the second circuit (92), $h_A$ denotes the refrigerant enthalpy in the first circuit (91), $h_B$ denotes the refrigerant enthalpy in the second circuit (92) and ht denotes the refrigerant enthalpy in the joint circuit (93).

The refrigerant circulating volume G in the refrigerant circuit (20) is calculated using the following Equation 10.

$$G=W/(h_H-h_L) \quad \text{Equation 10}$$

In the above Equation 10, W denotes the input electric power of the compressor (30), $h_H$ denotes the enthalpy of refrigerant discharged from the compressor (30) and $h_L$ denotes the enthalpy of refrigerant sucked into the compressor (30).

-Operational Behavior of Refrigeration System-

Next, a description is given of the operational behavior of the refrigeration system (10).

<Cooling Operation>

In the cooling operation, the four-way selector valve (33) is selected to the second position. When in this position the compressor (30) is operated, the refrigerant circuit (20) operates in a vapor compression refrigeration cycle in which the outdoor heat exchanger (34) serves as a condenser (gas cooler) and the indoor heat exchanger (37) serves as an evaporator. In the cooling operation, the first outdoor expansion valve (36*a*) is selected to the fully-open position and the openings of the second outdoor expansion valve (36*b*) and both the indoor expansion valves (39*a*, 39*b*) are appropriately adjusted.

In the cooling operation, a part of the refrigerant circuit from the converging point of the suction pipe (41) with the bypass pipe (16) to the diverging point of the liquid pipe (42) into the bypass pipe (16) constitutes a main circuit (66). In other words, the main circuit (66) is a part of the refrigerant circuit from a point at which all of refrigerant returning to the compressor (30) joins to a point at which refrigerant discharged from the compressor (30) first branches off. Furthermore, the bypass pipe (16) and the indoor circuits (22*a*, 22*b*) constitute individual branch circuits (67). The branch circuits (67) are connected in parallel with each other to the main circuit (66).

Specifically, the refrigerant discharged from the compressor (30) exchanges heat with outdoor air in the outdoor heat exchanger (34) to condense. The refrigerant having condensed in the outdoor heat exchanger (34) is distributed to the indoor connecting pipe (17) and the bypass pipe (16). The refrigerant having flowed into the indoor connecting pipe (17) flows through the first channel (15*a*) of the internal heat exchanger (15). On the other hand, the refrigerant having flowed into the bypass pipe (16) is reduced in pressure by the second outdoor expansion valve (36*b*) and then flows into the second channel (15*b*) of the internal heat exchanger (15). In the internal heat exchanger (15), heat is exchanged between refrigerant in the first channel (15*a*) and refrigerant in the second channel (15*b*). Through the heat exchange, the refrigerant in the first channel (15*a*) is cooled and the refrigerant in the second channel (15*b*) is heated.

The refrigerant having flowed through the first channel (15*a*) is distributed to the indoor circuits (22*a*, 22*b*). In each indoor circuit (22), the refrigerant is reduced in pressure during passage through the indoor expansion valve (39) and then exchanges heat with room air in the indoor heat exchanger (37) to evaporate. The refrigerant having evaporated in the indoor heat exchanger (37) meets the refrigerant having flowed through the bypass pipe (16), is then sucked into the compressor (30) and compressed therein.

<Heating Operation>

In the heating operation, the four-way selector valve (33) is selected to the first position. When in this position the compressor (30) is operated, the refrigerant circuit (20) operates in a vapor compression refrigeration cycle in which the outdoor heat exchanger (34) serves as an evaporator and the indoor heat exchanger (37) serves as a condenser (gas cooler). In the heating operation, the second outdoor expansion valve (36*b*) is selected to the fully-closed position and the openings of the first outdoor expansion valve (36*a*) and both the indoor expansion valves (39*a*, 39*b*) are appropriately adjusted.

In the heating operation, the indoor circuit (22), the liquid side connection pipe (23) and the gas side connection pipe (24) constitute a main circuit (66). Furthermore, the indoor circuits (22*a*, 22*b*) constitute individual branch circuits (67).

Specifically, the refrigerant having discharged from the compressor (30) is distributed to the indoor circuits (22*a*, 22*b*). In each indoor circuit (22), the refrigerant exchanges heat with room air in the indoor heat exchanger (37) to condense. The refrigerant having condensed in the indoor heat exchanger (37) is reduced in pressure during passage through the indoor expansion valve (39) and the first outdoor expansion valve (36*a*) and then exchanges heat with outdoor air in the outdoor heat exchanger (34) to evaporate. The refrigerant having evaporated in the outdoor heat exchanger (34) is sucked into the compressor (30) and compressed therein.

-Operation of Controller-

A description is given of the operation of the controller (50) upon diagnosis of the conditions of the parts to be diagnosed. The diagnosis of the conditions of the parts to be diagnosed is carried out during the cooling operation and heating operation. The following description is made with reference to the diagnosis during the cooling operation.

In the cooling operation, the controller (50) thermodynamically analyzes each of the indoor circuits (22*a*, 22*b*) and the bypass pipe (16). First, a description is given of the thermodynamic analysis of each indoor circuit (22*a*, 22*b*). Note that the following description is given only of the thermodynamic analysis of the first indoor circuit (22*a*). The thermodynamic analysis of the second indoor circuit (22*b*) is the same as that of the first indoor circuit (22*a*) and, therefore, the description thereof is not given.

In thermodynamically analyzing the first indoor circuit (22*a*), the refrigerant state detection section (51) detects the refrigerant temperatures and entropies at ten points: the entrance and exit of the compressor (30), the entrance and exit of the outdoor heat exchanger (34), the entrance and exit of the internal heat exchanger (15), the entrance and exit of the indoor expansion valve (39), and the entrance and exit of the indoor heat exchanger (37).

In Embodiment 2, the refrigerant temperature and entropy at the exit of the compressor (30) are considered to be equal to those at the entrance of the outdoor heat exchanger (34), the refrigerant temperature and entropy at the exit of the outdoor heat exchanger (34) are considered to be equal to those at the entrance of the internal heat exchanger (15), the refrigerant temperature and entropy at the exit of the internal heat exchanger (15) are considered to be equal to those at the entrance of the indoor expansion valve (39), and the refrigerant temperature and entropy at the exit of the indoor expansion valve (39) are considered to be equal to those at the entrance of the indoor heat exchanger (37). Furthermore, the refrigerant entropies at the exit of the outdoor heat exchanger (34) and the exit of the internal heat exchanger (15) are calculated on the presumption that the refrigerant pressures at them are equal to that at the exit of the compressor (30), and the refrigerant entropies at the entrance and exit of the indoor heat exchanger (37) are calculated on the presumption that the refrigerant pressures at them are equal to that at the entrance of the compressor (30).

Next, the loss calculation section (52) uses the refrigerant temperatures and entropies detected by the refrigerant state detection section (51) to separately calculate the values of losses produced in the circuit component parts (main component devices) including the compressor (30), the outdoor heat exchanger (34), the internal heat exchanger (15), the indoor expansion valve (39) and the indoor heat exchanger (37).

Figure 16A:
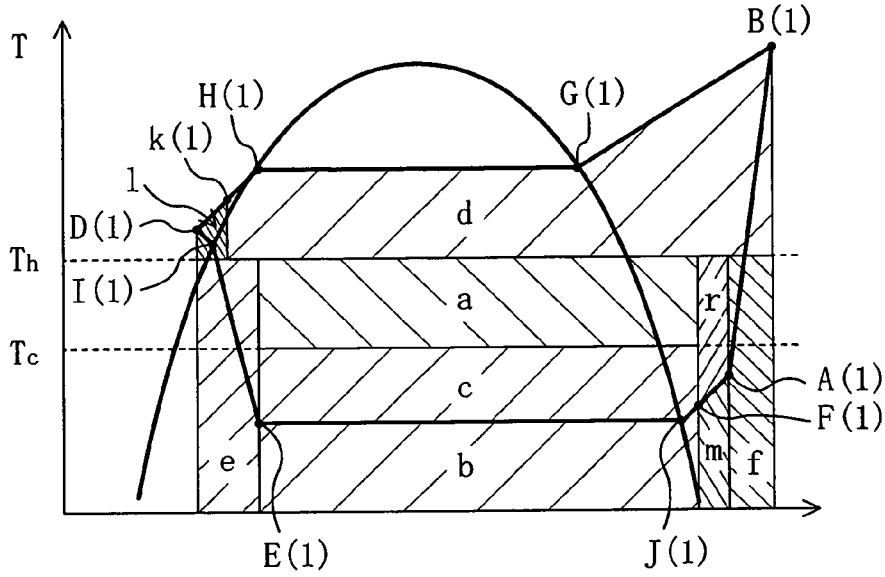
FIG. 16A is a T-s diagram for an indoor circuit and FIG. 16B is a T-s diagram for a bypass pipe.

Now shown in FIG. 16A is a T-s diagram plotted by a thermodynamic analysis of the first indoor circuit (22*a*). In FIG. 16A, Point A(1) corresponds to the state of refrigerant at the entrance of the compressor (30), Point B(1) corresponds to the state of refrigerant at the exit of the compressor (30) (the entrance of the outdoor heat exchanger (34)), Point K(1) corresponds to the state of refrigerant at the exit of the outdoor heat exchanger (34) (the entrance of the internal heat exchanger (15)), Point D(1) corresponds to the state of refrigerant at the exit of the internal heat exchanger (15) (the entrance of the indoor expansion valve (39)), Point E(1) corresponds to the state of refrigerant at the entrance of the indoor heat exchanger (37) (the exit of the indoor expansion valve (39)), and Point F(1) corresponds to the state of refrigerant at the exit of the indoor heat exchanger (37).

Point G(1) is an intersecting point of a constant pressure line passing through Point B(1) and a saturated vapor line. Point H(1) is an intersecting point of a constant pressure line passing through Point D(1) and a saturated liquid line. Point I(1) is an intersecting point of a constant enthalpy line passing through Point D(1) and the saturated liquid line. Point J(1) is an intersecting point of a constant pressure line passing through Point F(1) and the saturated vapor line.

Furthermore, in FIG. 16A, Region (a) indicates the workload of the reverse Carnot cycle, Region (b) indicates the quantity of heat taken in the indoor heat exchanger (37), Region (c) indicates the loss in the indoor heat exchanger (37), Region (d) indicates the loss in the outdoor heat exchanger (34), Region (e) indicates the friction loss during passage of refrigerant through the indoor expansion valve (39), Region (f) indicates the loss due to mechanical friction in the compressor (30), Region (1) indicates the loss in the internal heat exchanger (15), Region (m) indicates the quantity of heat penetrating the pipe between the indoor heat exchanger (37) and the compressor (30), and Region (r) indicates the loss due to heat exchange in the pipe between the indoor heat exchanger (37) and the compressor (30).

Each of the areas of Regions (a), (d), (f), (l), (m) and (r) indicating the losses of circuit component parts in the main circuit (66) represents the magnitude of loss corresponding to the ratio of the refrigerant flow volume flowing into the indoor circuit (22) to the refrigerant flow volume in the main circuit (66) as a value per unit refrigerant flow volume.

Next, a description is given of the thermodynamic analysis of the bypass pipe (16).

In thermodynamically analyzing the bypass pipe (16), the refrigerant state detection section (51) detects the refrigerant temperatures and entropies at eight points: the entrance and exit of the compressor (30), the entrance and exit of the outdoor heat exchanger (34), the entrance and exit of the second outdoor expansion valve (36*b*) and the entrance and exit of the internal heat exchanger (15).

In Embodiment 2, the refrigerant temperature and entropy at the exit of the compressor (30) are considered to be equal to those at the entrance of the outdoor heat exchanger (34), the refrigerant temperature and entropy at the exit of the outdoor heat exchanger (34) are considered to be equal to those at the entrance of the second outdoor expansion valve (36*b*), and the refrigerant temperature and entropy at the exit of the second outdoor expansion valve (36*b*) are considered to be equal to those at the entrance of the internal heat exchanger (15). Furthermore, the refrigerant entropy at the exit of the outdoor heat exchanger (34) is calculated on the presumption that the refrigerant pressure thereat is equal to that at the exit of the compressor (30), and the refrigerant entropies at the entrance and exit of the internal heat exchanger (15) are calculated on the presumption that the refrigerant pressures at them are equal to that at the entrance of the compressor (30).

Next, the loss calculation section (52) uses the refrigerant temperatures and entropies detected by the refrigerant state detection section (51) to separately calculate the values of losses produced in the circuit component parts (main component devices) including the compressor (30), the outdoor heat exchanger (34), the second outdoor expansion valve (36*b*) and the internal heat exchanger (15).

Figure 16B:
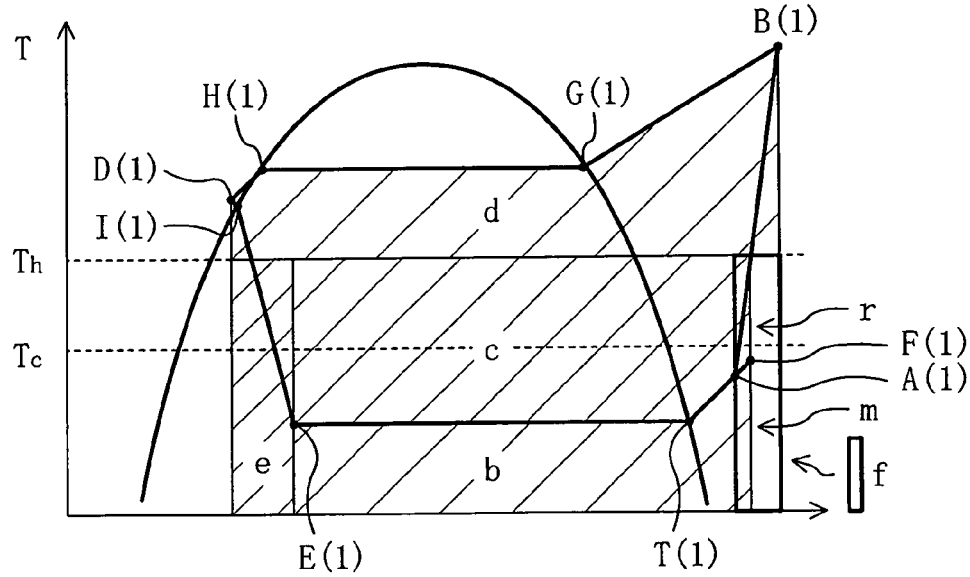

Now shown in FIG. 16B is a T-s diagram plotted by a thermodynamic analysis of the bypass pipe (16). In FIG. 16B, Point A(1) corresponds to the state of refrigerant at the entrance of the compressor (30), Point B(1) corresponds to the state of refrigerant at the exit of the compressor (30) (the entrance of the outdoor heat exchanger (34)), Point D(1) corresponds to the state of refrigerant at the exit of the outdoor heat exchanger (34) (the entrance of the second outdoor expansion valve (36*b*)), Point E(1) corresponds to the state of refrigerant at the entrance of the internal heat exchanger (15) (the exit of the second outdoor expansion valve (36*b*)), and Point F(1) corresponds to the state of refrigerant at the exit of the internal heat exchanger (15). Points G(1), H(1), I(1) and J(1) are the same as those in the thermodynamic analysis of the indoor circuit (22).

Furthermore, in FIG. 16B, Region (b) indicates the quantity of heat taken in the internal heat exchanger (15), Region (c) indicates the loss in the internal heat exchanger (15), Region (d) indicates the loss in the outdoor heat exchanger (34), Region (e) indicates the friction loss during passage of refrigerant through the second outdoor expansion valve (36*b*), Region (f) indicates the loss due to mechanical friction in the compressor (30), Region (m) indicates the quantity of heat penetrating the pipe between the internal heat exchanger (15) and the compressor (30), and Region (r) indicates the loss due to heat exchange in the pipe between the internal heat exchanger (15) and the compressor (30). Each of the areas of Regions (d), (f), (m) and (r) indicating the losses of circuit component parts in the main circuit (66) represents the magnitude of loss corresponding to the ratio of the refrigerant flow volume in the bypass pipe (16) to the refrigerant flow volume in the main circuit (66) as a value per unit refrigerant flow volume.

The loss calculation section (52) calculates the value of loss produced in each circuit component part based on the thermodynamic analyses of the indoor circuits (22*a*, 22*b*) and the thermodynamic analysis of the bypass pipe (16). Specifically, for each of circuit component parts in the indoor circuits (22*a*, 22*b*) and the bypass pipe (16) serving as branch circuits (67), the loss calculation section (52) calculates, from the T-s diagram for the branch circuit (67) including the circuit component part whose value of loss is to be calculated, the area of the region associated with the loss produced in the circuit component part. The area of the region represents the magnitude of loss produced in that circuit component part as a value per unit refrigerant flow volume. The loss calculation section (52) calculates the value of loss of the circuit component part in the branch circuit (67) as a workload by multiplying the area of the region for the circuit component part by the refrigerant flow volume in the branch circuit (67) calculated by the flow volume calculation section (56).

On the other hand, for each of circuit component parts in the main circuit (66), the loss calculation section (52) calculates, from the respective T-s diagrams for the branch circuits (67), the areas of the regions associated with the loss in the circuit component part whose value of loss is to be calculated. The area of the region associated with that circuit component part in the T-s diagram for each branch circuit (67) represents the magnitude of loss in the circuit component corresponding to the ratio of the refrigerant flow volume in the branch circuit (67) to the refrigerant flow volume in the main circuit (66) as a value per unit refrigerant flow volume. The loss calculation section (52) calculates the value of loss of the circuit component part in the main circuit (66) as a workload by summing up the values obtained by multiplying the respective calculated areas of the regions of the T-s diagrams for the circuit component part by the respective refrigerant flow volumes in the associated branch circuits (67) calculated by the flow volume calculation section (56) (see Equation 11).

$$R=\Sigma A\times G_X \qquad \text{Equation 11}$$

In Equation 11, R denotes the value of loss of a circuit component part in the main circuit (66), A denotes the area of the region of the T-s diagram for a branch circuit (67) associated with the loss produced in the circuit component part in the main circuit (66), and $G_X$ denotes the refrigerant flow volume in the branch circuit (67) for which the value A is calculated.

Like Embodiment 1, the diagnosing section (54) selects, from among reference values of losses under a plurality of operating situations stored in the loss storage section (53), a reference value of loss under an operating situation corresponding to an operating situation at diagnosis. Furthermore, the diagnosing section (54) diagnoses the conditions of the circuit component parts and the fluid-handling parts (12, 14, 28, 75, 76*b*) by comparing, for the loss produced in each circuit component part, the value of loss calculated by the loss calculation section (52) with the reference value of loss under the selected operating situation.

Modification of Embodiment 2

Figure 17:
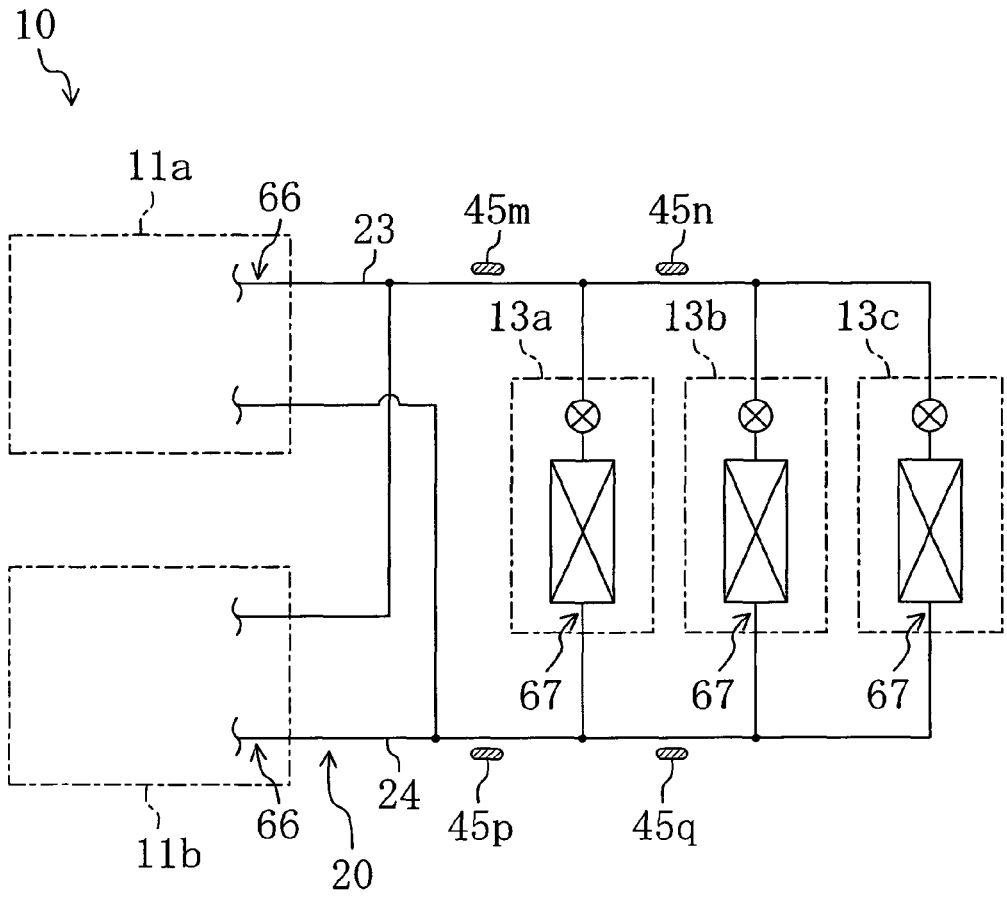
FIG. 17 is a schematic diagram of a refrigeration system according to a modification of Embodiment 2 of the present invention.

A description is given of a modification of Embodiment 2. As shown in FIG. 17, the refrigeration system (10) of this modification includes two outdoor units: a first outdoor unit (11*a*) and a second outdoor unit (11*b*). The first outdoor unit (11*a*) and the second outdoor unit (11*b*) are connected in parallel with each other. The number of outdoor units (11) is illustrative only.

Figure 18:
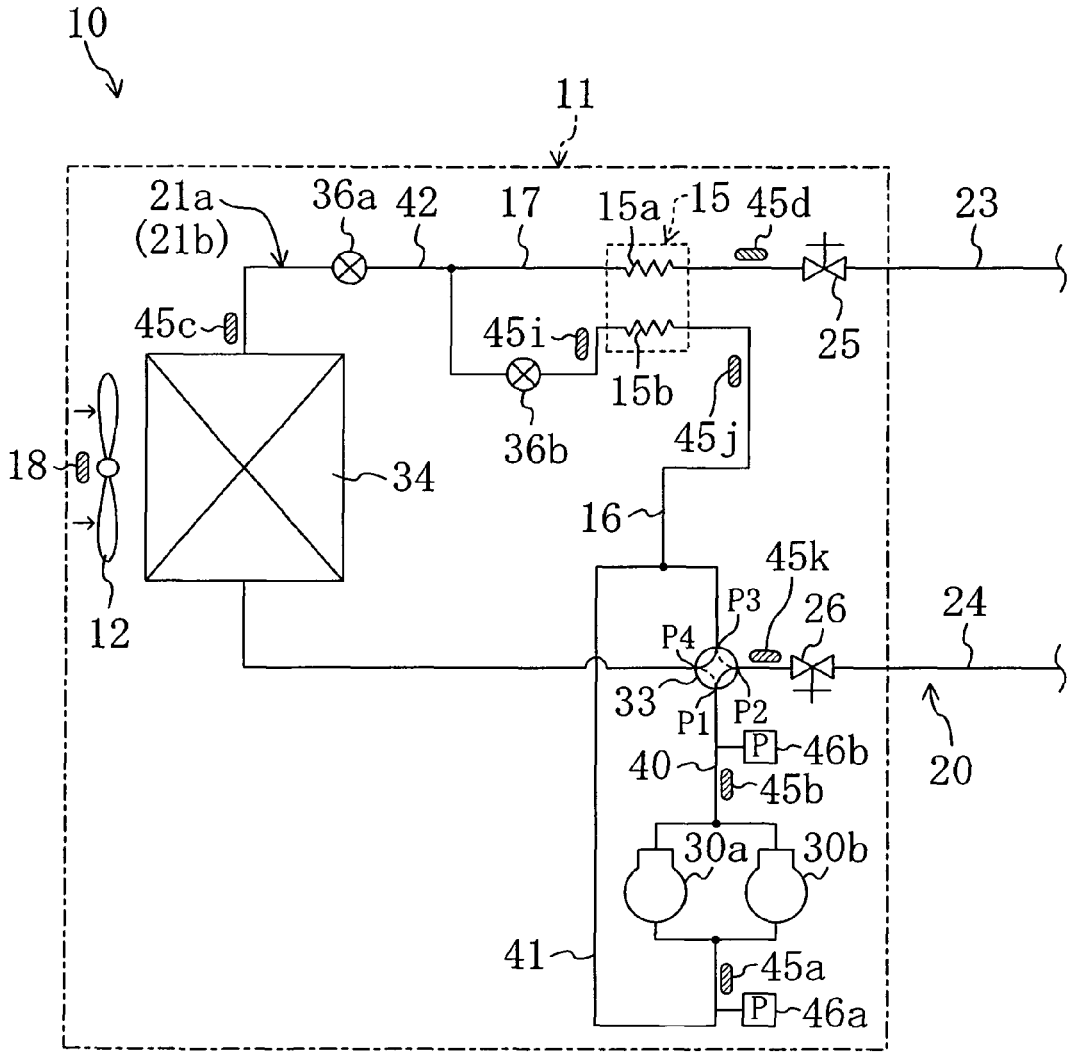
FIG. 18 is a schematic diagram of an outdoor unit of the refrigeration system according to the modification of Embodiment 2 of the present invention.

The first outdoor unit (11*a*) contains a first outdoor circuit (21*a*) and the second outdoor unit (11*b*) contains a second outdoor circuit (21*b*). The first outdoor circuit (21*a*) and the second outdoor circuit (21*b*) have the same configuration. Each outdoor circuit (21), as shown in FIG. 18, has the same configuration as the outdoor circuit in Embodiment 2 except that it includes two compressors (30*a*, 30*b*). The two compressors (30*a*, 30*b*) are connected in parallel with each other. A first compressor (30*a*), one of the two compressors, is a variable-displacement compressor and a second compressor (30*b*), the other of the two compressors, is a fixed-displacement compressor.

The refrigeration system (10) of this modification further includes three indoor units: a first indoor unit (13*a*), a second indoor unit (13*b*) and a third indoor unit (13*c*). The first indoor unit (13*a*) contains a first indoor circuit (22*a*), the second indoor unit (13*b*) contains a second indoor circuit (22*b*), and the third indoor units (13*c*) contains a third indoor circuit (22*c*). Furthermore, each of the liquid side connection pipe (23) and the gas side connection pipe (24) is provided with two temperature sensors (45*m*, 45*n*, 45*p*, 45*q*), one between the first indoor circuit (22*a*) and the second indoor circuit (22*b*) and the other on the way from the first indoor circuit (22*a*) to each outdoor circuit (21).

In the cooling operation in this modification in which the second outdoor expansion valve (36*a*) is open, a part of each outdoor circuit (21) from the converging point of the suction pipe (41) with the bypass pipe (16) to the diverging point of the liquid pipe (42) into the bypass pipe (16) constitutes a main circuit (66). Furthermore, the bypass pipe (16) and the indoor circuits (22*a*, 22*b*, 22*c*) constitute individual branch circuits (67). The indoor circuits (22*a*, 22*b*, 22*c*) are connected in parallel with each other to both of the main circuit (66) of the first outdoor circuit (21*a*) and the main circuit (66) of the second outdoor circuit (21*b*).

On the other hand, in the heating operation in which the second outdoor expansion valve (36*b*) is closed, the outdoor circuits (21) constitute individual main circuits (66) and the indoor circuits (22*a*, 22*b*, 22*c*) constitute individual branch circuits (67). The indoor circuits (22*a*, 22*b*, 22*c*) are connected in parallel with each other to both of the first outdoor circuit (21*a*) and the second outdoor circuit (21*b*).

The controller (50), like Embodiment 2, includes a refrigerant state detection section (51), a loss calculation section (52), a loss storage section (53), a diagnosing section (54), a display section (55) and a flow volume calculation section (56). The flow volume calculation section (56) in this modification is configured to calculate the respective refrigerant flow volumes ($G_1$, $G_2$, $G_3$) in the indoor circuits (22) and the respective refrigerant flow volumes ($G_{b1}$, $G_{b2}$) in the bypass pipes (16) of the outdoor circuits (21) according to equations made using Equations 8 and 9 in the same manner as in Embodiment 2.

Furthermore, in this modification, the flow volume calculation section (56) is configured to calculate, for the refrigerant flow volume ($G_1$, $G_2$, $G_3$) in each indoor circuit (22), the flow volume ($G_{1\text{-}1}$, $G_{2\text{-}1}$, $G_{3\text{-}1}$) of refrigerant flowing thereinto from the first outdoor circuit (21*a*) and the flow volume ($G_{1\text{-}2}$, $G_{2\text{-}2}$, $G_{3\text{-}2}$) of refrigerant flowing thereinto from the second outdoor circuit (21*b*). For example, out of the refrigerant flow volume ($G_1$) in the first indoor circuit (22*a*), the flow volume ($G_{1\text{-}1}$) of refrigerant inflowing from the first outdoor circuit (21*a*) is calculated according to the following Equation 12.

$$G_{1\text{-}1}=G_1\times G_{mA}/(G_{mA}+G_{mB}) \qquad \text{Equation 12}$$

In Equation 12, $G_{mA}$ denotes the flow volume of refrigerant outflowing from the first outdoor circuit (21*a*) and $G_{mB}$ denotes the flow volume of refrigerant outflowing from the second outdoor circuit (21*b*). These refrigerant flow volumes ($G_{mA}$, $G_{mB}$) are calculated using the following Equations 13 and 14 by the flow volume calculation section (56).

$$G_{mA}=(G_{Inv\text{-}A}+G_{Std\text{-}A})-G_{b1} \qquad \text{Equation 13}$$

$$G_{mB}=(G_{Inv\text{-}B}+G_{Std\text{-}B})-G_{b2} \qquad \text{Equation 14}$$

In Equations 13 and 14, $G_{Inv}$ denotes the flow volume of refrigerant discharged from the first compressor (30*a*) and $G_{Std}$ denotes the flow volume of refrigerant discharged from the second compressor (30*b*). These refrigerant flow volumes ($G_{Inv}$, $G_{Std}$) are calculated using the previously-stated Equation 10 by the flow volume calculation section (56).

The controller (50) thermodynamically analyzes each of the indoor circuits (22*a*, 22*b*, 22*c*) and the bypass pipes (16) of the outdoor circuits (21*a*, 21*b*). The operation of the controller (50) in thermodynamically analyzing each indoor circuit (22) and the operation of the controller (50) in thermodynamically analyzing the bypass pipe (16) of each outdoor circuit (21) are the same as those in Embodiment 2. A T-s diagram plotted by a thermodynamic analysis of each indoor circuit (22) is as shown in FIG. 16A and a T-s diagram plotted by a thermodynamic analysis of the bypass pipe (16) of each outdoor circuit (21) is as shown in FIG. 16B.

This modification is different from Embodiment 2 in the operation of the loss calculation section (52) in calculating the value of loss produced in each circuit component part of the main circuit (66). The operation of the loss calculation section (52) in calculating the value of loss produced in each circuit component part of the branch circuit (67) is the same as in Embodiment 2 and, therefore, the description thereof is not given. The following description is given of the operation of calculating the value of loss produced in each circuit component part of the first outdoor circuit (21*a*) out of circuit component parts in the main circuit (66).

The loss calculation section (52) calculates the values of losses produced in circuit component parts in the main circuit (66), more specifically, the values of losses produced in the compressor (30), the outdoor heat exchanger (34) and the first outdoor expansion valve (36*a*), using the following Equation 15.

$$R=\Sigma B\times G_Y+C\times G_{b1} \qquad \text{Equation 15}$$

In Equation 15, R denotes the value of loss of a circuit component part in the main circuit (66), B denotes the area of the region of the T-s diagram for an indoor circuit (22) associated with the loss produced in the circuit component part in the main circuit (66), $G_Y$ denotes the flow volume ($G_{1-1}$, $G_{2-1}$, $G_{3-1}$) of refrigerant flowing from the first outdoor circuit (21*a*) into the indoor circuit (22) for which the value B is calculated, and C denotes the area of the region of the T-s diagram for the bypass pipe (16) of the first outdoor circuit (21*a*) associated with the loss produced in the circuit component part in the main circuit (66).

In Equation 15, the value of loss produced in the compressor (30) is calculated as the sum of the value of loss produced in the first compressor (30*a*) and the value of loss produced in the second compressor (30*b*). The loss calculation section (52) calculates the value of loss produced in each compressor (30*a*, 30*b*) by proportionally dividing the value of loss in the compressor (30) at the ratio between the flow volume $G_{Inv\text{-}A}$ of refrigerant discharged from the first compressor (30*a*) and the flow volume $G_{Std\text{-}A}$ of refrigerant discharged from the second compressor (30*b*).

Embodiment 3 of the Invention

A description is given of Embodiment 3 of the present invention. Embodiment 3 is directed to a refrigeration system (10) according to the present invention. The refrigeration system (10) is configured as a refrigeration system having a hot water supply function.

Figure 19:
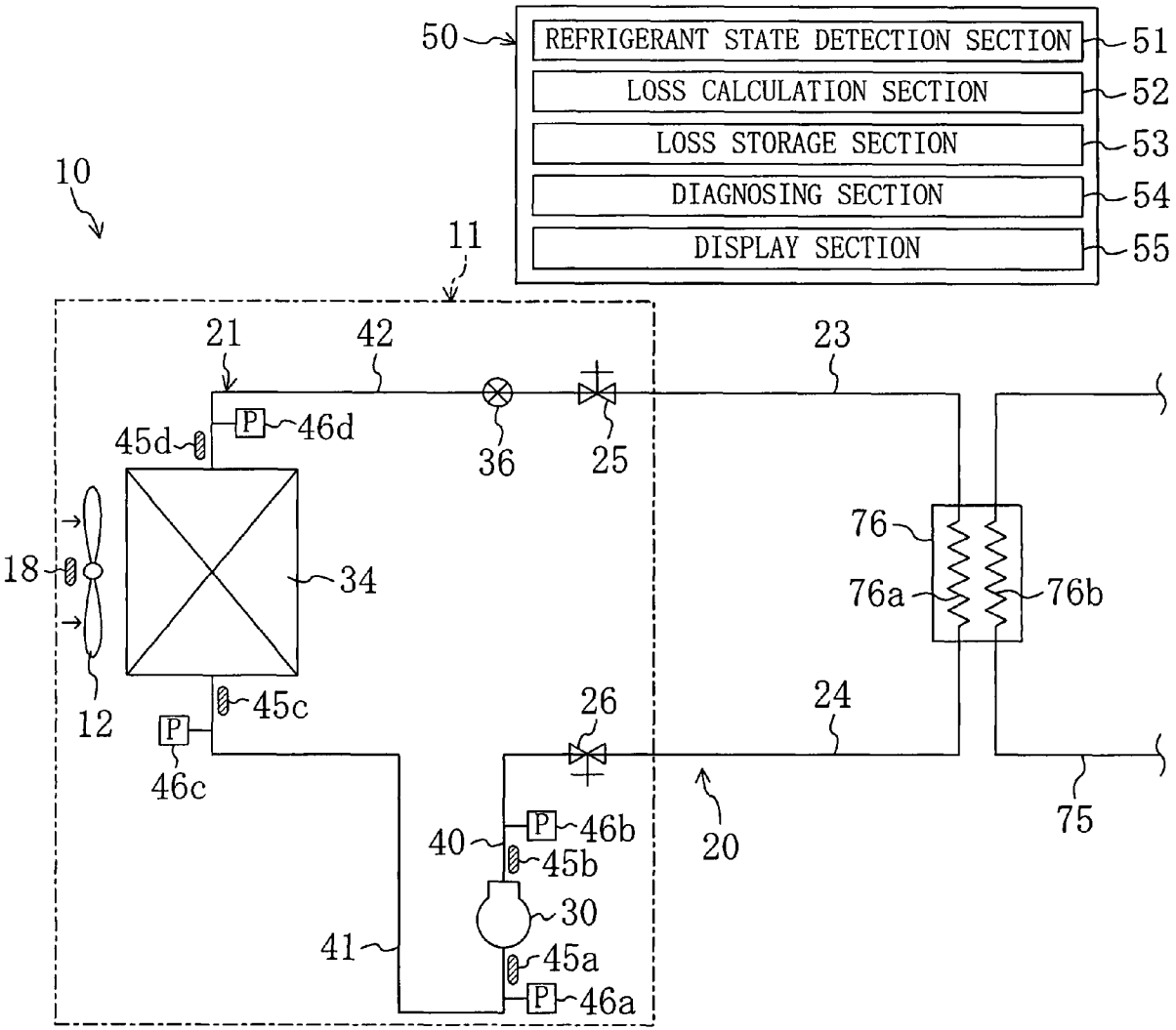
FIG. 19 is a schematic diagram of a refrigeration system according to Embodiment 3 of the present invention.

Specifically, as shown in FIG. 19, the refrigeration system (10) includes a water circulation circuit (75) through which water circulates, and a hot-water supply heat exchanger (76) for exchanging heat between water in the water circulation circuit (75) and refrigerant in the refrigerant circuit (20) to heat the water. The water circulation circuit (75) constitutes one of fluid-handling parts (12, 14, 28, 75, 76*b*). City water circulates through the water circulation circuit (75). The refrigerant circuit (20) is filled with carbon dioxide as refrigerant. The refrigeration system (10) is, like the modification of Embodiment 1, configured so that the refrigerant circuit (20) operates in a supercritical cycle.

The hot-water supply heat exchanger (76) includes a first channel (76*a*) included in the refrigerant circuit (20) and a second channel (76*b*) included in the water circulation circuit (75). The second channel (76*b*) constitutes one of fluid-handling parts (12, 14, 28, 75, 76*b*). In the hot-water supply heat exchanger (76), the first channel (76*a*) and the second channel (76*b*) are situated next to each other. Furthermore, the hot-water supply heat exchanger (76) is configured in a countercurrent system in which the entrance of the first channel (76*a*) and the exit of the second channel (76*b*) are on the same side and the exit of the first channel (76*a*) and the entrance of the second channel (76*b*) are on the same side.

In the hot-water supply heat exchanger (76), heat is exchanged between refrigerant in the first channel (76*a*) and water in the second channel (76*b*). Through the heat exchange, the high-pressure and high-temperature refrigerant in the first channel (76*a*) is cooled and the water in the second channel (76*b*) is heated.

Figure 20:
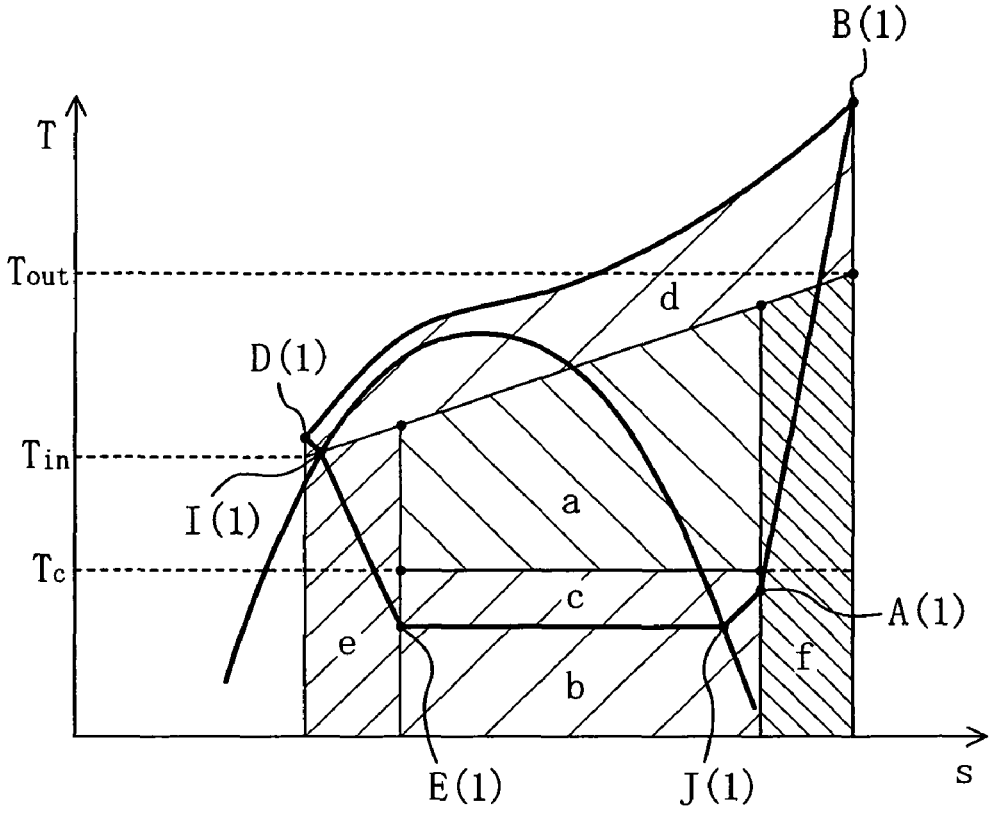
FIG. 20 is a T-s diagram segmentized into respective regions associated with circuit component parts whose values of losses are to be calculated in Embodiment 3 of the present invention.

In the T-s diagram of the refrigeration cycle of the refrigerant circuit (20) in Embodiment 3, as shown in FIG. 20, the boundary line of Region (d) with Regions (a), (e) and (f) inclines by a difference between the water temperature (Tin) at the entrance of the second channel (76*b*) and the water temperature (Tout) at the exit of the second channel (76*b*). The reason for this is that since the hot-water supply heat exchanger (76) is configured in a countercurrent system, the temperature of fluid (water) exchanging heat with the refrigerant in the first channel (76*a*) drops with approach to the exit, unlike Embodiments 1 and 2.

Region (a) in FIG. 20 indicates the workload of the reverse Carnot cycle. Region (b) indicates the quantity of heat taken in the indoor heat exchanger (37). Region (c) indicates the loss produced in the indoor heat exchanger (37). Region (d) indicates the loss produced in the first channel (76*a*). Region (e) indicates the friction loss during passage of refrigerant through the expansion valve (36). Region (f) indicates the loss due to mechanical friction in the compressor (30).

In Embodiment 3, the controller (50) treats, as parts to be diagnosed, the water circulation circuit (75) and the hot-water supply heat exchanger (76) as well as the parts to be diagnosed in Embodiments 1 and 2. The loss produced in the first channel (76*a*) reflects the state of heat exchange in the hot-water supply heat exchanger (76) and depends on not only the condition of the first channel (76*a*) but also the conditions of the second channel (76*b*) and the water circulation circuit (75). The diagnosing section (54) diagnoses, based on the value of loss produced in the first channel (76*a*), the conditions of the second channel (76*b*) and the water circulation circuit (75).

Embodiment 4 of the Invention

A description is given of Embodiment 4 of the present invention. Embodiment 4 is directed to an analyzer (60) for a refrigeration system (10) according to the present invention. The analyzer (60) is configured to analyze the condition of the refrigeration system as described in Embodiment 1, 2 or 3 to diagnose the conditions of its component parts.

-Configuration of Analyzer-

Figure 21:
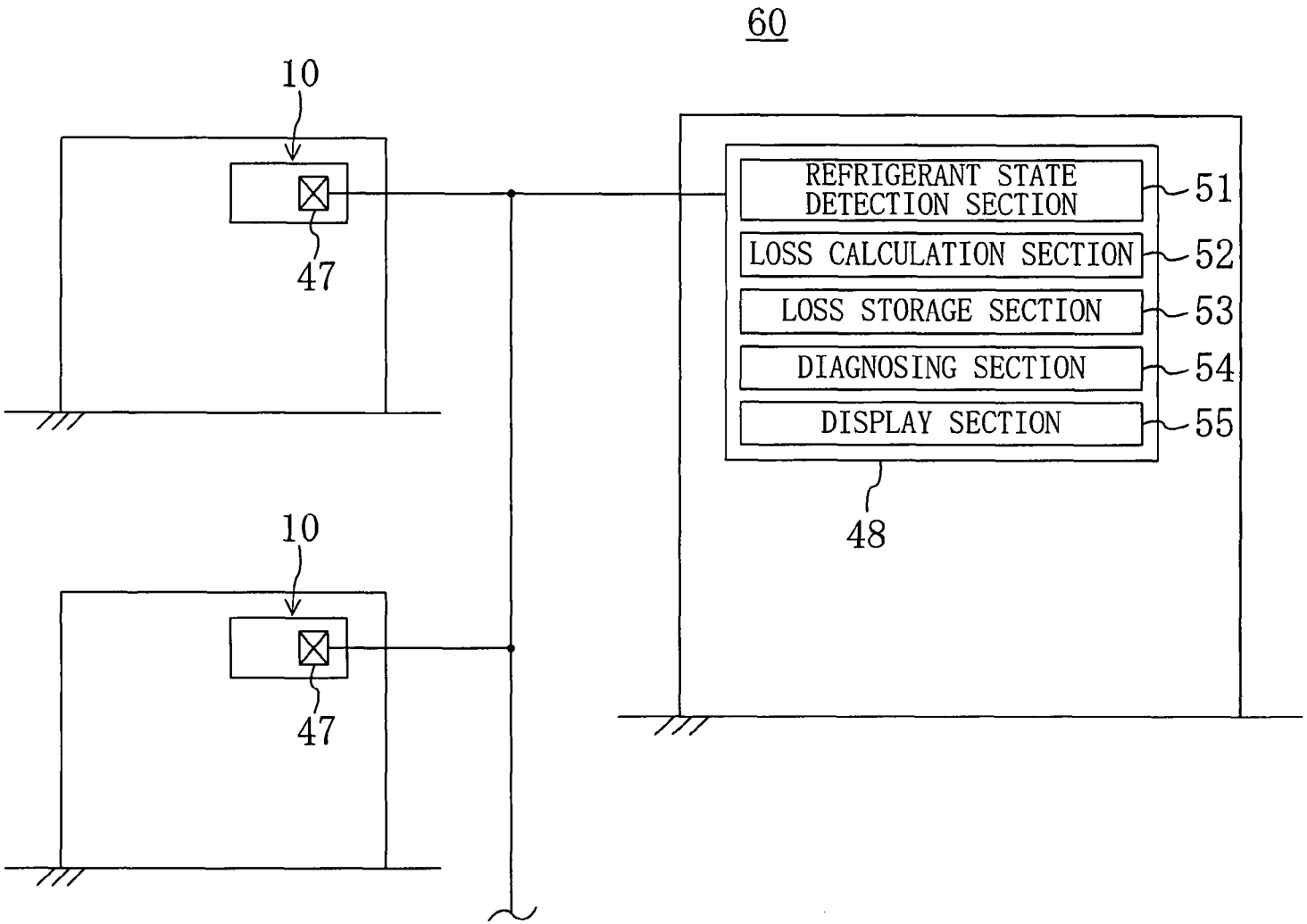
FIG. 21 is a schematic diagram of a refrigeration system analyzer according to Embodiment 4 of the present invention.

As shown in FIG. 21, the analyzer (60) according to Embodiment 4 of the present invention is composed of first component parts (47) and a second component part (48) all of which are connected via communication lines (63) to each other.

Each of the first component parts (47) includes a refrigerant state detection sensor (65). The refrigerant state detection sensor (65) is a sensor for detecting the state of refrigerant in the refrigerant circuit (20) necessary for detecting the refrigerant temperatures and entropies at the exit and entrance of each main component device. Specifically, the refrigerant state detection sensor (65) comprises six temperature sensors (45) and six pressure sensors (46) that are located at the same positions as those in the refrigerant circuit (20) of Embodiment 1.

The second component part (48) includes a refrigerant state detection section (51), a loss calculation section (52), a loss storage section (53), a diagnosing section (54) and a display section (55). The second component part (48) is configured as an electric computer and placed in a building separated from the refrigeration system (10). The refrigerant state detection section (51), the loss calculation section (52), the loss storage section (53), the diagnosing section (54) and the display section (55) are generally the same as those in Embodiment 1 and, therefore, the description of their configurations and operations is not given here.

The analyzer (60) of Embodiment 4 is configured to diagnose the conditions of parts to be diagnosed (circuit component parts and fluid-handling parts (12, 14, 28, 75, 76*b*)) in each of the refrigeration systems (10) connected thereto. In the diagnosis, the measured values of the refrigerant state detection sensor (65) are transmitted from each first component part (47) to the second component part (48). The refrigerant state detection section (51) uses the measured values of the temperature sensors (45) and pressure sensors (46) transmitted from the first component part (47) to detect the refrigerant temperatures and entropies at the exit and entrance of each main component device of the refrigeration system (10).

In Embodiment 4, the diagnosis results on the conditions of the parts to be diagnosed are displayed on the display section (55). The diagnosis results displayed on the display section (55) are checked by, instead of the user of the refrigeration system (10), for example, a person having specialized knowledge about the refrigeration system (10). Therefore, the conditions of the parts to be diagnosed can be comprehended with higher precision, which provides a certain finding of abnormality in the refrigeration system (10). Furthermore, the refrigeration system (10) can be prevented from being at fault.

The display section (55) may display also the values of losses produced in the circuit component parts. Thus, the variation in loss produced in each circuit component part can be separately understood.

In conventional refrigeration system analyzers that diagnose the refrigeration system using communication lines, the condition of the refrigeration system (10) is diagnosed by counting an error code transmitted from the refrigeration system (10). The conventional analyzers, however, can analyze only items to which error codes are preset. Furthermore, one factor may be counted for a plurality of items. In other words, items with no abnormality may be counted as those with abnormality. Therefore, it is difficult for the conventional analyzers to conduct a precise diagnosis.

In contrast, since the analyzer of this embodiment uses the value of loss produced in each circuit component part expressed in a T-s diagram, a person viewing the display section (55) can diagnose various items without limitation to such preset items as has conventionally been the case. Furthermore, the value of loss produced in each circuit component part depends on the condition of the circuit component part or the condition of an associated fluid-handling part (12, 14, 28, 75, 76*b*). Thus, the condition of the part relating to the value of loss can be understood with precision. Therefore, the analyzer can prevent from diagnosing any circuit component part with no abnormality as one with abnormality and conduct a precise diagnosis as compared with the conventional analyzers.

Modification of Embodiment 4

In this modification, out of the refrigerant state detection section (51), the loss calculation section (52), the loss storage section (53), the diagnosing section (54) and the display section (55), the refrigerant state detection section (51) is included in the first component part (47). The refrigerant state detection section (51) and the loss calculation section (52) may be included in the first component part (47), or the refrigerant state detection section (51), the loss calculation section (52), the loss storage section (53) and the diagnosing section (54) may be included in the first component part (47).

Embodiment 5 of the Invention

A description is given of Embodiment 5 of the present invention. Embodiment 5 is directed to an analyzer (60) for a refrigeration system (10) according to the present invention. The analyzer (60) is configured to analyze the condition of the refrigeration system as described in Embodiment 1, 2 or 3 to diagnose the conditions of its component parts.

-Configuration of Analyzer-

Figure 22:
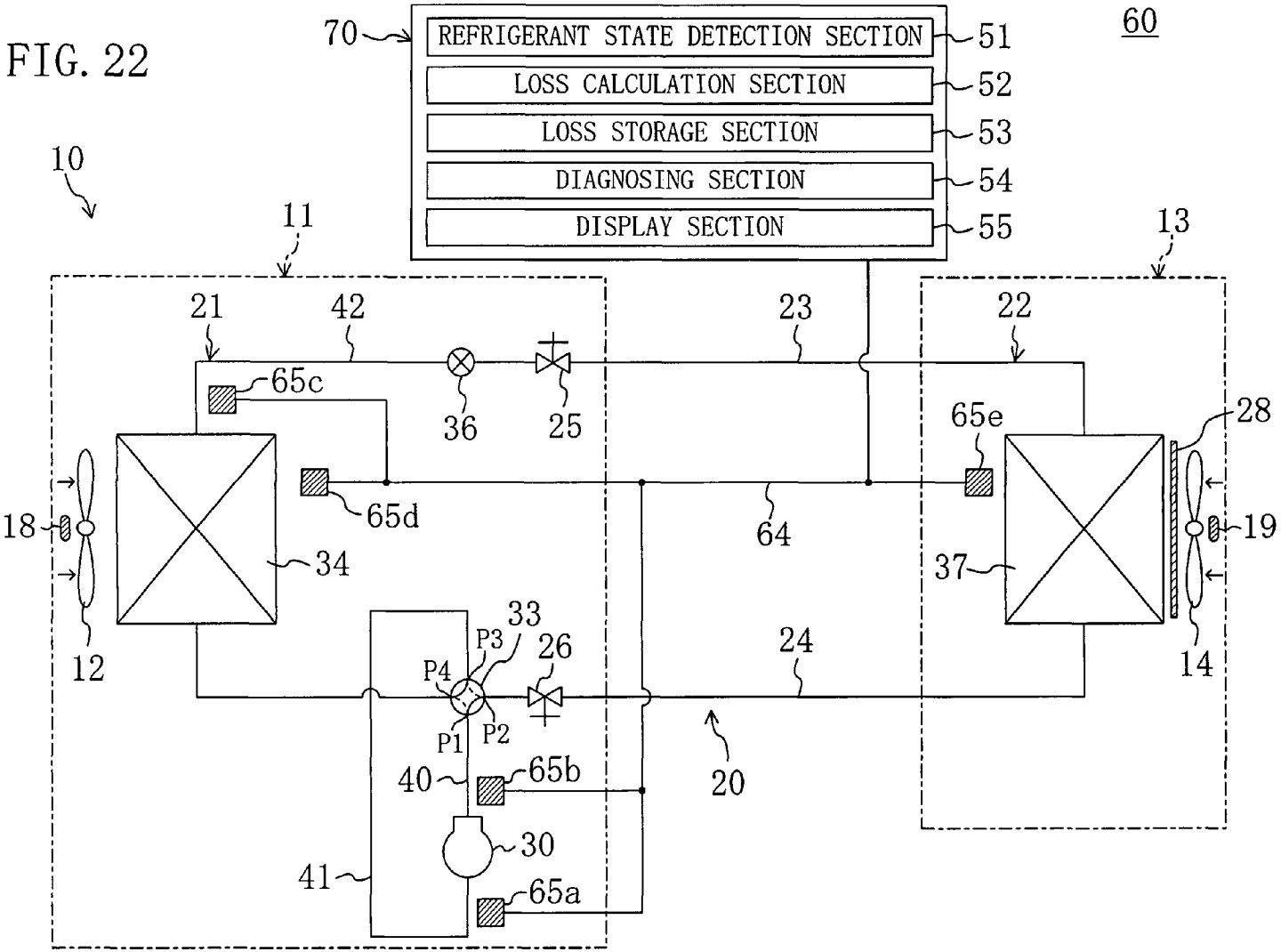
FIG. 22 is a schematic block diagram of a refrigeration system analyzer according to Embodiment 5 of the present invention.

As shown in FIG. 22, the analyzer (60) according to Embodiment 5 of the present invention includes a calculation unit (70) and a refrigerant state detection sensor (65). The calculation unit (70) includes a refrigerant state detection section (51), a loss calculation section (52), a loss storage section (53), a diagnosing section (54) and a display section (55). The calculation unit (70) is configured as an electric computer. The refrigerant state detection sensor (65) comprises five temperature sensors. When the refrigeration system (10) performs a cooling operation upon diagnosis of the condition thereof, as shown in FIG. 22, the first temperature sensor (65*a*) is mounted to the suction side of the compressor (30), the second temperature sensor (65*b*) is mounted to the discharge side of the compressor (30), the third temperature sensor (65*c*) is mounted to the liquid side of the outdoor heat exchanger (34), the fourth temperature sensor (65*d*) is mounted to the outdoor heat exchanger (34) and the fifth temperature sensor (65*e*) is mounted to the indoor heat exchanger (37). These temperature sensors (65) are connected via lead wires (64) to the calculation unit (70).

The refrigerant state detection section (51) is configured to detect, from five measured temperature values of the temperature sensors (65), the refrigerant temperatures and entropies at eight points: the entrance and exit of the compressor (30), the entrance and exit of the expansion valve (36), the entrance and exit of the outdoor heat exchanger (34), and the entrance and exit of the indoor heat exchanger (37).

The refrigerant temperature and entropy at the entrance of the outdoor heat exchanger (34) are detected as the same values as those at the exit of the compressor (30). The refrigerant temperature and entropy at the entrance of the expansion valve (36) are detected as the same values as those at the exit of the outdoor heat exchanger (34). The refrigerant temperature and entropy at the exit of the expansion valve (36) are detected as the same values as those at the entrance of the indoor heat exchanger (37). The refrigerant temperature and entropy at the exit of the indoor heat exchanger (37) are detected as the same values as those at the entrance of the compressor (30).

The loss calculation section (52), the loss storage section (53), the diagnosing section (54) and the display section (55) are generally the same as those in Embodiment 1 and, therefore, the description of their configurations is not given here.

-Operation of Analyzer-

A description is given of the operation of the analyzer (60) upon diagnosis of the conditions of the parts to be diagnosed. The diagnosis of the conditions of the parts to be diagnosed can be carried out during the cooling operation and heating operation. The following description is made with reference to the diagnosis during the cooling operation. The operations of the loss storage section (53), the diagnosing section (54) and the display section (55) are generally the same as those in Embodiment 1 and, therefore, a description is given here only of the operation of the refrigerant state detection section (51).

First, the refrigerant state detection section (51) detects the measured value of the fourth temperature sensor (65*d*) as a condensation temperature of refrigerant in the outdoor heat exchanger (34), calculates the saturated pressure of refrigerant at the condensation temperature and detects the saturated pressure as a high-side refrigerant pressure in the refrigeration cycle. In addition, the refrigerant state detection section (51) detects the measured value of the fifth temperature sensor (65*e*) as an evaporation temperature of refrigerant in the indoor heat exchanger (37), calculates the saturated pressure of refrigerant at the evaporation temperature and detects the saturated pressure as a constant refrigerant pressure in the refrigeration cycle.

Next, the refrigerant state detection section (51) uses the measured value of the first temperature sensor (65*a*) and the low-side refrigerant pressure in the refrigeration cycle to calculate the refrigerant entropy at the entrance of the compressor (30). Thus, the refrigerant temperature and entropy at the entrance of the compressor (30) are determined.

Next, the refrigerant state detection section (51) uses the measured value of the second temperature sensor (65*b*) and the high-side refrigerant pressure in the refrigeration cycle to calculate the refrigerant entropy at the exit of the compressor (30). Thus, the refrigerant temperature and entropy at the exit of the compressor (30) are determined.

Next, the refrigerant state detection section (51) uses the measured value of the third temperature sensor (65*c*) and the high-side refrigerant pressure in the refrigeration cycle to calculate the refrigerant entropy and enthalpy at the exit of the outdoor heat exchanger (34) serving as a condenser. Thus, the refrigerant temperature and entropy at the exit of the outdoor heat exchanger (34) are determined.

Finally, the refrigerant state detection section (51) detects the measured value of the fifth temperature sensor (65*e*) as the refrigerant temperature at the entrance of the indoor heat exchanger (37) serving as an evaporator. Furthermore, the refrigerant state detection section (51) uses the refrigerant enthalpy at the exit of the outdoor heat exchanger (34) to calculate the refrigerant entropy at the entrance of the indoor heat exchanger (37). Thus, the refrigerant temperature and entropy at the entrance of the indoor heat exchanger (37) are determined.

In Embodiment 5, a person having specialized knowledge about the refrigeration system (10) can carry the analyzer (60) for the refrigeration system (10) and diagnose, on a site where the refrigeration system (10) is installed, the conditions of the parts to be diagnosed. Therefore, the person having specialized knowledge about the refrigeration system (10), instead of the user of the refrigeration system (10), can precisely diagnose the conditions of the parts to be diagnosed on site. Furthermore, since the analyzer (60) for the refrigeration system (10) includes the refrigerant state detection sensor (65), it can diagnose, even for refrigeration systems (10) having no sensors for detecting the refrigerant temperatures and entropies at the exits and entrances of the main component devices, the conditions of the parts to be diagnosed.

Furthermore, in Embodiment 5, even if the refrigerant state detection sensor (65) includes no pressure sensor, the refrigerant temperatures and entropies at the exit and entrance of each main component device can be calculated. Therefore, the conditions of the parts to be diagnosed can be easily diagnosed using the easily mountable temperature sensors (65).

The refrigerant state detection section (51) in Embodiment 5 is applicable to the controllers (50) of the refrigeration systems (10) of Embodiments 1 to 3 and the analyzer (60) of Embodiment 4. In such cases, the refrigerant temperatures and entropies at the exits and entrances of the main component devices can be detected simply by mounting the five temperature sensors (45) at the points where the temperature sensors (65) are mounted in Embodiment 5.

Modification of Embodiment 5

In this modification, the analyzer (60) includes no refrigerant state detection sensor (65). The analyzer (60) is connected via lead wires to the refrigeration system (10). The refrigeration system (10) includes temperature sensors (45) and pressure sensors (46) like Embodiment 1.

The analyzer (60) of this modification diagnoses the conditions of parts to be diagnosed in the refrigeration system (10) connected thereto. In the diagnosis, the measured values of the temperature sensors (45) and pressure sensors (46) are transmitted from the refrigeration system (10) to the calculation unit (70). The refrigerant state detection section (51) uses the measured values of the temperature sensors (45) and pressure sensors (46) transmitted from the refrigeration system (10) to detect the refrigerant temperatures and entropies at the exit and entrance of each main component device of the refrigeration system (10).

Other Embodiments

The above embodiments may be configured as in the following modifications.

-First Modification-

In the above embodiments, the diagnosing section (54) may diagnose the conditions of the parts to be diagnosed based on the pattern of distribution of the values of losses produced in the circuit component parts. Specifically, the diagnosing section (54) diagnoses the conditions of the parts to be diagnosed based on the ratio of loss produced in each circuit component part to the total of losses. In this case, the loss storage section (53) previously stores an average distribution of losses in the normal operating condition. For example, when the ratio of loss due to mechanical friction in the compressor (30) at diagnosis is 10% or more larger than that in the normal operating condition, the diagnosing section (54) determines that the compressor (30) is at fault. Thus, even if the total of values of losses at diagnosis is significantly different from the total of values of losses in the normal operating condition so that it is difficult to compare the loss produced in each circuit component part at the diagnosis with that in the normal operating condition, the conditions of the parts to be diagnosed can be diagnosed.

-Second Modification-

In the above embodiments, the diagnosing section (54) may diagnose the conditions of the parts to be diagnosed by comprehensively analyzing the pattern of a change of the distribution of losses at diagnosis from the distribution of losses in the normal operating condition.

-Third Modification-

In the above embodiments, the diagnosing section (54) may diagnose the conditions of the parts to be diagnosed based on a change with time of the value of loss produced in each circuit component part. For example, the diagnosing section (54) diagnoses the condition of a part to be diagnosed by discriminating between the pattern of a change with time of the loss of the associated circuit component part during increasing air-conditioning load and the pattern of a change with time of the loss of the same circuit component part with a tendency towards deterioration.

Figure 23A:
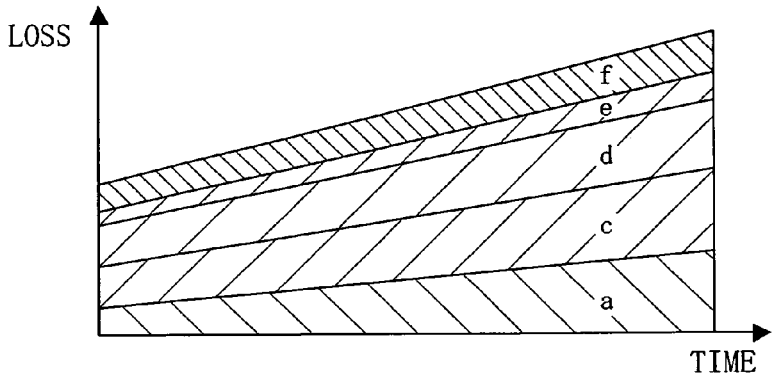
FIG. 23 is graphs showing variations with time of losses of circuit component parts in a refrigeration system according to a third modification in "Other Embodiments".

For example, as shown in FIG. 23A, when the workload of the reverse Carnot cycle relatively significantly increases, this means that an increase in air conditioning load causes an increase in the refrigerant circulating volume and thereby increases the value of loss in each circuit component part. Therefore, even if the value of loss increases, the diagnosing section (54) does not determine that the part to be diagnosed is deteriorating.

Figure 23B:
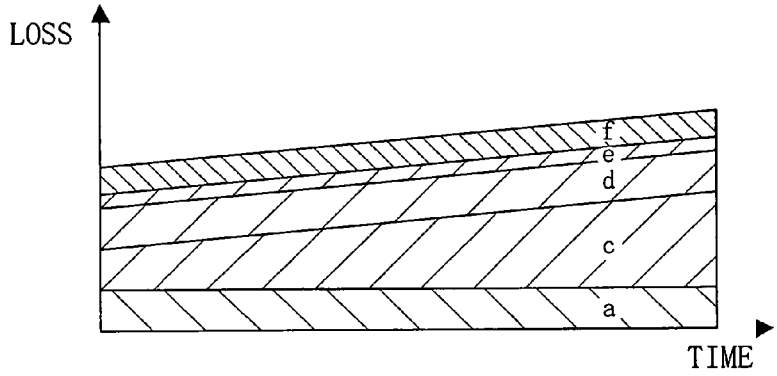

On the other hand, as shown in FIG. 23B, when the workload of the reverse Carnot cycle changes little, this means that the loss increases despite no change in air conditioning load, i.e., no change in refrigerant circulating volume. Therefore, the diagnosing section (54) determines that the part associated with the circuit component part having increased its value of loss is deteriorating. In this case, the diagnosing section (54) can detect, based on a change in air conditioning load, that a window of the room space is open and display a prompt to close the window on the display section (55).

Alternatively, the pattern of a change with time of the loss of the circuit component part at startup of the refrigeration system (10) or the pattern of a change with time of the loss of the circuit component part during defrosting operation of melting ice deposited on the evaporator can be used for diagnosis of the condition of the associated part to be diagnosed.

-Fourth Modification-

In Embodiment 1, temperature sensors (45) and pressure sensors (46) may be provided to directly detect the refrigerant temperatures and entropies at the entrance and exit of the expansion valve (36). Specifically, two pairs of one temperature sensor (45) and one pressure sensor (46) are provided, one pair between the outdoor heat exchanger (34) and the expansion valve (36) and the other pair between the expansion valve (36) and the gas side end of the outdoor circuit (21). Thus, the refrigerant pipe connecting between the outdoor heat exchanger (34) and the expansion valve (36) and the refrigerant pipe connecting between the expansion valve (36) and the indoor heat exchanger (37) can be treated as parts to be diagnosed and their conditions can be diagnosed.

Alternatively, in Embodiment 1, only four pairs of one temperature sensor (45) and one pressure sensor (46) may be provided. Specifically, unlike Embodiment 1, the temperature sensor (45) and pressure sensor (46) between the outdoor heat exchanger (34) and the four-way selector valve (33) and the temperature sensor (45) and pressure sensor (46) between the gas side end of the indoor circuit (22) and the indoor heat exchanger (37) are dispensed with.

Alternatively, in Embodiments 1, 2 and 3, the number of pressure sensors (46) provided in the refrigerant circuit may be two, one for measuring the pressure of high-pressure refrigerant and the other for measuring the pressure of low-pressure refrigerant. For example, only a suction pressure sensor (46*a*) and a discharge pressure sensor (46*b*) are pressure sensors provided in the refrigerant circuit (20). In this case, the entropies at the entrance and exit of the heat exchanger (34, 37) serving as a gas cooler are calculated using the measured value of the discharge pressure sensor (46*b*) and the entropies at the entrance and exit of the heat exchanger (34, 37) serving as an evaporator are calculated using the measured value of the suction pressure sensor (46*a*).

Alternatively, in Embodiments 1, 2 and 3, no discharge pressure sensor (46*b*) may be provided but a temperature sensor may be provided at the heat exchanger (34, 37) serving as a gas cooler to calculate the high-side refrigerant pressure in the refrigeration cycle using the measured value of the temperature sensor. Alternatively, no suction pressure sensor (46*a*) may be provided but a temperature sensor may be provided at the heat exchanger (34, 37) serving as an evaporator to calculate the low-side refrigerant pressure in the refrigeration cycle using the measured value of the temperature sensor.

-Fifth Modification-

In the above embodiments, a loss storage operation may be carried out to calculate the reference values of losses that will be stored by the loss storage section (53). The loss storage operation is carried out when the refrigeration system (10) is in the normal operating condition (for example, just after the installation of the refrigeration system (10) or before the shipment of the product). In the loss storage operation, the value of loss calculated by the loss calculation section (52) from the loss produced in each circuit component part is stored in the loss storage section (53). If the loss storage operation is carried out before the shipment of the product, whether the product is a defective or not can be detected based on the values of losses calculated by the loss calculation section (52).

-Sixth Modification-

Figure 24:
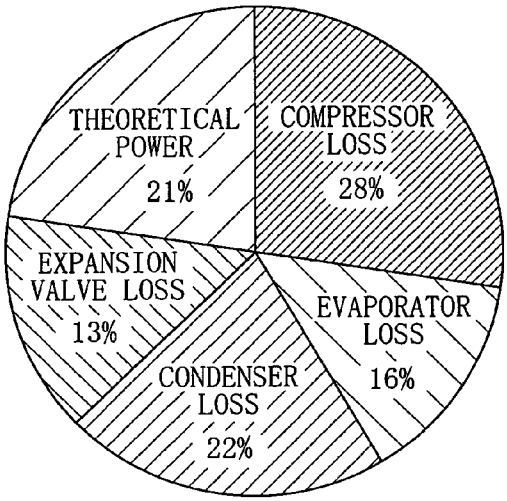
FIG. 24 is a diagram showing a way to display the losses of circuit component parts on a display section in a sixth modification in "Other Embodiments".

In the above embodiments, the display section (55) may display the respective values of losses in the individual circuit component parts or may display the respective values of losses in the individual circuit component parts in chart form. For example, as shown in FIG. 24, the display section (55) may display a pie chart representing the respective percentages of the values (instantaneous values) of losses in the circuit component parts (main component devices) with respect to the total loss (100%).

Figure 25:
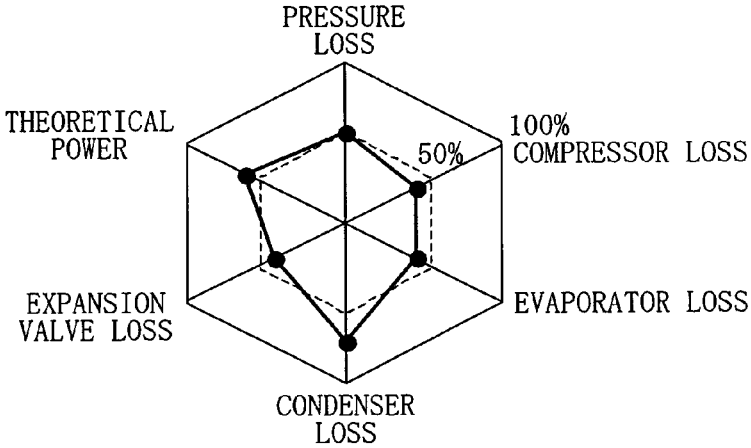
FIG. 25 is a diagram showing another way to display the losses of the circuit component parts on the display section in the sixth modification in "Other Embodiments".

Alternatively, as shown in FIG. 25, the display section (55) may display a radar chart in which the values of losses in the circuit component parts (main component devices) in the normal operating condition are set at the midpoints of the axes and the respective degrees of change in the values (instantaneous values) of losses from the midpoints are represented.

Figure 26:
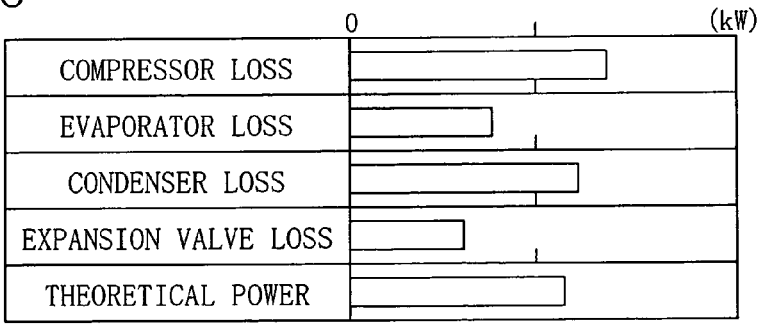
FIG. 26 is a diagram showing still another way to display the losses of the circuit component parts on the display section in the sixth modification in "Other Embodiments".

Alternatively, the display section (55) may display the respective values (instantaneous values) of losses in the circuit component parts (main component devices) in terms of electric power as shown in FIG. 26 or may display them in terms of amount of money.

Alternatively, as shown in FIG. 27, the display section (55) may include lightening parts for their respective circuit component parts (main component devices). In this case, the respective values (instantaneous values) of losses in the circuit component parts are quantized in a multi-numbering system and the conditions of the circuit component parts are indicated by states of their lightening parts. For example, when the respective values of losses in the circuit component parts are quantized in a binary system, each lightening part is configured to turn off during the normal condition of the associated circuit component part and turn on upon failure of the circuit component part. Alternatively, when the respective values of losses in the circuit component parts are quantized in a ternary system, each lightening part is configured to turn on green during the normal condition of the associated circuit component part, turn on yellow as a sign of caution and turn on red upon failure of the circuit component part. The determination to give a caution is made when the circuit component part reaches a predetermined condition near to the condition that it should be determined to be at fault.

Alternatively, as shown in FIG. 28, the display section (55) may display changes with time of the value of loss in each circuit component part (main component device) in each individual chart. Alternatively, as shown in FIG. 29, the display section (55) may display changes with time of the values of losses in the circuit component parts (main component devices) in a single chart. In this case, the chart may also show, for example, the outdoor temperature, the room temperature and the cooling capacity.

-Seventh Modification-

In Embodiments 1 to 3, the controller (50) may include no diagnosing section (54). In Embodiments 4 and 5, the analyzer (60) may include no diagnosing section (54). In these cases, the display section (55) displays the states of losses in the circuit component parts based on the calculated values of the variation calculation means (52). Specifically, the respective values of losses in the individual circuit component parts are displayed or the respective values of losses in the individual circuit component parts are displayed in chart form. The states of losses in the circuit component parts are displayed as data for diagnosing the condition of the refrigeration system (10). Since the state of loss in each circuit component part depends on the condition of the circuit component part or the condition of the associated fluid-handling part (12, 14, 28, 75, 76*b*), a person having specialized knowledge about the refrigeration system (10), for example, can diagnose the condition of the circuit component part or the condition of the associated fluid-handling part (12, 14, 28, 75, 76*b*) from the state of loss in the circuit component part displayed on the display section (55).

-Eighth Modification-

Although in the above embodiments the magnitude of energy variation of refrigerant produced in each circuit component part is calculated as a value of loss produced in the circuit component part, the magnitude of energy variation of refrigerant may be calculated as a use of power, a power requirement or a power allocation for each circuit component part. In these cases, instead of the loss calculation section (52), the power calculation section (52) for calculating the use of power, power requirement or power allocation for each circuit component part is provided as a variation calculation means.

The above embodiments are merely preferred embodiments in nature and are not intended to limit the scope, applications and use of the invention.

INDUSTRIAL APPLICABILITY

The above embodiments are merely preferred embodiments in nature and are not intended to limit the scope, applications and use of the invention.

The invention claimed is:

1. A refrigeration system that comprises a refrigerant circuit configured by connecting a plurality of circuit component parts including a compressor, a pressure reduction device and a plurality of heat exchangers and operates in a refrigeration cycle by circulating refrigerant through the refrigerant circuit, the refrigeration system further comprising:

refrigerant state detection section for detecting the refrigerant temperatures and entropies at the entrance and exit of each of the compressor, the pressure reduction device and the heat exchangers; and variation calculation section that uses the refrigerant temperatures and entropies detected by the refrigerant state detection section to separately calculate the magnitude of energy variation of refrigerant produced in each of the circuit component parts; and sets an area of a region indicating an amount of work of a reverse Carnot cycle in a temperature-entropy diagram based on a temperature of fluid exchanging heat with the refrigerant in each of the heat exchangers serving as a radiator, a temperature of fluid exchanging heat with the refrigerant in each of the heat exchangers serving as an evaporator, and refrigerant temperatures and entropies at an entrance and an exit of each of the heat exchangers serving as an evaporator, and the variation calculation section calculates an area of a region indicating energy variation of the refrigerant generated in the refrigeration cycle in the temperature-entropy diagram based on the area of region indicating the amount of work of the reverse Carnot cycle as a reference, according to energy variation of the refrigerant produced in each of the circuit component parts.

2. The refrigeration system of claim 1, further comprising:

fluid-handling parts through each of which fluid exchanging heat with the refrigerant in the associated heat exchanger flows; and diagnosing section for treating at least one of the circuit component parts and the fluid-handling parts as a part to be diagnosed and diagnosing the condition of the part to be diagnosed based on the value calculated by the variation calculation section.

3. The refrigeration system of claim 2, further comprising fans for sending air to the respective heat exchangers, the fans constituting the individual fluid-handling parts, the diagnosing section being configured to treat each of the fans as the part to be diagnosed and diagnose the condition of each of the fans based on the value calculated by the variation calculation section.

4. The refrigeration system of claim 2 or 3, wherein the variation calculation section calculates the magnitude of energy variation of refrigerant produced in each of the circuit component parts as a value of loss produced in the circuit component part, and the diagnosing section diagnoses the condition of the part to be diagnosed based on the value calculated as the value of loss by the variation calculation section.

5. The refrigeration system of claim 4, wherein the variation calculation section separately calculates the value of each of plural types of losses produced in each of the heat exchangers, and the diagnosing section diagnoses, for the losses produced in each of the heat exchangers, the condition of the part to be diagnosed based on the value calculated for each of the plural types of losses by the variation calculation section.

6. The refrigeration system of claim 4, wherein the refrigerant circuit includes a main circuit including the compressor for compressing the refrigerant to a high-side pressure in the refrigeration cycle and a plurality of branch circuits connected in parallel with each other to the main circuit, the refrigeration system further comprises flow volume calculation section for calculating the refrigerant flow volume in each of the branch circuits, and the variation calculation section calculates the value of loss produced in each of the circuit component parts using the refrigerant flow volume in each of the branch circuits calculated by the flow volume calculation section.

7. The refrigeration system of claim 6, wherein the refrigerant circuit includes the plurality of branch circuits provided with their respective heat exchangers, and the variation calculation section calculates the value of loss produced in the heat exchanger in each of the branch circuits using the refrigerant flow volume in the branch circuit calculated by the flow volume calculation section.

8. The refrigeration system of claim 4, further comprising loss storage section for storing the magnitude of loss produced in each of the circuit component parts in a normal operating condition as a reference value of loss, the diagnosing section being configured to diagnose the condition of the part to be diagnosed based on the value calculated by the variation calculation section and the reference value of loss stored in the loss storage section.

9. The refrigeration system of claim 8, wherein the diagnosing section diagnoses the condition of the part to be diagnosed by comparing, for the loss produced in each of the circuit component parts, the value of loss calculated by the variation calculation section with the reference value of loss stored in the loss storage section.

10. The refrigeration system of claim 8, wherein the loss storage section stores the reference values of losses in normal operating conditions under a plurality of operating situations, and the diagnosing section uses, out of the reference values of losses stored in the loss storage section, the reference value of loss under the operating situation corresponding to the operating situation at diagnosis to diagnose the condition of the part to be diagnosed.

11. The refrigeration system of claim 2, wherein the diagnosing section diagnoses the condition of the part to be diagnosed based on a variation with time of the value calculated by the variation calculation section.

12. The refrigeration system of claim 1 or 2, wherein the refrigerant circuit is provided with pairs of one temperature sensor and one pressure sensor, one pair at each of one end and the other end of each of the compressor and the heat exchangers, to measure the refrigerant temperatures and pressures at the entrances and exits of the compressor and the heat exchangers, and the refrigerant state detection section is configured to consider the refrigerant temperature and entropy at the entrance of the pressure reduction device as the same values as those at the exit of the heat exchanger serving as a gas cooler and consider the refrigerant temperature and entropy at the exit of the pressure reduction device as the same values as those at the entrance of the heat exchanger serving as an evaporator.

13. A refrigeration system analyzer for analyzing the condition of a refrigeration system that comprises a refrigerant circuit configured by connecting a plurality of circuit component parts including a compressor, a pressure reduction device and a plurality of heat exchangers and operates in a refrigeration cycle by circulating refrigerant through the refrigerant circuit, the refrigeration system analyzer being connected to the refrigeration system, the refrigeration system analyzer comprising:

refrigerant state detection section for detecting the refrigerant temperatures and entropies at the entrance and exit of each of the compressor, the pressure reduction device and the heat exchangers;

variation calculation section that uses the refrigerant temperatures and entropies detected by the refrigerant state detection section to separately calculate the magnitude of energy variation of refrigerant produced in each of the circuit component parts and sets an area of a region indicating an amount of work of a reverse Carnot cycle in a temperature-entropy diagram based on a temperature of fluid exchanging heat with the refrigerant in each of the heat exchangers serving as a radiator, a temperature of fluid exchanging heat with the refrigerant in each of the heat exchangers serving as an evaporator, and refrigerant temperatures and entropies at an entrance and an exit of each of the heat exchangers serving as an evaporator, wherein the variation calculation section calculates an area of a region indicating energy variation of the refrigerant generated in the refrigeration cycle in the temperature-entropy diagram based on the area of the region indicating the amount of work of the reverse Carnot cycle as a reference, according to energy variation of the refrigerant produced in each of the circuit component parts; and a display for displaying an analysis result on the condition of the refrigeration system based on the value calculated by the variation calculation section.

14. The refrigeration system analyzer of claim 13, wherein the refrigeration system further comprises fluid-handling parts through each of which fluid exchanging heat with the refrigerant in the associated heat exchanger flows, the refrigeration system analyzer further comprises diagnosing section for treating at least one of the circuit component parts and the fluid-handling parts as a part to be diagnosed and diagnosing the condition of the part to be diagnosed based on the value calculated by the variation calculation section, and the display displays, as the analysis result on the condition of the refrigeration system, a diagnosis result of the diagnosing section on the condition of the part to be diagnosed.

15. The refrigeration system analyzer of any one of claims 13 or 14, wherein the refrigeration system analyzer is composed of:

a first component unit that includes at least a refrigerant state detection sensor for detecting states of refrigerant in the refrigerant circuit necessary to detect the refrigerant temperatures and entropies at the entrance and exit of each of the compressor, the pressure reduction device and the heat exchangers and is disposed in the refrigeration system; and a second component unit including at least a display and disposed away from the refrigeration system, and the first component unit and the second component unit are connected to each other via communication lines.

16. The refrigeration system analyzer of any one of claims 13 or 14, further comprising a refrigerant state detection sensor for detecting states of refrigerant in the refrigerant circuit necessary to detect the refrigerant temperatures and entropies at the entrance and exit of each of the compressor, the pressure reduction device and the heat exchangers, the refrigerant state detection sensor being mountable to the refrigerant circuit (20), the refrigerant state detection section using measured values of the refrigerant state detection sensor to calculate the refrigerant temperatures and entropies at the entrance and exit of each of the compressor, the pressure reduction device and the heat exchangers.

17. A diagnosing method of, in a refrigeration system operating in a refrigeration cycle by circulating refrigerant through a refrigerant circuit, diagnosing conditions of circuit component parts of the refrigerant circuit including a compressor, a pressure reduction device and a plurality of heat exchangers, the method comprising:

a refrigerant state detection step of detecting refrigerant temperatures and entropies at an entrance and an exit of each of the compressor, the pressure reduction device, and the heat exchangers;

a variation calculation step of separately calculating a magnitude of energy variation of refrigerant produced in each of the circuit component parts by using the refrigerant temperatures and entropies detected in the refrigerant state detection step and setting an area of a region indicating an amount of work of a reverse Carnot cycle in a temperature-entropy diagram based on a temperature of fluid exchanging heat with the refrigerant in each of the heat exchangers serving as a radiator, a temperature of fluid exchanging heat with the refrigerant in each of the heat exchangers serving as an evaporator, and the refrigerant temperatures and entropies at an entrance and an exit of each of the heat exchangers serving as an evaporator is performed;

a step of calculating an area of a region indicating energy variation of the refrigerant generated in the refrigeration cycle in the temperature-entropy diagram based on the area of the region indicating the amount of work of the reverse Carnot cycle as a reference, according to energy variation of the refrigerant produced in each of the circuit component parts is performed; and a diagnosing step of treating at least one of the circuit component parts as a part to be diagnosed, and diagnosing a condition of the part to be diagnosed based on the magnitude of energy variation calculated by the variation calculation step.

* * * * *